US011393405B2

(12) United States Patent
Feng et al.

(10) Patent No.: US 11,393,405 B2
(45) Date of Patent: Jul. 19, 2022

(54) SHIFT REGISTER UNIT CIRCUIT AND DRIVE METHOD, AND GATE DRIVER AND DISPLAY DEVICE

(71) Applicants: HEFEI BOE JOINT TECHNOLOGY CO., LTD., Anhui (CN); BOE TECHNOLOGY GROUP CO., LTD., Beijing (CN)

(72) Inventors: Xuehuan Feng, Beijing (CN); Yongqian Li, Beijing (CN)

(73) Assignees: HEFEI BOE JOINT TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/417,675

(22) PCT Filed: Oct. 15, 2020

(86) PCT No.: PCT/CN2020/121140

§ 371 (c)(1),
(2) Date: Jun. 23, 2021

(87) PCT Pub. No.: WO2021/088613

PCT Pub. Date: May 14, 2021

(65) Prior Publication Data

US 2022/0114970 A1 Apr. 14, 2022

(30) Foreign Application Priority Data

Nov. 4, 2019 (CN) ..... 201911065920.0

(51) Int. Cl.
*G09G 3/3266* (2016.01)
*G09G 3/36* (2006.01)

(52) U.S. Cl.
CPC ... *G09G 3/3266* (2013.01); *G09G 2300/0426* (2013.01); *G09G 2310/0286* (2013.01); *G09G 2310/061* (2013.01); *G09G 2310/08* (2013.01)

(58) Field of Classification Search
CPC ..... G09G 3/3266; G09G 2310/0286
See application file for complete search history.

(56) References Cited

U.S. PATENT DOCUMENTS 9,129,577 B2 * 9/2015 Park ..... G09G 3/3677
2012/0140871 A1 6/2012 Yang et al.
(Continued)

FOREIGN PATENT DOCUMENTS

CN 102063858 A 5/2011
CN 103345941 A 10/2013
(Continued)

OTHER PUBLICATIONS

"First Office Action and English language translation", CN Application No. 201911065920.0, dated Feb. 4, 2021, 11 pp.
(Continued)

*Primary Examiner* — Sepehr Azari
(74) *Attorney, Agent, or Firm* — Myers Bigel, P.A.

(57) ABSTRACT

Provided are a shift register unit circuit and drive method, and a gate driver and a display device. The shift register unit circuit includes a first sub-unit circuit, a second sub-unit circuit, a third sub-unit circuit, and a fourth sub-unit circuit. Responsive to providing a corresponding input pulse and clock signal, the shift register unit circuit is configured output first, second, third, and fourth output signals. The shift register unit circuit is configured such that a fifth node is in conduction with a second node at least while the reset pulse is active.

20 Claims, 25 Drawing Sheets

(56) References Cited

U.S. PATENT DOCUMENTS

| | | | | |
|---|---|---|---|---|
| 2015/0077319 | A1 | 3/2015 | Yao et al. | |
| 2015/0287376 | A1* | 10/2015 | Lim | G09G 3/3677 345/92 |
| 2016/0180964 | A1* | 6/2016 | Hu | G09G 3/3677 377/64 |
| 2016/0210890 | A1* | 7/2016 | Lim | G09G 3/20 |
| 2017/0115808 | A1* | 4/2017 | Cho | G06F 3/04184 |
| 2017/0193950 | A1 | 7/2017 | Kim et al. | |
| 2017/0287424 | A1 | 10/2017 | Wu et al. | |
| 2018/0096645 | A1* | 4/2018 | Lee | G09G 3/2092 |
| 2018/0337682 | A1* | 11/2018 | Takasugi | H03K 21/18 |
| 2021/0201751 | A1* | 7/2021 | Feng | G09G 3/2092 |
| 2021/0201774 | A1* | 7/2021 | Feng | G11C 19/28 |
| 2021/0201805 | A1* | 7/2021 | Feng | G09G 3/3275 |
| 2021/0335199 | A1 | 10/2021 | Yuan et al. | |
| 2021/0335203 | A1* | 10/2021 | Feng | G09G 3/3266 |
| 2022/0020326 | A1* | 1/2022 | Feng | G09G 3/3225 |

FOREIGN PATENT DOCUMENTS

| | | | |
|---|---|---|---|
| CN | 105225625 | A | 1/2016 |
| CN | 105761663 | A | 7/2016 |
| CN | 105788555 | A | 7/2016 |
| CN | 205992407 | U | 3/2017 |
| CN | 106935215 | A | 7/2017 |
| CN | 107886913 | A | 4/2018 |
| CN | 108597438 | A | 9/2018 |
| CN | 109935204 | A | 6/2019 |
| CN | 110619838 | A | 12/2019 |
| KR | 20130010715 | A | 1/2013 |
| KR | 101237199 | B1 | 2/2013 |

OTHER PUBLICATIONS

"International Search Report and Written Opinion of the International Searching Authority with English translation of ISR", International Application No. PCT/CN2020/121140, dated Jan. 14, 2021, 13 pp.

"Second Office Action and English language translation", CN Application No. 201911065920.0, dated Jun. 9, 2021, 13 pp.

* cited by examiner

SHIFT REGISTER UNIT CIRCUIT AND DRIVE METHOD, AND GATE DRIVER AND DISPLAY DEVICE

CROSS REFERENCE TO RELATED APPLICATIONS

The present application is a 35 U.S.C. 371 national stage application of PCT International Application No. PCT/CN2020/121140, filed on Oct. 15, 2020, which claims priority to Chinese patent application No. 201911065920.0, with application date Nov. 4, 2019, and entitled "SHIFT REGISTER UNIT CIRCUIT AND DRIVE METHOD, AND GATE DRIVER AND DISPLAY DEVICE", the entire contents of which are incorporated herein by reference.

TECHNICAL FIELD

The present disclosure relates to the generation of gate driving signals, in particular, to a shift register unit circuit and a drive method thereof, a gate driver including the shift register unit circuit, and a display device including the gate driver.

BACKGROUND

A gate driver (also referred to as a GOA) that includes a plurality of cascaded shift register unit circuits can operate to generate and supply gate driving signals to the pixel array of a display panel. In the display field, particularly in liquid crystal display (LCD) and organic light emitting diode (also referred to as OLED) display technologies, gate driving circuits are an effective means of reducing panel defects and lowering costs. The gate driving circuit used in current OLED display devices generally comprises three sub-circuits, namely: a detection sub-circuit, a display sub-circuit, and a connection sub-circuit that outputs combined pulses of the two aforementioned. However, the structure of this circuit is very complex and cannot meet the requirements of high resolution and narrow border of the display device. Therefore, it is always desired in the field to provide a simplified GOA circuit structure, and also to avoid the output waveform anomaly problem caused by the simplified circuit.

SUMMARY

According to an aspect of the present disclosure, there is provided a shift register unit circuit that includes: a first sub-unit circuit including: a first sub-unit input circuit configured to: in response to a first input pulse received from a first input terminal being active, bring the first input terminal into conduction with a first node and a second node, and in response to the first input pulse being inactive, disconnect the first input terminal from the first node and the second node in conduction; a first sub-unit output circuit configured to: in response to the first node being at an active potential, bring a first clock terminal configured to receive a first clock signal into conduction with a first output terminal configured to output a first output signal, and in response to the first node being at an inactive potential, disconnect the first clock terminal from the first output terminal in conduction; a first sub-unit reset circuit configured to: in response to a reset pulse received from the reset terminal being active, bring the first node and the second node into conduction with a first voltage terminal configured to be applied with a first voltage signal, and in response to the reset pulse being inactive, disconnect the first node and the second node from the first voltage terminal in conduction; a second sub-unit circuit including: a second sub-unit input circuit configured to: in response to the first input pulse being active, bring the second node into conduction with a third node, and in response to the first input pulse being inactive, disconnect the second node from the third node in conduction; a second sub-unit output circuit configured to: in response to the third node being at an active potential, bring a second clock terminal configured to receive a second clock signal into conduction with a second output terminal configured to output a second output signal, and in response to the third node being at an inactive potential, disconnect the second clock terminal from the second output terminal in conduction; a second sub-unit reset circuit configured to: in response to the reset pulse being active, bring the third node into conduction with the second node, and in response to the reset pulse being inactive, disconnect the third node from the second node in conduction; a third sub-unit circuit including: a third sub-unit input circuit configured to: in response to a second input pulse received from a second input terminal being active, bring the second input terminal into conduction with a fourth node and a fifth node, and in response to the second input pulse being inactive, disconnect the second input terminal from the fourth node and the fifth node in conduction; a third sub-unit output circuit configured to: in response to the fourth node being at an active potential, bring a third clock terminal configured to receive a third clock signal into conduction with a third output terminal configured to output a third output signal, and in response to the fourth node being at an inactive potential, disconnect the third clock terminal and the third output terminal in conduction; a third sub-unit reset circuit configured to: in response to the reset pulse being active, bring the fourth node into conduction with the fifth node, and in response to the reset pulse being inactive, disconnect the fourth node from the fifth node in conduction; a fourth sub-unit circuit including: a fourth sub-unit input circuit configured to: in response to the second input pulse being active, bring the fifth node into conduction with a sixth node, and in response to the second input pulse being inactive, disconnect the fifth node from the sixth node in conduction; a fourth sub-unit output circuit configured to: in response to the sixth node being at an active potential, bring a fourth clock terminal configured to receive a fourth clock signal into conduction with a fourth output terminal configured to output a fourth output signal, and in response to the sixth node being at an inactive potential, disconnect the fourth clock terminal from the fourth output terminal in conduction; a fourth sub-unit reset circuit configured to: in response to the reset pulse being active, bring the sixth node into conduction with the fifth node, and in response to the reset pulse being inactive, disconnect the sixth node from the fifth node in conduction, wherein the fifth node is in conduction with the second node at least while the reset pulse is active.

In some exemplary embodiments, the fifth node is connected with the second node by a wire.

In some exemplary embodiments, the shift register unit circuit further includes a conduction control circuit configured to: in response to at least one of the fourth node and the sixth node being at an active potential, bring the fifth node into conduction with the second node, and in response to both the fourth node and the sixth node being at an inactive potential, disconnect the fifth node from the second node in conduction.

In some exemplary embodiments, the conduction control circuit includes: a sixteenth transistor having a first electrode connected to the second node, a second electrode connected to the fifth node and a control electrode connected to the fourth node; a seventeenth transistor having a first electrode connected to the second node, a second electrode connected to the fifth node and a control electrode connected to the sixth node.

In some exemplary embodiments, the shift register unit circuit further includes a conduction control circuit configured to: in response to the fifth node being at an active potential, bring the fifth node into conduction with the second node, and in response to the fifth node being at an inactive potential, disconnect the fifth node from the second node in conduction.

In some exemplary embodiments, the conduction control circuit includes an eighteenth transistor having a first electrode connected to the second node, and having a second electrode and a control electrode both connected to the fifth node.

In some exemplary embodiments, the first sub-unit input circuit includes: a first transistor having a first electrode and a control electrode both connected to the first input terminal, and a second electrode connected to the second node; a second transistor having a first electrode connected to the second node, a second electrode connected to the first node, and a control electrode connected to the first input terminal, the first sub-unit output circuit includes: a third transistor having a first electrode connected to the first clock terminal, a second electrode connected to the first output terminal, and a control electrode connected to the first node; a first capacitor having a first electrode connected to the first node and a second electrode connected to the first output terminal, the first sub-unit reset circuit includes: a fourth transistor having a first electrode connected to the first node, a second electrode connected to the second node, and a control electrode connected to the reset terminal; a fifth transistor having a first electrode connected to the second node, a second electrode connected to the first voltage terminal, and a control electrode connected to the reset terminal, the second sub-unit input circuit includes a sixth transistor having a first electrode connected to the second node, a second electrode connected to the third node, and a control electrode connected to the first input terminal, the second sub-unit output circuit includes: a seventh transistor having a first electrode connected to the second clock terminal, a second electrode connected to the second output terminal, and a control electrode connected to the third node; a second capacitor having a first electrode connected to the third node and a second electrode connected to the second output terminal, the second sub-unit reset circuit includes an eighth transistor having a first electrode connected to the third node, a second electrode connected to the second node, and a control electrode connected to the reset terminal, the third sub-unit input circuit includes: a ninth transistor having a first electrode and a control electrode both connected to the second input terminal, and a second electrode connected to the fifth node; a tenth transistor having a first electrode connected to the fifth node, a second electrode connected to the fourth node, and a control electrode connected to the second input terminal, the third sub-unit output circuit includes: an eleventh transistor having a first electrode connected to the third clock terminal, a second electrode connected to the third output terminal, and a control electrode connected to the fourth node; a third capacitor having a first electrode connected to the fourth node and a second electrode connected to the third output terminal, the third sub-unit reset circuit includes a twelfth transistor having a first electrode connected to the fourth node, a second electrode connected to the fifth node, and a control electrode connected to the reset terminal, the fourth sub-unit input circuit includes a thirteenth transistor having a first electrode connected to the fifth node, a second electrode connected to the sixth node, and a control electrode connected to the second input terminal, the fourth sub-unit output circuit includes: a fourteenth transistor having a first electrode connected to the fourth clock terminal, a second electrode connected to the fourth output terminal, and a control electrode connected to the sixth node; a fourth capacitor having a first electrode connected to the sixth node and a second electrode connected to the fourth output terminal, the fourth sub-unit reset circuit includes a fifteenth transistor having a first electrode connected to the sixth node, a second electrode connected to the fifth node, and a control electrode connected to the reset terminal.

In some exemplary embodiments, the first sub-unit circuit further includes: a first sub-unit transfer circuit configured to: in response to the first node being at an active potential, bring a first transfer clock terminal configured to receive a first transfer clock signal into conduction with a first transfer terminal configured to output a first transfer signal, and in response to the first node being at an inactive potential, disconnect the first transfer clock terminal from the first transfer terminal in conduction; a first sub-unit first control circuit configured to: when a third voltage terminal configured to be applied with a third voltage signal is at an active potential, in response to either of the first node and the fourth node being at an active potential, disconnect the third voltage terminal from the seventh node in conduction, and in response to the first node being at an active potential, bring the seventh node into conduction with the first voltage terminal, and in response to both the first node and the fourth node being at an inactive potential, disconnect the seventh node from the first voltage terminal in conduction and bring the seventh node into conduction with the third voltage terminal; when the third voltage terminal is at an inactive potential, in response to the first node being at an active potential, bring the seventh node into conduction with the first voltage terminal, in response to the first node being at an inactive potential, disconnect the seventh node from the first voltage terminal in conduction; a first sub-unit second control circuit configured to: in response to the seventh node being at an active potential, bring the first transfer terminal into conduction with the first voltage terminal and bring the first output terminal into conduction with a second voltage terminal configured to be applied with a second voltage signal, and in response to the seventh node being at an inactive potential, disconnect the first transfer terminal from the first voltage terminal in conduction, and disconnect the first output terminal from the second voltage terminal in conduction; a first sub-unit third control circuit configured to: in response to the seventh node being at an active potential, bring the first node and the second node into conduction with the first voltage terminal, and in response to the seventh node being at an inactive potential, disconnect the first node and the second node from the first voltage terminal in conduction, the second sub-unit circuit further includes: a second sub-unit first control circuit configured to: in response to the seventh node being at an active potential, bring the second output terminal into conduction with the second voltage terminal, and in response to the seventh node being at an inactive potential, disconnect the second output terminal from the second voltage terminal in conduction; a second sub-unit second control circuit configured to: in response to the seventh node being at an active potential, bring the third node into conduction with the second node, and in response to the seventh node being at an inactive potential, disconnect the third node from the second node in conduction, the third sub-unit circuit further includes: a third sub-unit transfer circuit configured to: in response to the fourth node being at an active potential, bring a second transfer clock terminal configured to receive a second transfer clock signal into conduction with a second transfer terminal configured to output a second transfer signal, and in response to the fourth node being at an inactive potential, disconnect the second transfer clock terminal from the second transfer terminal in conduction; a third sub-unit first control circuit configured to: in response to the seventh node being at an active potential, bring the second transfer terminal into conduction with the first voltage terminal and bring the third output terminal into conduction with the second voltage terminal, and in response to the seventh node being at an inactive potential, disconnect the second transfer terminal from the first voltage terminal in conduction and disconnect the third output terminal from the second voltage terminal in conduction; a third sub-unit second control circuit configured to: in response to the seventh node being at an active potential, bring the fourth node into conduction with the fifth node, and in response to the seventh node being at an inactive potential, disconnect the fourth node from the fifth node in conduction, the fourth sub-unit circuit further includes: a fourth sub-unit first control circuit configured to: in response to the seventh node being at an active potential, bring the fourth output terminal into conduction with the second voltage terminal, and in response to the seventh node being at an inactive potential, disconnect the fourth output terminal from the second voltage terminal in conduction; a fourth sub-unit second control circuit configured to: in response to the seventh node being at an active potential, bring the fifth node into conduction with the sixth node, and in response to the seventh node being at an inactive potential, disconnect the fifth node from the sixth node in conduction.

In some exemplary embodiments, the first sub-unit transfer circuit includes a twenty-third transistor having a first electrode connected to the first transfer clock terminal, a second electrode connected to the first transfer terminal, and a control electrode connected to the first node, the first sub-unit first control circuit includes: a twenty-fourth transistor having a first electrode connected to the third voltage terminal and a second electrode connected to the seventh node; a twenty-fifth transistor having a first electrode and a control electrode both connected to the third voltage terminal; a twenty-sixth transistor having a second electrode connected to the second voltage terminal and a control electrode connected to the fourth node; a twenty-seventh transistor having a control electrode connected to the first node and a second electrode connected to the second voltage terminal; a twenty-eighth transistor having a first electrode connected to the seventh node, a second electrode connected to the first voltage terminal, and a control electrode connected to the first node, wherein a control electrode of the twenty-fourth transistor, a second electrode of the twenty-fifth transistor, a first electrode of the twenty-sixth transistor and a first electrode of the twenty-seventh transistor are connected together, the first sub-unit second control circuit includes: a nineteenth transistor having a first electrode connected to the first transfer terminal, a second electrode connected to the first voltage terminal, and a control electrode connected to the seventh node; a twentieth transistor having a first electrode connected to the first output terminal, a second electrode connected to the second voltage terminal, and a control electrode connected to the seventh node, the first sub-unit third control circuit includes: a twenty-first transistor having a first electrode connected to the first node, a second electrode connected to the second node, and a control electrode connected to the seventh node; a twenty-second transistor having a first electrode connected to the second node, a second electrode connected to the first voltage terminal, and a control electrode connected to the seventh node, the second sub-unit first control circuit includes a twenty-ninth transistor having a first electrode connected to the second output terminal, a second electrode connected to the second voltage terminal, and a control electrode connected to the seventh node, the second sub-unit second control circuit includes a thirtieth transistor having a first electrode connected to the third node, a second electrode connected to the second node, and a control electrode connected to the seventh node, the third sub-unit transfer circuit includes a thirty-fourth transistor having a first electrode connected to the second transfer clock terminal, a second electrode connected to the second transfer terminal, and a control electrode connected to the fourth node, the third sub-unit first control circuit includes: a thirty-first transistor having a first electrode connected to the second transfer terminal, a second electrode connected to the first voltage terminal, and a control electrode connected to the seventh node; a thirty-second transistor having a first electrode connected to the third output terminal, a second electrode connected to the second voltage terminal, and a control electrode connected to the seventh node, the third sub-unit second control circuit includes a thirty-third transistor having a first electrode connected to the fourth node, a second electrode connected to the fifth node, and a control electrode connected to the seventh node, the fourth sub-unit first control circuit includes a thirty-sixth transistor having a first electrode connected to the fourth output terminal, a second electrode connected to the second voltage terminal, and a control electrode connected to the seventh node, the fourth sub-unit second control circuit includes a thirty-fifth transistor having a first electrode connected to the sixth node, a second electrode connected to the fifth node, and a control electrode connected to the seventh node.

In some exemplary embodiments, the shift register unit circuit further includes: a fourth voltage terminal configured to be applied with a fourth voltage signal; the first sub-unit circuit further including: a first sub-unit fourth control circuit configured to: in response to an eighth node being at an active potential, bring the first transfer terminal into conduction with the first voltage terminal and bring the first output terminal into conduction with the second voltage terminal, and in response to the eighth node being at an inactive potential, disconnect the first transfer terminal from the first voltage terminal in conduction and disconnect the first output terminal from the second voltage terminal in conduction; a first sub-unit fifth control circuit configured to: in response to the eighth node being at an active potential, bring the first node and the second node into conduction with the first voltage terminal, and in response to the eighth node being at an inactive potential, disconnect the first node and the second node from the first voltage terminal in conduction; the second sub-unit circuit further including: a second sub-unit third control circuit configured to: in response to the eighth node being at an active potential, bring the second output terminal into conduction with the second voltage terminal, and in response to the eighth node being at an inactive potential, disconnect the second output terminal from the second voltage terminal in conduction; a second sub-unit fourth control circuit configured to: in response to the eighth node being at an active potential, bring the third node into conduction with the second node, and in response to the eighth node being at an inactive potential, disconnect the third node from the second node in conduction; the third sub-unit circuit further including: a third sub-unit third control circuit configured to: when the fourth voltage terminal is at an active potential, in response to either of the first node and the fourth node being at an active potential, disconnect the fourth voltage terminal from the eighth node in conduction, in response to the fourth node being at an active potential, bring the eighth node into conduction with the first voltage terminal, and in response to both the first node and the fourth node being at an inactive potential, disconnect the eighth node from the first voltage terminal in conduction and bring the eighth node into conduction with the fourth voltage terminal; when the fourth voltage terminal is at an inactive potential, in response to the fourth node being at an active potential, bring the eighth node into conduction with the first voltage terminal, and in response to the fourth node being at an inactive potential, disconnect the eighth node from the first voltage terminal in conduction; a third sub-unit fourth control circuit configured to: in response to the eighth node being at an active potential, bring the second transfer terminal into conduction with the first voltage terminal and bring the third output terminal into conduction with the second voltage terminal, and in response to the eighth node being at an inactive potential, disconnect the second transfer terminal from the first voltage terminal in conduction and disconnect the third output terminal from the second voltage terminal in conduction; a third sub-unit fifth control circuit configured to: in response to the eighth node being at an active potential, bring the fourth node into conduction with the fifth node, and in response to the eighth node being at an inactive potential, disconnect the fourth node from the fifth node in conduction; the fourth sub-unit circuit further including: a fourth sub-unit third control circuit configured to: in response to the eighth node being at an active potential, bring the fourth output terminal into conduction with the second voltage terminal, and in response to the eighth node being at an inactive potential, disconnect the fourth output terminal from the second voltage terminal in conduction; a fourth sub-unit fourth control circuit configured to: in response to the eighth node being at an active potential, bring the fifth node into conduction with the sixth node, and in response to the eighth node being at an inactive potential, disconnect the fifth node from the sixth node in conduction.

In some exemplary embodiments, the first sub-unit fourth control circuit includes: a thirty-seventh transistor having a first electrode connected to the first transfer terminal, a second electrode connected to the first voltage terminal, and a control electrode connected to the eighth node; a thirty-eighth transistor having a first electrode connected to the first output terminal, a second electrode connected to the second voltage terminal, and a control electrode connected to the eighth node; the first sub-unit fifth control circuit includes: a thirty-ninth transistor having a first electrode connected to the first node, a second electrode connected to the second node, and a control electrode connected to the eighth node; a fortieth transistor having a first electrode is connected to the second node, a second electrode connected to the first voltage terminal, and a control electrode connected to the eighth node, the second sub-unit third control circuit includes a forty-second transistor having a first electrode connected to the second output terminal, a second electrode connected to the second voltage terminal, and a control electrode connected to the eighth node, the second sub-unit fourth control circuit includes a forty-first transistor having a first electrode connected to the third node, a second electrode connected to the second node, and a control electrode connected to the eighth node, the third sub-unit third control circuit includes: a forty-sixth transistor having a first electrode connected to the fourth voltage terminal and a second electrode connected to the eighth node; a forty-seventh transistor having a first electrode and a control electrode both connected to the fourth voltage terminal; a forty-eighth transistor having a second electrode connected to the second voltage terminal and a control electrode connected to the first node; a forty-ninth transistor having a control electrode connected to the fourth node and a second electrode connected to the second voltage terminal; a fiftieth transistor having a first electrode connected to the eighth node, a second electrode connected to the first voltage terminal, and a control electrode connected to the fourth node; wherein a control electrode of the forty-sixth transistor, a second electrode of the forty-seventh transistor, a first electrode of the forty-eighth transistor, and a first electrode of the forty-ninth transistor are connected together, the third sub-unit fourth control circuit includes: a forty-third transistor having a first electrode connected to the second transfer terminal, a second electrode connected to the first voltage terminal, and a control electrode connected to the eighth node; a forty-fourth transistor having a first electrode connected to the third output terminal, a second electrode connected to the second voltage terminal, and a control electrode connected to the eighth node, the third sub-unit fifth control circuit includes a forty-fifth transistor having a first electrode connected to the fourth node, a second electrode connected to the fifth node, and a control electrode connected to the eighth node, the fourth sub-unit third control circuit includes a fifty-second transistor having a first electrode connected to the fourth output terminal, a second electrode connected to the second voltage terminal, and a control electrode connected to the eighth node, the fourth sub-unit fourth control circuit includes a fifty-first transistor having a first electrode connected to the sixth node, a second electrode connected to the fifth node, and a control electrode connected to the eighth node.

In some exemplary embodiments, the shift register unit circuit further includes: a fifth voltage terminal configured to be applied with a fifth voltage signal; a reset terminal configured to receive a reset pulse; the first sub-unit circuit further including: a first sub-unit sixth control circuit configured to: in response to the first node being at an active potential, bring the second node into conduction with the fifth voltage terminal, and in response to the first node being at an inactive potential, disconnect the second node from the fifth voltage terminal in conduction; a first sub-unit seventh control circuit configured to: in response to the first input pulse being active, bring the seventh node into conduction with the first voltage terminal, and in response to the first input pulse being inactive, disconnect the seventh node from the first voltage terminal in conduction; a first sub-unit reset circuit configured to: in response to the reset pulse being active, bring the first node and the second node into conduction with the first voltage terminal, and in response to the reset pulse being inactive, disconnect the first node and the second node from the first voltage terminal in conduction; the second sub-unit circuit further including a second sub-unit reset circuit configured to: in response to the reset pulse being active, bring the third node into conduction with the second node, and in response to the reset pulse being inactive, disconnect the third node from the second node in conduction; the third sub-unit circuit further including: a third sub-unit sixth control circuit configured to: in response to the fourth node being at an active potential, bring the fifth node into conduction with the fifth voltage terminal, and in response to the fourth node being at an inactive potential, disconnect the fifth node from the fifth voltage terminal in conduction; a third sub-unit seventh control circuit configured to: in response to the second input pulse being active, bring the eighth node into conduction with the first voltage terminal, and in response to the second input pulse being inactive, disconnect the eighth node from the first voltage terminal in conduction; a third sub-unit reset circuit configured to: in response to the reset pulse being active, bring the fourth node into conduction with the fifth node, and in response to the reset pulse being inactive, disconnect the fourth node from the fifth node in conduction; the fourth sub-unit circuit further including a fourth sub-unit reset circuit configured to: in response to the reset pulse being active, bring the fifth node into conduction with the sixth node, and in response to the reset pulse being inactive, disconnect the fifth node from the sixth node in conduction.

In some exemplary embodiments, the first sub-unit sixth control circuit includes a fifty-fourth transistor having a first electrode connected to the fifth voltage terminal, a second electrode connected to the second node, and a control electrode connected to the first node, the first sub-unit seventh control circuit includes a fifty-third transistor having a first electrode connected to the seventh node, a second electrode connected to the first voltage terminal, and a control electrode connected to the first input terminal, the first sub-unit reset circuit includes: a fifty-fifth transistor having a first electrode connected to the first node, a second electrode connected to the second node, and a control electrode connected to the reset terminal; a fifty-sixth transistor having a first electrode connected to the second node, a second electrode connected to the first voltage terminal, and a control electrode connected to the reset terminal, the second sub-unit reset circuit includes a fifty-seventh transistor having a first electrode connected to the third node, a second electrode connected to the second node, and a control electrode connected to the reset terminal, the third sub-unit sixth control circuit includes a fifty-ninth transistor having a first electrode connected to the fifth voltage terminal, a second electrode connected to the fifth node, and a control electrode connected to the fourth node, the third sub-unit seventh control circuit includes a fifty-eighth transistor having a first electrode connected to the eighth node, a second electrode connected to the first voltage terminal, and a control electrode connected to the second input terminal, the third sub-unit reset circuit includes a sixtieth transistor having a first electrode connected to the fourth node, a second electrode connected to the fifth node, and a control electrode connected to the reset terminal, the fourth sub-unit reset circuit includes a sixty-first transistor having a first electrode connected to the sixth node, a second electrode connected to the fifth node, and a control electrode connected to the reset terminal.

In some exemplary embodiments, the shift register unit circuit further includes: a detection control signal terminal configured to be applied with a detection control pulse; a detection pulse terminal configured to be applied with a detection pulse; the first sub-unit circuit further including: a first sub-unit first detection control circuit configured to: in response to the detection control pulse being active, bring a ninth node into conduction with the first input terminal and the fifth voltage terminal, and in response to the detection control pulse being inactive, disconnect the ninth node from the first input terminal and the fifth voltage terminal in conduction; a first sub-unit second detection control circuit configured to: in response to the ninth node being at an active potential and the detection pulse being active, bring the detection pulse terminal into conduction with the first node and the second node, and in response to the ninth node being at an inactive potential or the detection pulse being inactive, disconnect the detection pulse terminal from the first node and the second node in conduction; a first sub-unit third detection control circuit configured to: in response to the detection pulse being active, bring the seventh node into conduction with the first voltage terminal, and in response to the detection pulse being inactive, disconnect the seventh node from the first voltage terminal in conduction; the second sub-unit circuit further including a second sub-unit detection control circuit configured to: in response to the detection pulse being active, bring the second node into conduction with the third node, in response to the detection pulse being inactive, disconnect the second node from the third node in conduction; the third sub-unit circuit further including: a third sub-unit first detection control circuit configured to: in response to the detection control pulse being active, bring a tenth node into conduction with the second input terminal and the fifth voltage terminal, and in response to the detection control pulse being inactive, disconnect the tenth node from the second input terminal and the fifth voltage terminal in conduction; a third sub-unit second detection control circuit configured to: in response to the tenth node being at an active potential and the detection pulse being active, bring the detection pulse terminal into conduction with the fourth node and the fifth node, and in response to the tenth node being at an inactive potential or the detection pulse being inactive, disconnect the detection pulse terminal from the fourth node and the fifth node in conduction; a third sub-unit third detection control circuit configured to: in response to the detection pulse being active, bring the eighth node into conduction with the first voltage terminal, and in response to the detection pulse being inactive, disconnect the eighth node from the first voltage terminal in conduction; the fourth sub-unit circuit further including a fourth sub-unit detection control circuit configured to: in response to the detection pulse being active, bring the fifth node into conduction with the sixth node, and in response to the detection pulse being inactive, disconnect the fifth node from the sixth node in conduction.

In some exemplary embodiments, the first sub-unit first detection control circuit includes: a sixty-third transistor having a first electrode connected to the first input terminal and a control electrode connected to the detection control signal terminal; a sixty-fourth transistor having a second electrode connected to the ninth node and a control electrode connected to the detection control signal terminal; a sixty-five transistor having a first electrode connected to the fifth voltage terminal and a control electrode connected to the ninth node; a fifth capacitor having a second electrode connected to the first voltage terminal; wherein a second electrode of the sixty-third transistor, a first electrode of the sixty-fourth transistor, a second electrode of the sixty-fifth transistor and a first electrode of the fifth capacitor are connected together, the first sub-unit second detection control circuit includes: a sixty-sixth transistor having a first electrode connected to the detection pulse terminal and a control electrode connected to the ninth node; a sixty-seventh transistor having a second electrode connected to the second node and a control electrode connected to the detection pulse terminal; a sixty-eighth transistor having a first electrode connected to the second node, a second electrode connected to the first node, and a control electrode connected to the detect pulse terminal; wherein a second electrode of the sixty-sixth transistor is connected with a first electrode of the sixty-seventh transistor, the first sub-unit third detection control circuit includes a sixty-second transistor having a first electrode connected to the seventh node, a second electrode connected to the first voltage terminal, and a control electrode connected to the detection pulse terminal, the second sub-unit detection control circuit includes a sixty-ninth transistor having a first electrode connected to the second node, a second electrode connected to the third node, and a control electrode connected to the detection pulse terminal; the third sub-unit first detection control circuit includes: a seventieth transistor having a first electrode connected to the second input terminal and a control electrode connected to the detection control signal terminal; a seventy-first transistor having a second electrode connected to the tenth node and a control electrode connected to the detection control signal terminal; a seventy-second transistor having a first electrode connected to the fifth voltage terminal and a control electrode connected to the tenth node; a sixth capacitor having a second electrode connected to the first voltage terminal, wherein a second electrode of the seventieth transistor, a first electrode of the seventy-first transistor, a second electrode of the seventy-second transistor and a first electrode of the sixth capacitor are connected together, the third sub-unit second detection control circuit includes: a seventy-third transistor having a first electrode connected to the detection pulse terminal and a control electrode connected to the tenth node; a seventy-fourth transistor having a second electrode connected to the fifth node and a control electrode connected to the detection pulse terminal; a seventy-fifth transistor having a first electrode connected to the fifth node, a second electrode connected to the fourth node, and a control electrode connected to the detection pulse terminal, wherein a second electrode of the seventy-third transistor is connected with a first electrode of the seventy-fourth transistor, the third sub-unit third detection control circuit includes a seventy-sixth transistor having a first electrode connected to the eighth node, a second electrode connected to the first voltage terminal, and a control electrode connected to the detection pulse terminal, the fourth sub-unit detection control circuit includes a seventy-seventh transistor having a first electrode connected to the fifth node, a second electrode connected to the sixth node, and a control electrode connected to the detection pulse terminal.

In some exemplary embodiments, all transistors are N-type transistors.

According to another aspect of the present disclosure, there is provided a gate driver including N cascaded shift register unit circuits as described hereinabove, N being an integer greater than or equal to 3, wherein a first output terminal of an (m)th shift register unit circuit of the N shift register unit circuits is connected to a first input terminal of an (m+1)th shift register unit circuit, a third output terminal of the (m)th shift register unit circuit is connected to a second input terminal of the (m+1)th shift register unit circuit, m being an integer and $1 \leq m < N$, and wherein a first output terminal of a (n)th shift register unit circuit of the N shift register unit circuits is connected to a reset terminal of a (n−2)th shift register unit circuit, n being an integer and $2 < n \leq N$.

According to another aspect of the present disclosure, there is provided a gate driver including N cascaded shift register unit circuits as described hereinabove, N being an integer greater than or equal to 3, wherein a first transfer terminal of an (m)th shift register unit circuit of the N shift register unit circuits is connected to a first input terminal of an (m+1)th shift register unit circuit, a second transfer terminal of the (m)th shift register unit circuit is connected to a second input terminal of the (m+1)th shift register unit circuit, wherein m is an integer and $1 \leq m < N$, and wherein a first output terminal or a first transfer terminal of a (n)th shift register unit circuit of the N shift register unit circuits is connected to a reset terminal of a (n−2)th shift register unit circuit, n being an integer and $2 < n \leq N$.

According to another aspect of the present disclosure, there is provided an OLED display device including a gate driver, wherein: the gate driver includes N cascaded shift register unit circuits as described hereinabove, N being an integer greater than or equal to 3, wherein a first transfer terminal of an (m)th shift register unit circuit of the N shift register unit circuits is connected to a first input terminal of an (m+1)th shift register unit circuit, and a second transfer terminal of the (m)th shift register unit circuit is connected to a second input terminal of the (m+1)th shift register unit circuit, m being an integer and $1 \leq m < N$, and wherein a first output terminal or a first transfer terminal of a (n)th shift register unit circuit of the N shift register unit circuits is connected to a reset terminal of a (n−2)th shift register unit circuit, n being an integer and $2 < n \leq N$.

According to another aspect of the present disclosure, there is provided a method of driving a shift register unit circuit as described hereinabove, including: supplying the first clock signal to the first clock terminal, supplying the second clock signal to the second clock terminal, supplying the third clock signal to the third clock terminal, and supplying the fourth clock signal to the fourth clock terminal, wherein the first clock signal, the second clock signal, the third clock signal, and the fourth clock signal have the identical duty cycle, and wherein the duty cycle is less than or equal to 4:9; supplying the first input pulse to the first input terminal, and supplying the second input pulse to the second input terminal; supplying the reset pulse to the reset terminal; bring the fifth node into conduction with the second node at least while the reset pulse is active.

BRIEF DESCRIPTION OF DRAWINGS

Embodiments of the present disclosure will be described in detail hereinafter in connection with the accompanying drawings so as to be able to appreciate and understand the problems to be solved by the present disclosure, the above-mentioned and other objectives, features and advantages more fully. In the drawings.

Figure 1:
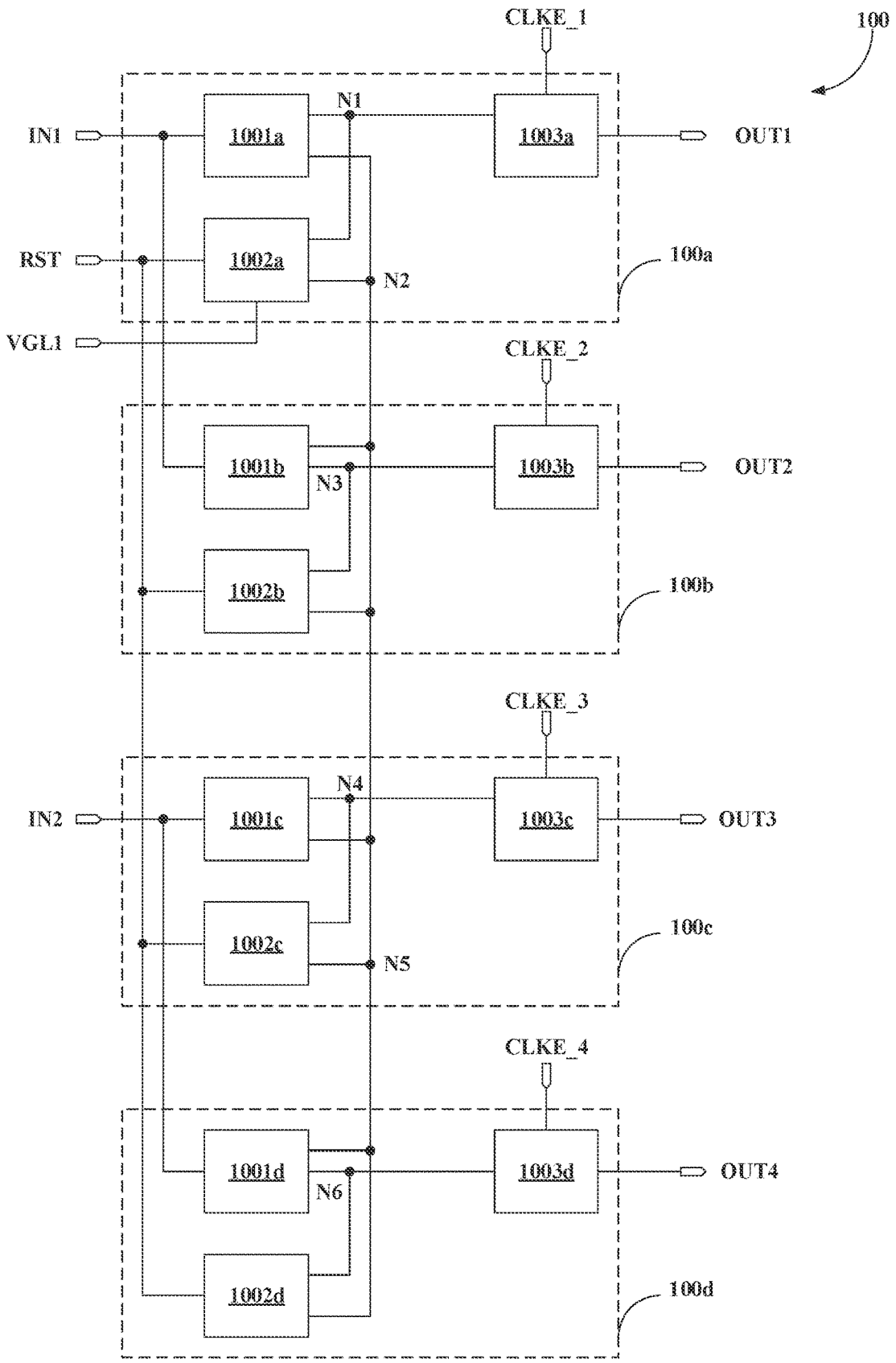
FIG. 1 is a schematic block diagram of a shift register unit circuit according to an exemplary embodiment of the present disclosure.

It needs to be noted that the contents shown in the drawings are merely schematic, and therefore they need not be drawn to scale. In addition, throughout the drawings, the same or similar devices, portions, parts and/or elements are indicated by the same or similar reference signs.

DETAILED DESCRIPTION OF EMBODIMENTS

It should be understood that although terms such as "first", "second", "third" and the like can be used herein for describing various devices, elements, parts and/or portions, they should not limit these devices, elements, parts and/or portions. These terms are only used for distinguishing one device, element, part or portion from another device, element, part or portion. Therefore, a first device, element, part or portion discussed below may also be referred to as a second or third device, element, part or portion without departing from the teaching of the present disclosure.

Terms used herein are only intended for describing the specific embodiments of the present disclosure, rather than limiting the present disclosure. As used herein, singular forms of "an", "a" and "the" are intended to also comprise plural forms, unless explicitly indicated otherwise in the context. It should be further understood that when used in this disclosure, the terms of "comprise" and/or "include" indicate the presence of the indicated features, entities, steps, operations, elements and/or parts, but does not exclude the presence of one or more other features, entities, steps, operations, elements, parts and/or groups thereof, or the addition of one or more other features, entities, steps, operations, elements, parts and/or groups thereof. As used herein, the term of "and/or" comprises any and all combination(s) of one or more of the items associated and listed.

It should be understood that when an element is referred to as being "connected to another element" or "coupled to another element", the element can be connected to another element or coupled to another element directly or by means of an intermediate element. On the contrary, when an element is described as being "directly connected to another element" or "directly coupled to another element", there is no intermediate element.

It should also be understood that in the present disclosure, when A and B are described as "A and B are in conduction", it should be understood that the electrical connection between A and B is realized, that is, electrical signals can be transmitted between A and B. Correspondingly, when A and B are described as "disconnect A from B in conduction", it should be understood as breaking the electrical connection between A and B, that is, electrical signals cannot be transmitted between A and B. However, at this time, A and B may be physically disconnected from each other, or they may still be connected to each other. In the above, A and B can be any suitable elements, parts, portions, ports or signal terminals, and the like.

Unless otherwise defined, all terms (including both technical terms and scientific terms) used herein have the same meaning as usually understood by one having ordinary skills in the art to which the present disclosure pertains. It should be further understood that terms such as those defined in a commonly used dictionary should be construed as having the same meanings as they do in the related art and/or in the context of this specification, and should not be construed in an ideal sense or an overly formal sense, unless explicitly defined so herein.

It should be noted that in the description of this specification, descriptions with reference to expressions such as "an embodiment", "some embodiments", "an exemplary embodiment", "a specific example" or "some examples" mean that specific features, structures, materials or characteristics described in combination with the exemplary embodiment(s) or example(s) are comprised in at least one exemplary embodiment or example of this disclosure. Therefore, schematic descriptions of the above expressions are not necessarily directed only at the same exemplary embodiment(s) or example(s) herein. Instead, the described specific features, structures, materials or characteristics can be combined in any one or more exemplary embodiments or examples in any suitable ways. Besides, where no contradiction is introduced, those skilled in the art can combine and assemble different exemplary embodiments or examples described in this specification, and can combine and assemble features of different exemplary embodiments or examples described in this specification.

It should be understood that the steps in the method described hereinafter are all exemplary, and they do not necessarily have to be performed in the order as listed, but one or more of these steps can be performed in a different order or simultaneously according to actual conditions. In addition, according to actual conditions, the method described hereinafter may further include other additional steps.

For clarity, some techniques, structures and materials commonly known in the art to which the present disclosure pertains will not be described in detail so as to avoid redundancy and tediousness of the present application.

Referring to FIG. 1, it schematically illustrates the structure of a shift register unit circuit 100 according to an exemplary embodiment of the present disclosure in the form of a block diagram. As shown in FIG. 1, the shift register unit circuit 100 includes: a first input terminal IN1 configured to receive a first input pulse; a second input terminal IN2 configured to receive a second input pulse; a reset terminal RST configured to receive a reset pulse; a first clock terminal CLKE_1 configured to receive a first clock signal; a second clock terminal CLKE_2 configured to receive a second clock signal; a third clock terminal CLKE_3 configured to receive a third clock signal; a fourth clock terminal CLKE_4 for receiving a fourth clock signal; a first output terminal OUT1 configured to output a first output signal; a second output terminal OUT2 configured to output a second output signal; a third output terminal OUT3 configured to output a third output signal; a fourth output terminal OUT4 configured to output a fourth output signal; and a first voltage terminal VGL1 configured to be applied with a first voltage signal. In addition, the shift register unit circuit 100 further includes a first sub-unit circuit 100*a*, a second sub-unit circuit 100*b*, a third sub-unit circuit 100*c*, and a fourth sub-unit circuit 100*d*.

The first sub-unit circuit 100*a* includes a first sub-unit input circuit 1001*a*, a first sub-unit reset circuit 1002*a* and a first sub-unit output circuit 1003*a*, which are illustrated as blocks.

The first sub-unit input circuit 1001*a* is configured to: in response to the first input pulse received at the first input terminal IN1 being active, bring the first input terminal IN1 into conduction with the first node N1 and the second node N2, and in response to the first input pulse received at the first input terminal IN1 being inactive, disconnect the first input terminal IN1 from the first node N1 and the second node N2 in conduction. The first sub-unit reset circuit 1002*a* is configured to: in response to the reset pulse received at the reset terminal RST being active, bring the first node N1 and the second node N2 into conduction with the first voltage terminal VGL1, and in response to the reset pulse received at the reset terminal RST being inactive, disconnect the first node N1 and the second node N2 from the first voltage terminal VGL1 in conduction. The first sub-unit output circuit 1003*a* is configured to: in response to the first node N1 being at an active potential, bring the first clock terminal CLKE_1 into conduction with the first output terminal OUT1, and in response to the first node N1 being at an inactive potential, disconnect the first clock terminal CLKE_1 from the first output terminal OUT1 in conduction.

The second sub-unit circuit 100*b* includes a second sub-unit input circuit 1001*b*, a second sub-unit reset circuit 1002*b* and a second sub-unit output circuit 1003*b*, which are illustrated as blocks.

The second sub-unit input circuit 1001*b* is configured to: in response to the first input pulse received at the first input terminal IN1 being active, bring the second node N2 into conduction with the third node N3, and in response to the first input pulse received at the first input terminal IN1 being inactive, disconnect the second node N2 from the third node N3 in conduction. The second sub-unit reset circuit 1002*b* is configured to: in response to the reset pulse received at the reset terminal RST being active, bring the third node N3 into conduction with the second node N2, and in response to the reset pulse received at the reset terminal RST being inactive, disconnect the third node N3 from the second node N2 in conduction. The second sub-unit output circuit 1003*b* is configured to: in response to the third node N3 being at an active potential, bring the second clock terminal CLKE_2 into conduction with the second output terminal OUT2, and in response to the third node N3 being at an inactive potential, disconnect the second clock terminal CLKE_2 from the second output terminal OUT2 in conduction.

The third sub-unit circuit 100*c* includes a third sub-unit input circuit 1001*c*, a third sub-unit reset circuit 1002*c* and a third sub-unit output circuit 1003*c*, which are illustrated as blocks.

The third sub-unit input circuit 1001*c* is configured to: in response to the second input pulse received at the second input terminal IN2 being active, bring the second input terminal IN2 into conduction with the fourth node N4 and the fifth node N5, and in response to the second input pulse received at the second input terminal IN2 being inactive, disconnect the second input terminal IN2 from the fourth node N4 and the fifth node N5 in conduction. The third sub-unit reset circuit 1002*c* is configured to: in response to the reset pulse received at the reset terminal RST being active, bring the fourth node N4 into conduction with the fifth node N5, and in response to the reset pulse received at the reset terminal RST being inactive, disconnect the fourth node N4 from the fifth node N5 in conduction. The third sub-unit output circuit 1003*c* is configured to: in response to the fourth node N4 being at an active potential, bring the third clock terminal CLKE_3 into conduction with the third output terminal OUT3, and in response to the fourth node N4 being at an inactive potential, disconnect the third clock terminal CLKE_3 from the third output terminal OUT3 in conduction.

The fourth sub-unit circuit 100*d* includes a fourth sub-unit input circuit 1001*d*, a fourth sub-unit reset circuit 1002*d* and a fourth sub-unit output circuit 1003*d*, which are illustrated as blocks.

The fourth sub-unit input circuit 1001*d* is configured to: in response to the second input pulse received at the second input terminal IN2 being active, bring the fifth node N5 into conduction with the sixth node N6, and in response to the second input pulse received at the second input terminal IN2 being inactive, disconnect the fifth node N5 from the sixth node N6 in conduction. The fourth sub-unit reset circuit 1002*d* is configured to: in response to the reset pulse received at the reset terminal RST being active, bring the sixth node N6 into conduction with the fifth node N5, and in response to the reset pulse received at the reset terminal RST being inactive, disconnect the sixth node N6 from the fifth node N5 in conduction. The fourth sub-unit output circuit 1003*d* is configured to: in response to the sixth node N6 being at an active potential, bring the fourth clock terminal CLKE_4 into conduction with the fourth output terminal OUT4, and in response to the sixth node N6 being at an inactive potential, disconnect the fourth clock terminal CLKE_4 from the fourth output terminal OUT4 in conduction.

In the shift register unit circuit 100 shown in FIG. 1, the fifth node N5 is connected with the second node N2, such that the fifth node N5 is in conduction with the second node N2 at least while the reset pulse is active.

It should be noted that the term "active potential" used herein refers to a potential required for enabling the circuit element (e.g., a transistor) involved, and the term "inactive potential" used herein refers to a potential at which the circuit element involved is disabled. For an N-type transistor, the active potential is a high potential, and the inactive potential is a low potential. For a P-type transistor, the active potential is a low potential, and the inactive potential is a high potential. It will be understood that the active potential or the inactive potential is not intended to refer to a certain specific potential, but instead it may comprise a range of potentials. Besides, in this disclosure, the terms "voltage", "voltage level" and "potential" can be exchanged with each other in use.

Figure 2:
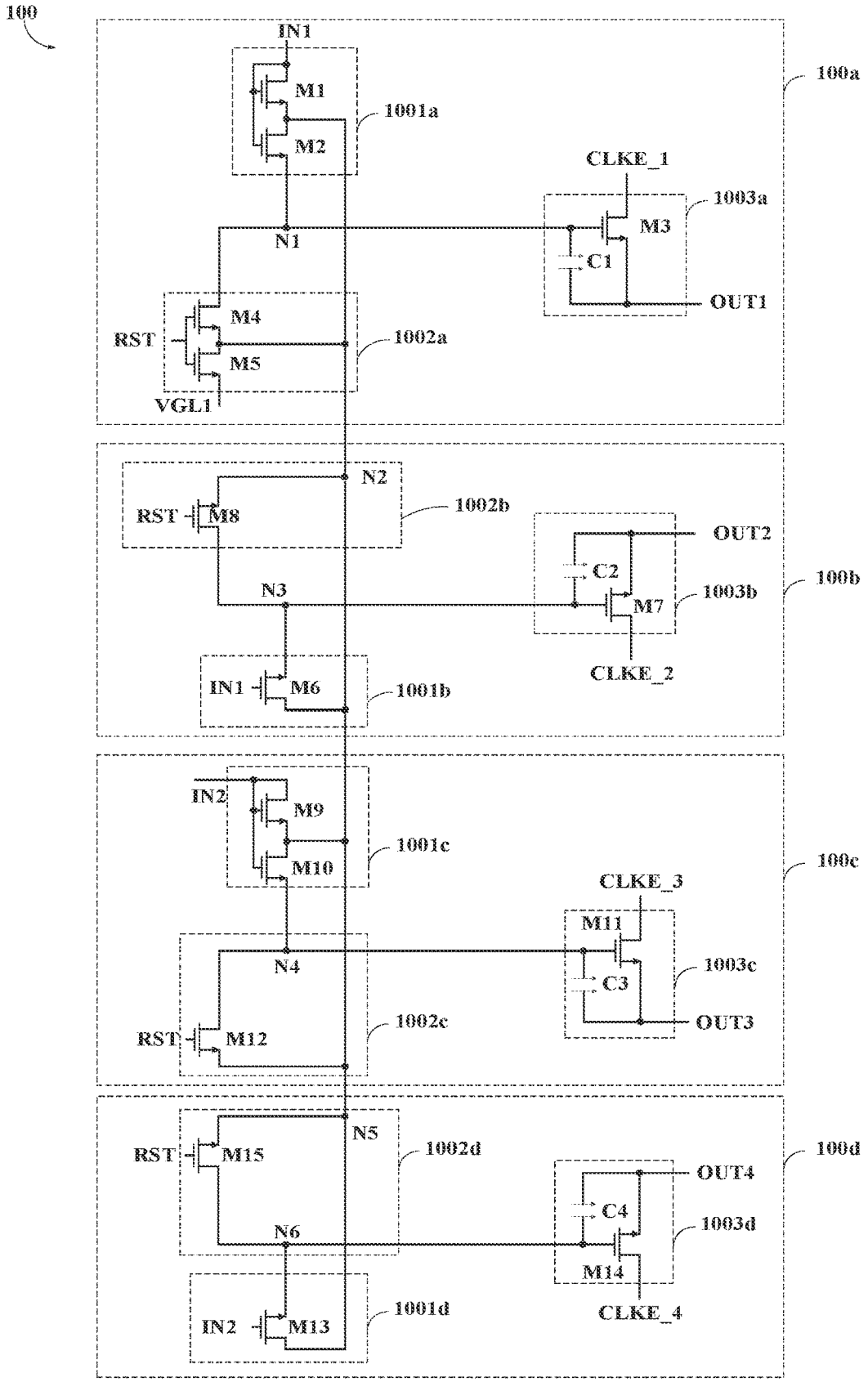
FIG. 2 is a circuit diagram schematically illustrating an exemplary circuit of the shift register unit circuit shown in FIG. 1.

Referring to FIG. 2, it schematically illustrates an exemplary circuit of the shift register unit circuit 100 shown in FIG. 1. The exemplary circuit construction of the shift register unit circuit 100 is described in detail hereinafter with reference to FIG. 2 and in conjunction with reference to FIG. 1.

It should be pointed out that the transistors used in each exemplary embodiment of this disclosure can be thin film transistors or field effect transistors or other devices having the same characteristics. In each exemplary embodiment, each transistor is typically fabricated such that its source and drain can be used interchangeably, so its source and drain are not essentially different from each other in the description of the connection relationship. In each exemplary embodiment of this disclosure, to distinguish between the source and the drain of a transistor, one electrode is referred to as a first electrode, and the other is referred to as a second electrode, and the gate is referred to as a control electrode. In each exemplary embodiment of this disclosure, although each transistor is illustrated and described as an N-type transistor, a P-type transistor is also possible. It can be easily understood that given an N-type transistor, the turn-on voltage of the control electrode (i.e. gate) has a high potential, and the turn-off voltage of the control electrode has a low potential. In the following description of this disclosure, as a non-limiting example, N-type transistors are used for the description. However, it can be easily understood that with the teaching of this disclosure, those skilled in the art can replace one or more or all of the N-type transistors in each exemplary embodiment of this disclosure with P-type transistor(s), or add or remove one or more elements into/from each exemplary embodiment of this disclosure, without departing from the spirit and scope of this disclosure. In addition, where no conflict with the teaching of this disclosure is introduced, other embodiments can also be envisaged.

As shown in FIG. 2, the shift register unit circuit 100 includes the first sub-unit circuit 100*a*, the second sub-unit circuit 100*b*, the third sub-unit circuit 100*c*, and the fourth sub-unit circuit 100*d*.

The first sub-unit circuit 100*a* includes the first sub-unit input circuit 1001*a*, the first sub-unit reset circuit 1002*a* and the first sub-unit output circuit 1003*a*. The first sub-unit input circuit 1001*a* may include a first transistor M1 and a second transistor M2. The first electrode and the control electrode of the first transistor M1 are both connected to the first input terminal IN1, and its second electrode is connected to the second node N2; the first electrode of the second transistor M2 is connected to the second node N2, its second electrode is connected to the first node N1, and its control electrode is connected to the first input terminal IN1. The first sub-unit output circuit 1003*a* may include a third transistor M3 and a first capacitor C1. The first electrode of the third transistor M3 is connected to the first clock terminal CLKE_1, its second electrode is connected to the first output terminal OUT1, and its control electrode is connected to the first node N1; a first electrode of the first capacitor C1 is connected to the first node N1 and its second electrode is connected to the first output terminal OUT1. The presence of the first capacitor C1 is advantageous because the potential at the first node N1 can be further increased with the help of the bootstrap effect of the first capacitor C1 in order to further turn on the third transistor M3, as will be described hereinafter. The first sub-unit reset circuit 1002*a* may comprise a fourth transistor M4 and a fifth transistor M5. The first electrode of the fourth transistor M4 is connected to the first node N1, its second electrode is connected to the second node N2, and its control electrode is connected to the reset terminal RST; a first electrode of the fifth transistor M5 is connected to the second node N2, its second electrode is connected to the first voltage terminal VGL1, and its control electrode is connected to the reset terminal RST.

The second sub-unit circuit 100*b* includes the second sub-unit input circuit 1001*b*, the second sub-unit reset circuit 1002*b* and the second sub-unit output circuit 1003*b*. The second sub-unit input circuit 1001*b* may include a sixth transistor M6 with its first electrode connected to the second node N2, its second electrode connected to the third node N3 and its control electrode connected to the first input terminal IN1. The second sub-unit output circuit 1003*b* may comprise a seventh transistor M7 and a second capacitor C2. The first electrode of the seventh transistor M7 is connected to the second clock terminal CLKE_2, its second electrode is connected to the second output terminal OUT2, and its control electrode is connected to the third node N3; the first electrode of the second capacitor C2 is connected to the third node N3, and its second electrode is connected to the second output terminal OUT2. The presence of the second capacitor C2 is advantageous because the potential at the third node N3 can be further increased with the help of the bootstrap effect of the second capacitor C2 in order to further turn on the seventh transistor M7, as will be described hereinafter. The second sub-unit reset circuit 1002*b* may comprise an eighth transistor M8 with its first electrode connected to the third node N3, its second electrode connected to the second node N2 and its control electrode connected to the reset terminal RST.

The third sub-unit circuit 100*c* includes the third sub-unit input circuit 1001*c*, the third sub-unit reset circuit 1002*c* and the third sub-unit output circuit 1003*c*. The third sub-unit input circuit 1001*c* may include a ninth transistor M9 and a tenth transistor M10. The first electrode and the control electrode of the ninth transistor M9 are both connected to a second input terminal IN2, and its second electrode is connected to the fifth node N5;

the first electrode of the tenth transistor M10 is connected to the fifth node N5, its second electrode is connected to the fourth node N4, and its control electrode is connected to the second input terminal IN2. The third sub-unit output circuit 1003*c* may include an eleventh transistor M11 and a third capacitor C3. The first electrode of the eleventh transistor M11 is connected to the third clock terminal CLKE_3, and its second electrode is connected to the third output terminal OUT3, and its control electrode is connected to the fourth node N4; the first electrode of the third capacitor C3 is connected to the fourth node N4, and its second electrode is connected to the third output terminal OUT3. The presence of the third capacitor C3 is advantageous because the potential at the fourth node N4 can be further increased with the help of the bootstrap effect of the third capacitor C3 in order to further turn on the eleventh transistor M11, as will be described hereinafter. The third sub-unit reset circuit 1002*c* may comprise a twelfth transistor M12 with its first electrode connected to the fourth node N4, its second electrode connected to the fifth node N5, and its control electrode connected to the reset terminal RST.

The fourth sub-unit circuit 100*d* includes the fourth sub-unit input circuit 1001*d*, the fourth sub-unit reset circuit 1002*d*, and a fourth sub-unit output circuit 1003*d*. The fourth sub-unit input circuit 1001*d* may include a thirteenth transistor M13 with its first electrode connected to the fifth node N5, its second electrode connected to the sixth node N6, and its control electrode connected to the second input terminal IN2. The fourth sub-unit output circuit 1003*d* may include a fourteenth transistor M14 and a fourth capacitor C4. The first electrode of the fourteenth transistor M14 is connected to the fourth clock terminal CLKE_4, its second electrode is connected to the fourth output terminal OUT4, and its control electrode is connected to the sixth node N6; the first electrode of the fourth capacitor C4 is connected to the sixth node N6, and its second electrode is connected to the fourth output terminal OUT4. The presence of the fourth capacitor C4 is advantageous because the potential at the sixth node N6 can be further increased with the help of the bootstrap effect of the fourth capacitor C4 to further turn on the fourteenth transistor M14, as will be described hereinafter. The fourth sub-unit reset circuit 1002*d* may comprise a fifteenth transistor M15 with its first electrode connected to the sixth node N6, its second electrode connected to the fifth node N5 and its control electrode connected to the reset terminal RST.

In the exemplary circuit of the shift register unit circuit 100 shown in FIG. 2, the fifth node N5 and the second node N2 are connected by a wire, so that it is able to bring the fifth node N5 into conduction with the second node N2 at least while the reset pulse is active. Thus, the nodes N1 to N6 are all in conduction with the first voltage terminal VGL1 while the reset pulse is active, thereby realizing the reset operation of each sub-unit circuit.

Figure 3:
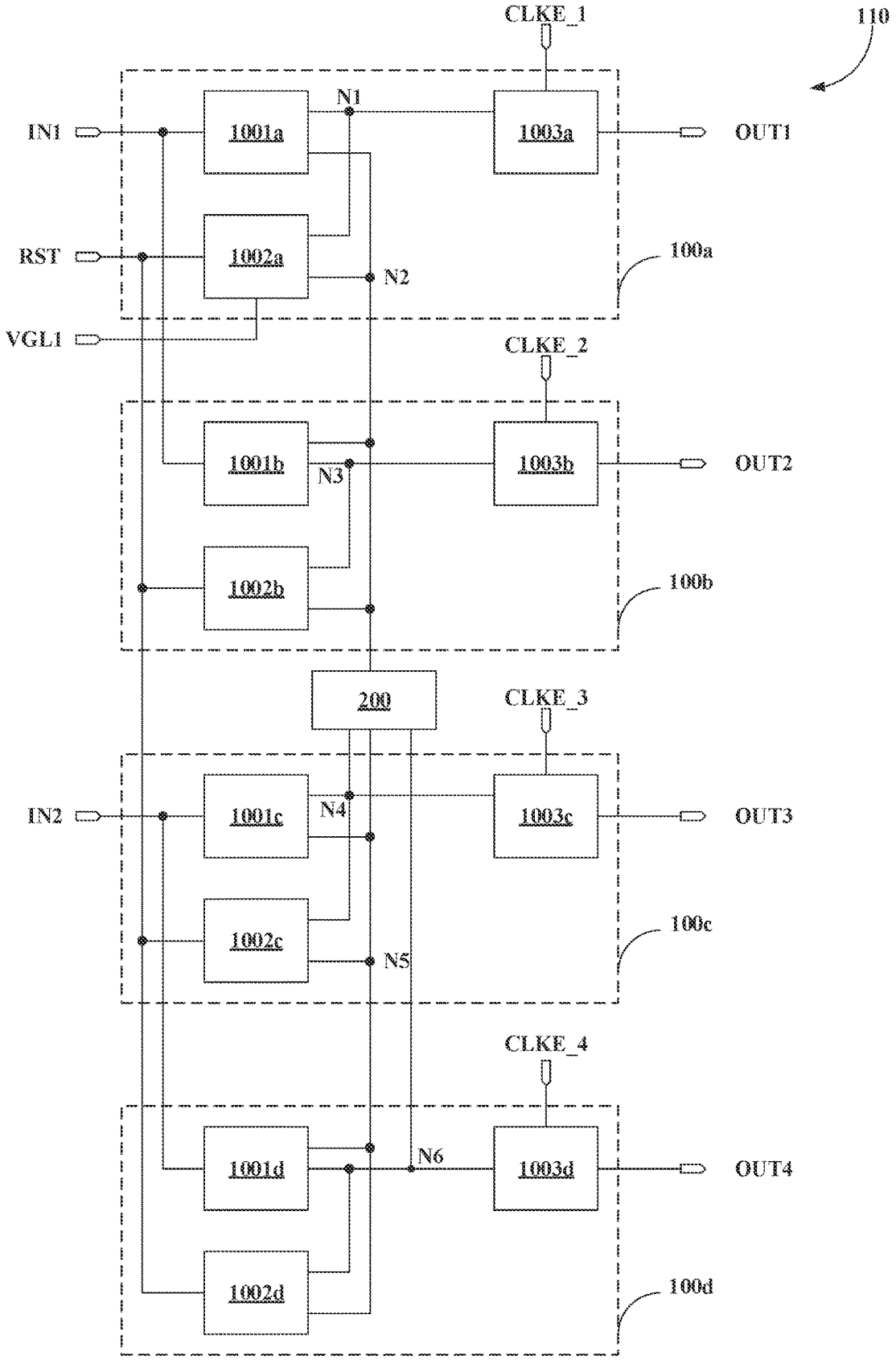
FIG. 3 is a schematic block diagram of a shift register unit circuit according to another exemplary embodiment of the present disclosure.

Referring to FIG. 3, it schematically illustrates the structure of a shift register unit circuit 110 according to another exemplary embodiment of the present disclosure in the form of a block diagram. Compared with the shift register unit circuit 100 shown in FIG. 1, the shift register unit circuit 110 in FIG. 3 differs in structure only in that it further includes a conduction control circuit 200. The other parts of the shift register unit circuit 110 are the same as the corresponding parts of the shift register unit circuit 100 shown in FIG. 1, so they will not be repeatedly described herein. The conduction control circuit 200 is configured to: in response to at least one of the fourth node N4 and the sixth node N6 being at an active potential, bring the fifth node N5 into conduction with the second node N2, and to in response to both the fourth node N4 and the sixth node N6 being at an inactive potential, disconnect the fifth node N5 from the second node N2 in conduction.

Figure 4:
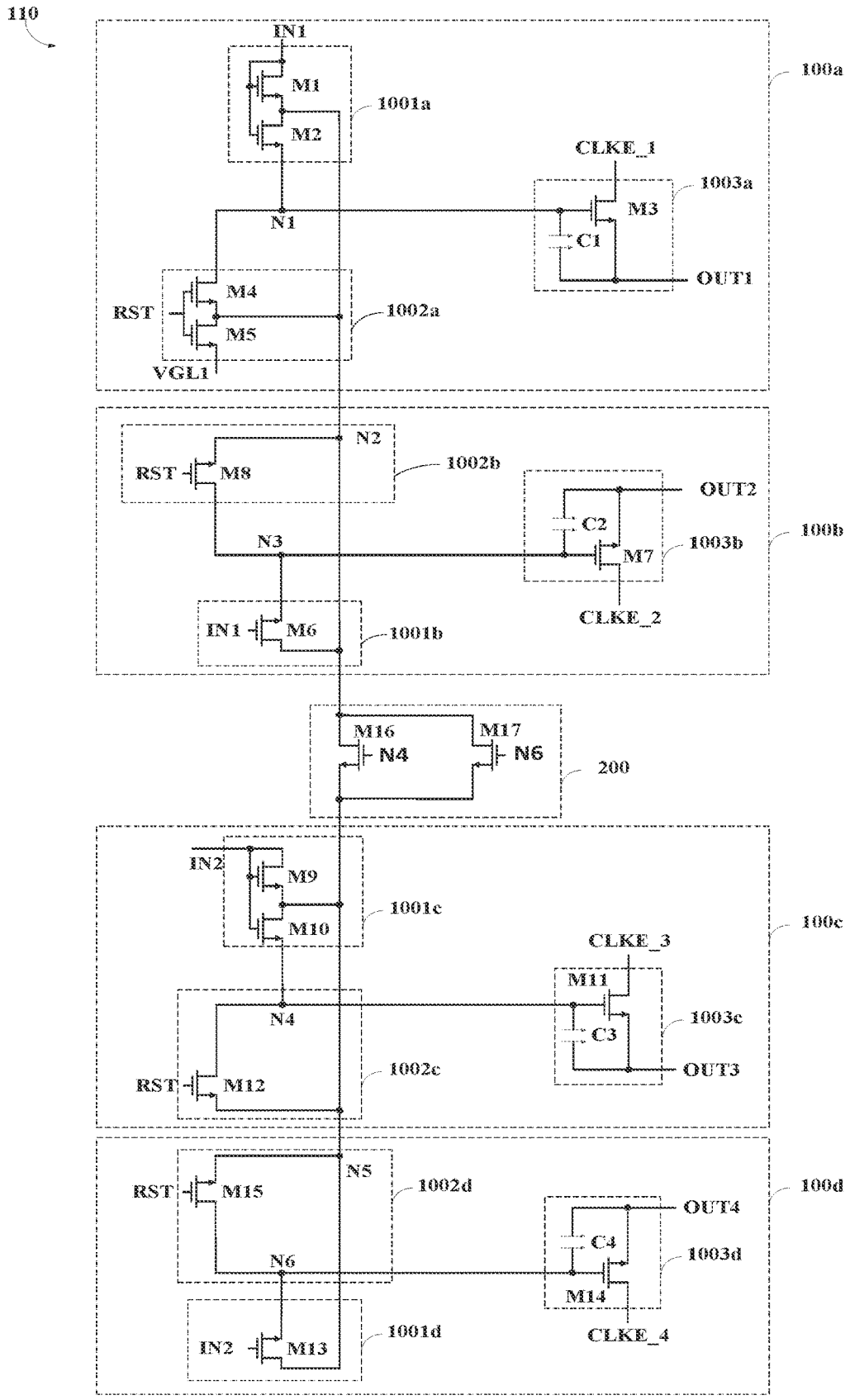
FIG. 4 is a circuit diagram schematically illustrating one exemplary circuit of the shift register unit circuit shown in FIG. 3.

Referring to FIG. 4, it schematically illustrates an exemplary circuit of the shift register unit circuit 110 shown in FIG. 3. It should be noted that, except for the conduction control circuit 200, the circuits of the other parts of the shift register unit circuit 110 are the same as the circuits of the corresponding parts of the shift register unit circuit 100 shown in FIG. 2, so they will not be repeatedly described herein. As shown in FIG. 4, the conduction control circuit 200 may include a sixteenth transistor M16 and a seventeenth transistor M17. The first electrode of the sixteenth transistor M16 is connected to the second node N2, its second electrode is connected to the fifth node N5, and its control electrode is connected to the fourth node N4; the first electrode of the seventeenth transistor M17 is connected to the second node N2, its second electrode is connected to the fifth node N5, and its control electrode is connected to the sixth node N6. Thus, when at least one of the fourth node N4 and the sixth node N6 is at an active potential, at least one of the sixteenth transistor M16 and the seventeenth transistor M17 is turned on, thereby bringing the fifth node N5 into conduction with the second node N2; when both the fourth node N4 and the sixth node N6 are at an inactive potential, both the sixteenth transistor M16 and the seventeenth transistor M17 are turned off, thereby disconnecting the fifth node N5 from the second node N2 in conduction.

Figure 5:
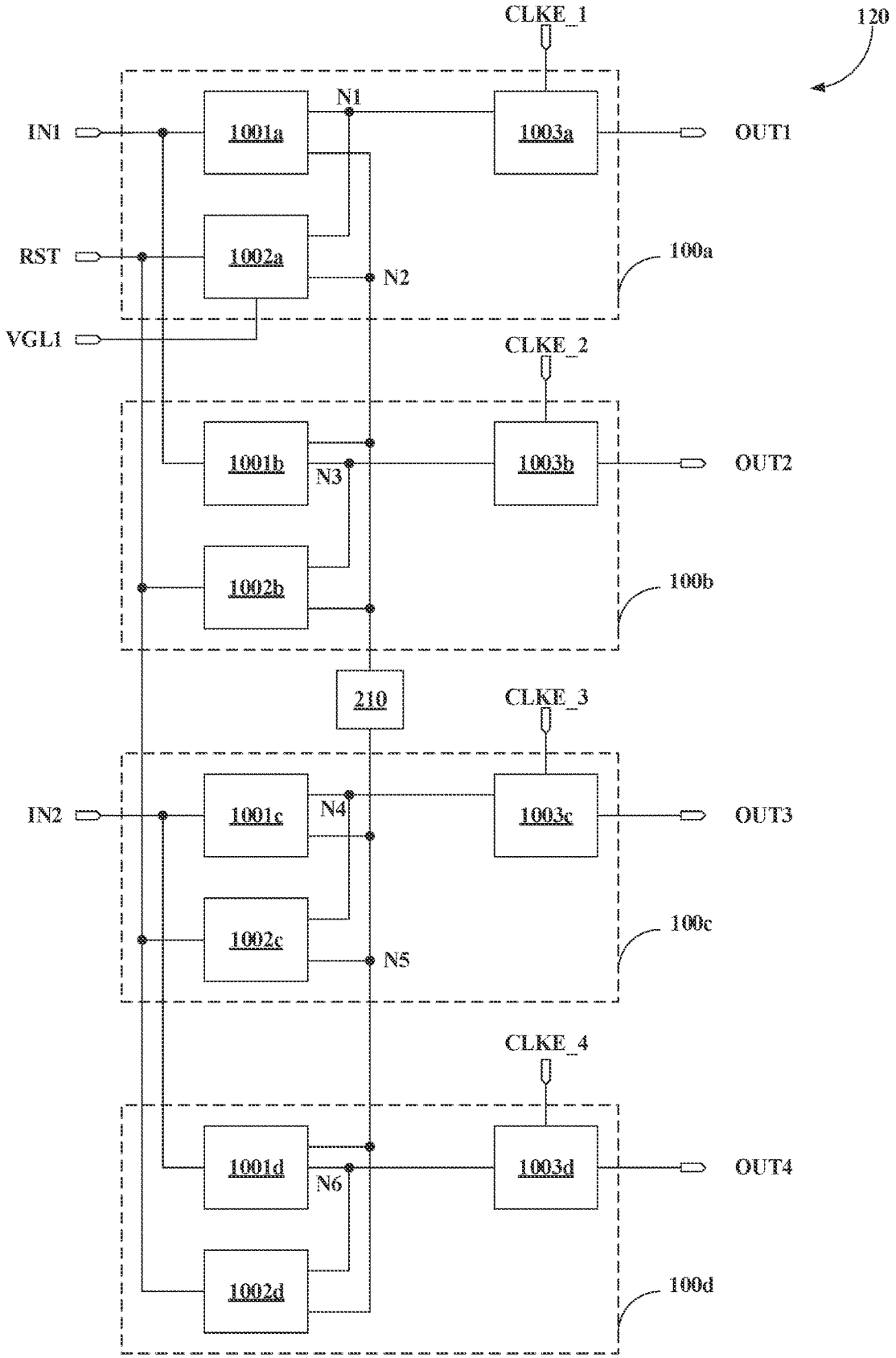
FIG. 5 is a schematic block diagram of a shift register unit circuit according to another exemplary embodiment of the present disclosure.

Referring to FIG. 5, it schematically illustrates the structure of a shift register unit circuit 120 according to another exemplary embodiment of the present disclosure in the form of a block diagram. Compared with the shift register unit circuit 100 shown in FIG. 1 and the shift register unit circuit 110 shown in FIG. 3, the shift register unit circuit 120 in FIG. 5 differs in structure only in that it includes a conduction control circuit 210. The other parts of the shift register unit circuit 120 are the same as the corresponding parts of the shift register unit circuit 100 shown in FIG. 1 and the shift register unit circuit 110 shown in FIG. 3, so they will not be repeatedly described herein. The conduction control circuit 210 is configured to: in response to the fifth node N5 being at an active potential, bring the fifth node N5 into conduction with the second node N2, and in response to the fifth node N5 being at an inactive potential, disconnect the fifth node N5 from the second node N2 in conduction.

Figure 6:
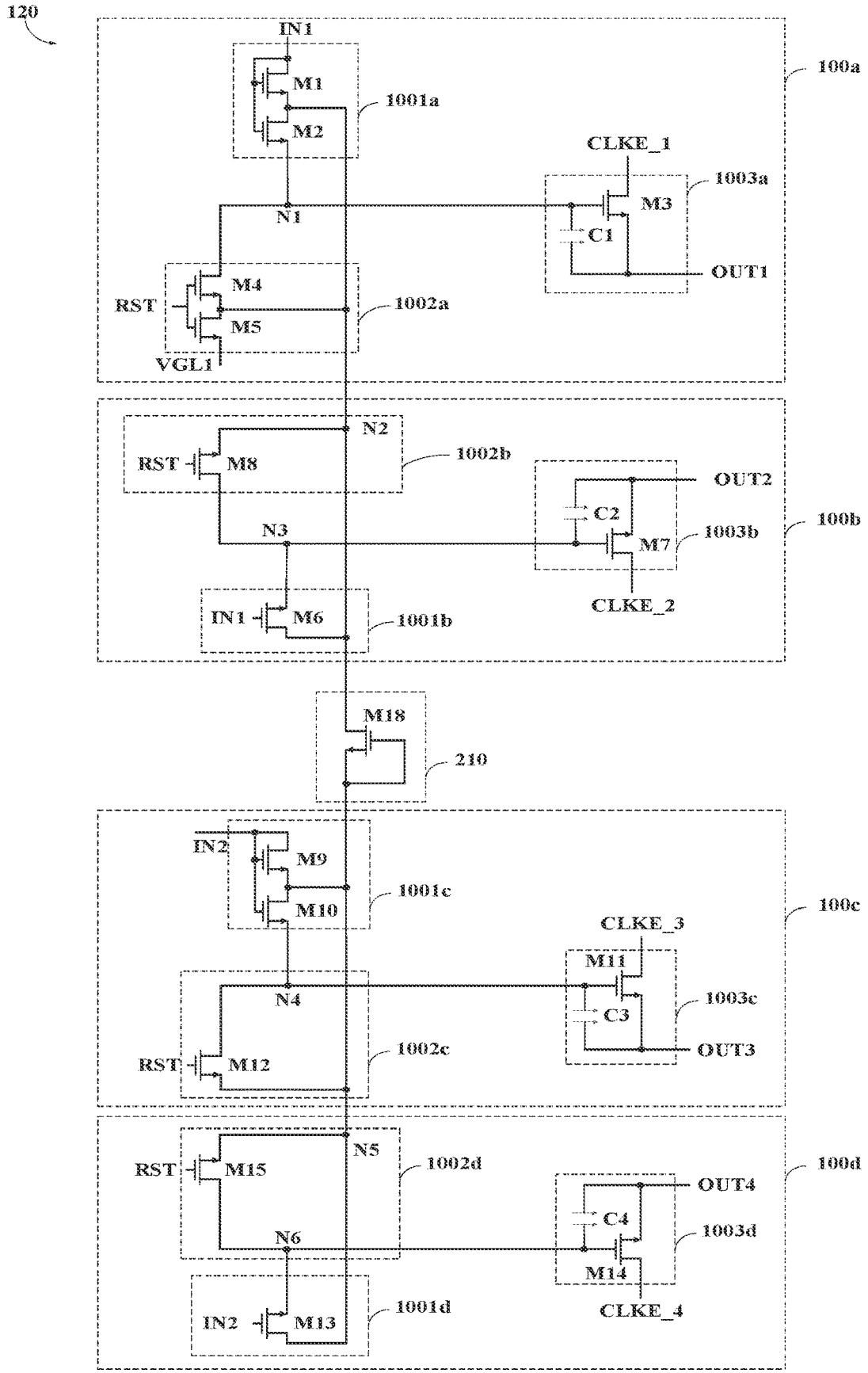
FIG. 6 is a circuit diagram schematically illustrating one exemplary circuit of the shift register unit circuit shown in FIG. 5.

Referring to FIG. 6, it schematically illustrates an exemplary circuit of the shift register unit circuit 120 shown in FIG. 5. It should be noted that, except for the conduction control circuit 210, the circuits of the other parts of the shift register unit circuit 120 is the same as the circuits of the corresponding parts in the shift register unit circuit 100 shown in FIG. 2 and the circuits of the corresponding parts in the shift register unit circuit 110 shown in FIG. 4, so they will not be repeatedly described herein. As shown in FIG. 6, the conduction control circuit 210 may include an eighteenth transistor M18 with its first electrode connected to the second node N2, its second electrode and control electrode both connected to the fifth node N5. Thus, when the fifth node N5 is at an active potential, the eighteenth transistor M18 is turned on, thereby bringing the fifth node N5 into conduction with the second node N2; when the fifth node N5 is at an inactive potential, the eighteenth transistor M18 is turned off, thus disconnecting the fifth node N5 from the second node N2 in conduction.

Figure 7:
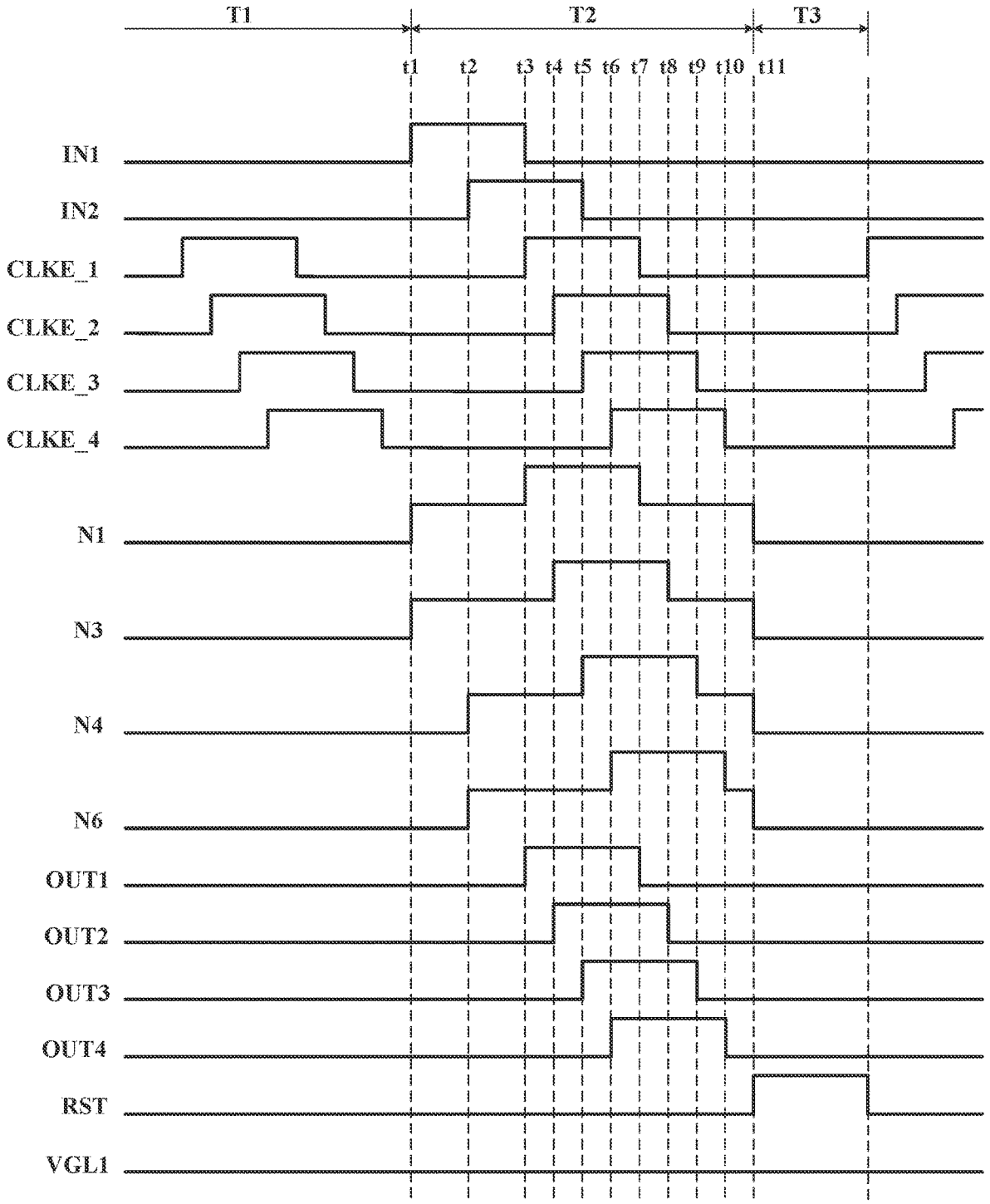
FIG. 7 is a timing diagram for the exemplary circuits of the shift register unit circuits shown in FIG. 2, FIG. 4 and FIG. 6.

Referring to FIG. 7, it illustrates a timing diagram that can be used for the exemplary circuits of the shift register unit circuits of FIG. 2, FIG. 4, and FIG. 6. As shown in FIG. 7, the first clock signal received from the first clock terminal CLKE_1, the second clock signal received from the second clock terminal CLKE_2, the third clock signal received from the third clock terminal CLKE_3, and the fourth clock signal received from the fourth clock terminal CLKE_4 have the same period and duty cycle. In some exemplary embodiments of the present disclosure, the duty cycle of the clock signals is less than or equal to 4:9, while in each exemplary embodiment illustrated in the present disclosure, the duty cycle of the clock signals is 1:3. In addition, as shown in FIG. 7, the first, second, third, and fourth clock signals differ from each other in timing by one-fourth of the pulse width of the high level pulse signal. Thus, each sub-unit circuit in the shift register unit circuit can operate in the same (but "time-shifted") timing sequence in order to sequentially generate the output signals as gate-on pulses. As a non-limiting example, the first input pulse received from the first input terminal IN1 and the second input pulse received from the second input terminal IN2 each have a pulse width equal to the pulse width of a high level pulse signal in each clock signal, and the second input pulse is half a pulse width behind the first input pulse in the timing sequence. In addition, as shown in FIG. 7, the first voltage terminal VGL1 is always applied with a low voltage level.

The operations of the exemplary circuits of the shift register unit circuits shown in FIG. 2, FIG. 4 and FIG. 6 will be described in detail with reference to FIG. 7 hereinafter. In the following, a high potential is indicated by 1 and a low potential is indicated by 0.

In the first time period T1, IN1=0, IN2=0, VGL1=0, and RST=0. Although the first, second, third, and third clock signals received at the first, second, third, and fourth clock terminals CLKE_1, CLKE_2, CLKE_3, and CLKE_4 have respective clock pulses at this time, because IN1=0 and IN2=0, the first transistor M1, the second transistor M2, the sixth transistor M6, the ninth transistor M9, the tenth transistor M10, and the thirteenth transistor M13 are all turned off, causing the first node N1, the second node N2, the third node N3, the fourth node N4, the fifth node N5, and the sixth node N6 at a low potential. Since the first node N1, the third node N3, the fourth node N4 and the sixth node N6 are all at a low potential, the third transistor M3, the seventh transistor M7, the eleventh transistor M11 and the fourteenth transistor M14 are turned off, thus causing OUT1=0, OUT2=0, OUT3=0 and OUT4=0 in the first time period T1.

In the second time period T2, VGL1=0 and RST=0. In addition, as shown in FIG. 7, for ease of description, the second time period T2 will be described based on eleven moments t1 to t11, where the moment t1 is the moment at which the second time period T2 begins and the moment t11 is the moment at which the second time period T2 ends.

In the time period from the moment t1 to the moment t2, IN1=1 and IN2=0. Because IN1=1, the first transistor M1 and the second transistor M2 are turned on, bringing the first node N1 and the second node N2 into conduction with the first input IN1, thus causing N1=1 and N2=1, and the sixth transistor M6 is also turned on, bringing the second node N2 into conduction with the third node N3, causing N3=1, thus making the first node N1, the second node N2 and the third node N3 all at a high potential. Since N1=1 and N3=1, the third transistor M3 and the seventh transistor M7 are turned on. However, because CLKE_1=0 and CLKE_2=0 in the time period from the moment t1 to the moment t2, OUT1=0 and OUT2=0. In addition, because IN2=0, the ninth transistor M9, the tenth transistor M10 and the thirteenth transistor M13 remain off, so that the fourth node N4 and the sixth node N6 remain at a low potential, and thus the eleventh transistor M11 and the fourteenth transistor M14 remain turned off, causing OUT3=0 and OUT4=0.

In the time period from the moment t2 to the moment t3, IN1=1 and IN2=1. Because IN1=1, the first transistor M1, the second transistor M2 and the sixth transistor M6 remain turned on, bringing the first node N1 and the second node N2 into conduction with the first input terminal IN1, and bringing the second node N2 into conduction with the third node N3, thereby causing N1=1, N3=1, and thus the third transistor M3 and the seventh transistor M7 remain turned on. In addition, because IN2=1, the ninth transistor M9, tenth transistor M10 and thirteenth transistor M13 are turned on, bringing the fourth node N4 and the fifth node N5 into conduction with the second input terminal IN2, thereby causing N4=1 and N5=1, and bringing the sixth node N6 into conduction with the fifth node N5, thereby causing N6=1, so that the fourth node N4, the fifth node N5 and the sixth node N6 are all at a high potential. Because N4=1 and N6=1, the eleventh transistor M11 and the fourteenth transistor M14 are turned on. However, because CLKE_1=0, CLKE_2=0, CLKE_3=0 and CLKE_4=0 in the time period from the moment t2 to the moment t3, OUT1=0, OUT2=0, OUT3=0 and OUT4=0.

In the time period from the moment t3 to the moment t4, IN1=0 and IN2=1. Because IN1=0, the first transistor M1 and the second transistor M2 are turned off, thus disconnecting the first node N1 and the second node N2 from the first input terminal IN1 in conduction, and the sixth transistor M6 is turned off, thus disconnecting the second node N2 from the third node N3 in conduction. However, because of the first capacitor C1 and the second capacitor C2, the first node N1 and the third node N3 remain at a high potential, i.e., N1=1 and N3=1, so that the third transistor M3 and the seventh transistor M7 remain turned on. At this time, CLKE_1=1 and CLKE_2=0, so OUT1=1 and OUT2=0. It should be noted that when OUT1=1, since the voltage between the two electrodes of the first capacitor C1 cannot change instantaneously, the potential at the first node N1 becomes higher, thus making the third transistor M3 turned on more fully. In addition, because IN2=1, N4=1 and N6=1, so that the eleventh transistor M11 and the fourteenth transistor M14 remain turned on. However, because CLKE_3=0 and CLKE_4=0 at this time, OUT3=0 and OUT4=0.

In the time period from the moment t4 to the moment t5, it is still IN1=0 and IN2=1. Therefore, the third transistor M3, the seventh transistor M7, the eleventh transistor M11 and the fourteenth transistor M14 remain turned on. At this time, CLKE_1=1, CLKE_2=1, CLKE_3=0, CLKE_4=0, so OUT1=1, OUT2=1, OUT3=0, OUT4=0. It should be noted that when OUT2=1, since the voltage between the two electrodes of the second capacitor C2 cannot change instantaneously, the potential at the third node N3 becomes higher, thus making the seventh transistor M7 turned on more fully.

In the time period from the moment t5 to the moment t6, IN1=0 and IN2=0. Although IN1=0, the first node N1 and the third node N3 remain at a high potential because of the first capacitor C1 and the second capacitor C2, i.e. N1=1 and N3=1, causing the third transistor M3 and the seventh transistor M7 to remain turned on. Since IN2=0, the ninth transistor M9 and the tenth transistor M10 are turned off, thus disconnecting the fourth node N4 and the fifth node N5 from the second input terminal IN2 in conduction, and the thirteenth transistor M13 is turned off, thus disconnecting the fifth node N5 from the sixth node N6 in conduction. However, because of the third capacitor C3 and the fourth capacitor C4, the fourth node N4 and the sixth node N6 still remain at a high potential, i.e., N4=1 and N6=1, so that the eleventh transistor M11 and the fourteenth transistor M14 remain turned on. At this point, CLKE_1=1, CLKE_2=1, CLKE_3=1, CLKE_4=0, so OUT1=1, OUT2=1, OUT3=1, OUT4=0. It should also be noted that when OUT3=1, since the voltage between the two electrodes of the third capacitor C3 cannot change instantaneously, the potential at the fourth node N4 becomes higher, thus making the eleventh transistor M11 turned on more fully.

In the time period from the moment t6 to the moment t7, IN1=0 and IN2=0. However, because of the first, second, third and fourth capacitors C1, C2, C3 and C4, N1=1, N3=1, N4=1 and N6=1, so the third transistor M3, the seventh transistor M7, the eleventh transistor M11 and the fourteenth transistor M14 remain turned on. At this time, CLKE_1=1, CLKE_2=1, CLKE_3=1, CLKE_4=1, so OUT1=1, OUT2=1, OUT3=1, OUT4=1.

In the time period from the moment t7 to the moment t8, IN1=0 and IN2=0. However, because of the first, second, third and fourth capacitors C1, C2, C3 and C4, N1=1, N3=1, N4=1 and N6=1, so the third transistor M3, the seventh transistor M7, the eleventh transistor M11 and the fourteenth transistor M14 remain turned on. At this moment, CLKE_1=0, CLKE_2=1, CLKE_3=1, CLKE_4=1, so OUT1=0, OUT2=1, OUT3=1, OUT4=1.

In the time period from the moment t8 to the moment t9, IN1=0 and IN2=0. However, because of the first, second, third and fourth capacitors C1, C2, C3 and C4, N1=1, N3=1, N4=1 and N6=1, so the third transistor M3, the seventh transistor M7, the eleventh transistor M11 and the fourteenth transistor M14 remain turned on. At this time, CLKE_1=0, CLKE_2=0, CLKE_3=1, CLKE_4=1, so OUT1=0, OUT2=0, OUT3=1, OUT4=1.

In the time period from the moment t9 to the moment t10, IN1=0 and IN2=0. However, because of the first, second, third and fourth capacitors C1, C2, C3 and C4, N1=1, N3=1, N4=1 and N6=1, so the third transistor M3, the seventh transistor M7, the eleventh transistor M11 and the fourteenth transistor M14 remain turned on. At this moment, CLKE_1=0, CLKE_2=0, CLKE_3=0, CLKE_4=1, so OUT1=0, OUT2=0, OUT3=0, OUT4=1.

In the time period from the moment t10 to the moment t11, IN1=0 and IN2=0. However, because of the first, second, third and fourth capacitors C1, C2, C3 and C4, N1=1, N3=1, N4=1 and N6=1, so the third transistor M3, the seventh transistor M7, the eleventh transistor M11 and the fourteenth transistor M14 remain turned on. At this time, CLKE_1=0, CLKE_2=0, CLKE_3=0, CLKE_4=0, so OUT1=0, OUT2=0, OUT3=0, OUT4=0.

In the third time period T3, IN1=0, IN2=0, VGL1=0 and RST=1. Since RST=1, the fourth transistor M4 and the fifth transistor M5 are turned on to bring the first node N1 and the second node N2 into conduction with the first voltage terminal VGL1, thus making N1=0 and N2=0. The eighth transistor M8 are turned on to bring the second node N2 into conduction with the third node N3, thus making N3=0. The twelfth transistor M12 are turned on to bring the fourth node N4 into conduction with the fifth node N5, and the fifteenth transistor M15 are turned on to bring the fifth node N5 into conduction with the sixth node N6. The fifth node N5 is in conduction with the second node N2 when RST=1, so N5=0, thus making N4=0 and N6=0. Thus, when RST=1, the first node N1, the second node N2, the third node N3, the fourth node N4, the fifth node N5 and the sixth node N6 are all in conduction with the first voltage terminal VGL1, so that the first, second, third and fourth capacitors C1, C2, C3, and C4 discharge, followed by N1=0, N3=0, N4=0, and N6=0, thus turning off the third transistor M3, the seventh transistor M7, the eleventh transistor M11 and the fourteenth transistor M14. At this time, OUT1=0, OUT2=0, OUT3=0, OUT4=0.

Thereafter, the output signals at the output terminals OUT1, OUT2, OUT3, and OUT4 are all at a low potential regardless of the changes of CLKE_1, CLKE_2, CLKE_3, and CLKE_4. When the input pulses are received again at the first input terminal IN1 and the second input terminal IN2, the shift register unit circuit according to the present disclosure will repeat the operations in the above time periods.

Figure 8:
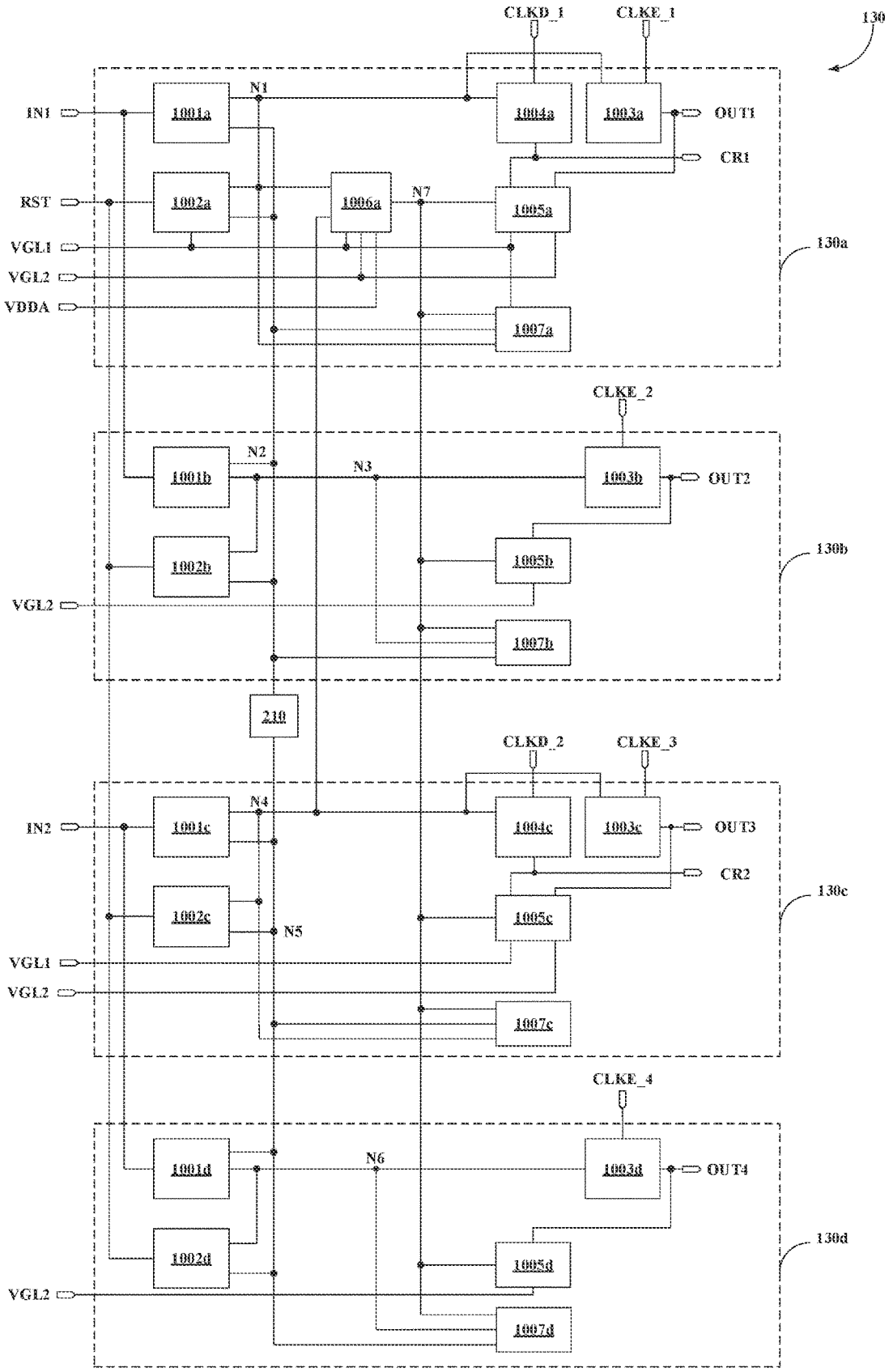
FIG. 8 is a schematic block diagram of a shift register unit circuit according to another exemplary embodiment of the present disclosure.

Referring now to FIG. 8, it schematically illustrates the structure of a shift register unit circuit 130 according to another exemplary embodiment of the present disclosure in the form of a block diagram. It should be noted that the shift register unit circuit 130 in FIG. 8 is structurally similar to the shift register unit circuit 120 shown in FIG. 5, so only the structural differences between the shift register unit circuit 130 in FIG. 8 and the shift register unit circuit 120 shown in FIG. 5 will be described hereinafter, and the parts that are the same between the two will not be repeatedly described.

As shown in FIG. 8, the shift register unit circuit 130 further includes: a first transfer terminal CR1 configured to output a first transfer signal; a second transfer terminal CR2 configured to output a second transfer signal; a first transfer clock terminal CLKD_1 configured to receive a first transfer clock signal; a second transfer clock terminal CLKD_2 configured to receive a second transfer clock signal; a second voltage terminal VGL2 configured to be applied with a second voltage signal; and a third voltage terminal VDDA configured to be applied with a third voltage signal. It should be noted that the first transfer clock signal received at the first transfer clock terminal CLKD_1 may have the same waveform as the first clock signal received at the first clock terminal CLKE_1; the second transfer clock signal received at the second transfer clock terminal CLKD_2 may have the same waveform as the third clock signal received at the third clock terminal CLKE_3. Thus, the first transfer signal output at the first transfer terminal CR1 can have the same waveform as the first output signal output at the first output terminal OUT1, and the second transfer signal output at the second transfer terminal CR2 can have the same waveform as the third output signal output at the third output terminal OUT3. By setting the first transfer terminal CR1 and the second transfer terminal CR2, the output signals for generating the gate driving signals in the shift register unit circuit 130 and the transfer signals for cascading the shift register unit circuit 130 to form a gate driver are separated from each other, so that the noise in the corresponding signals can be eliminated and the load carrying capacity of the circuit can be enhanced. In addition, the first voltage terminal VGL1 and the second voltage terminal VGL2 are both applied with a low potential voltage signal. In some exemplary embodiments of the present disclosure, the potential at the second voltage terminal VGL2 may be higher than the potential at the first voltage terminal VGL1.

Referring further to FIG. 8, the first sub-unit circuit 130*a* of the shift register unit circuit 130 further includes a first sub-unit transfer circuit 1004*a*, a first sub-unit first control circuit 1006*a*, a first sub-unit second control circuit 1005*a*, and a first sub-unit third control circuit 1007*a*.

The first sub-unit transfer circuit 1004*a* is configured to: in response to the first node N1 being at an active potential, bring the first transfer clock terminal CLKD_1 into conduction with the first transfer terminal CR1, and in response to the first node N1 being at an inactive potential, disconnect the first transfer clock terminal CLKD_1 from the first transfer terminal CR1 in conduction. The first sub-unit first control circuit 1006*a* is configured to: when the third voltage terminal VDDA is at an active potential, in response to either of the first node N1 and the fourth node N4 being at an active potential, disconnect the third voltage terminal VDDA from the seventh node N7 in conduction, and in response to the first node N1 being at an active potential, bring the seventh node N7 into conduction with the first voltage terminal VGL1, and in response to the first node N1 and the fourth node N4 being both at an inactive potential, disconnect the seventh node N7 from the first voltage terminal VGL1 in conduction and bring the seventh node N7 into conduction with the third voltage terminal VDDA; when the third voltage terminal VDDA is at an inactive potential, in response to the first node N1 being at an active potential, bring the seventh node N7 into conduction with the first voltage terminal VGL1, and in response to the first node N1 is at an inactive potential, disconnect the seventh node N7 from the first voltage terminal VGL1 in conduction. The first sub-unit second control circuit 1005*a* is configured to: in response to the seventh node N7 being at an active potential, bring the first transfer terminal CR1 into conduction with the first voltage terminal VGL1 and bring the first output terminal OUT1 into conduction with the second voltage terminal VGL2, and in response to the seventh node N7 being at an inactive potential, disconnect the first transfer terminal CR1 from the first voltage terminal VGL1 in conduction and disconnect the first output terminal OUT1 from the second voltage terminal VGL2 in conduction. The first sub-unit third control circuit 1007*a* is configured to: in response to the seventh node N7 being at an active potential, bring the first node N1 and the second node N2 into conduction with the first voltage terminal VGL1, and in response to the seventh node N7 being at an inactive potential, disconnect the first node N1 and the second node N2 from the first voltage terminal VGL1 in conduction.

The second sub-unit circuit 130*b* of the shift register unit circuit 130 further includes a second sub-unit first control circuit 1005*b* and a second sub-unit second control circuit 1007*b*.

The second sub-unit first control circuit 1005*b* is configured to: in response to the seventh node N7 being at an active potential, bring the second output terminal OUT2 into conduction with the second voltage terminal VGL2, and in response to the seventh node N7 being at an inactive potential, disconnect the second output terminal OUT2 from the second voltage terminal VGL2 in conduction. The second sub-unit second control circuit 1007*b* is configured to: in response to the seventh node N7 being at an active potential, bring the third node N3 into conduction with the second node N2, and in response to the seventh node N7 being at an inactive potential, disconnect the third node N3 from the second node N2 in conduction.

The third sub-unit circuit 130*c* of the shift register unit circuit 130 further includes a third sub-unit transfer circuit 1004*c*, a third sub-unit first control circuit 1005*c*, and a third sub-unit second control circuit 1007*c*.

The third sub-unit transfer circuit 1004*c* is configured to: in response to the fourth node N4 being at an active potential, bring the second transfer clock terminal CLKD_2 into conduction with the second transfer terminal CR2, and in response to the fourth node N4 being at an inactive potential, disconnect the second transfer clock terminal CLKD_2 from the second transfer terminal CR2 in conduction. The third sub-unit first control circuit 1005*c* is configured to: in response to the seventh node N7 being at an active potential, bring the second transfer terminal CR2 into conduction with the first voltage terminal VGL1 and bring the third output terminal OUT3 into conduction with the second voltage terminal VGL2, and in response to the seventh node N7 being at an inactive potential, disconnect the second transfer terminal CR2 from the first voltage terminal VGL1 in conduction and disconnect the third output terminal OUT3 from the second voltage terminal VGL2 in conduction. The third sub-unit second control circuit 1007*c* is configured to: in response to the seventh node N7 being at an active potential, bring the fourth node N4 into conduction with the fifth node N5, and in response to the seventh node N7 being at an inactive potential, disconnect the fourth node N4 from the fifth node N5 in conduction.

The fourth sub-unit circuit 130*d* of the shift register unit circuit 130 further includes a fourth sub-unit first control circuit 1005*d* and a fourth sub-unit second control circuit 1007*d*.

The fourth sub-unit first control circuit 1005*d* is configured to: in response to the seventh node N7 being at an active potential, bring the fourth output terminal OUT4 into conduction with the second voltage terminal VGL2, and in response to the seventh node N7 being at an inactive potential, disconnect the fourth output terminal OUT4 from the second voltage terminal VGL2 in conduction. The fourth sub-unit second control circuit 1007*d* is configured to: in response to the seventh node N7 being at an active potential, bring the fifth node N5 into conduction with the sixth node N6, and in response to the seventh node N7 being at an inactive potential, disconnect the fifth node N5 from the sixth node N6 in conduction.

Figure 9:
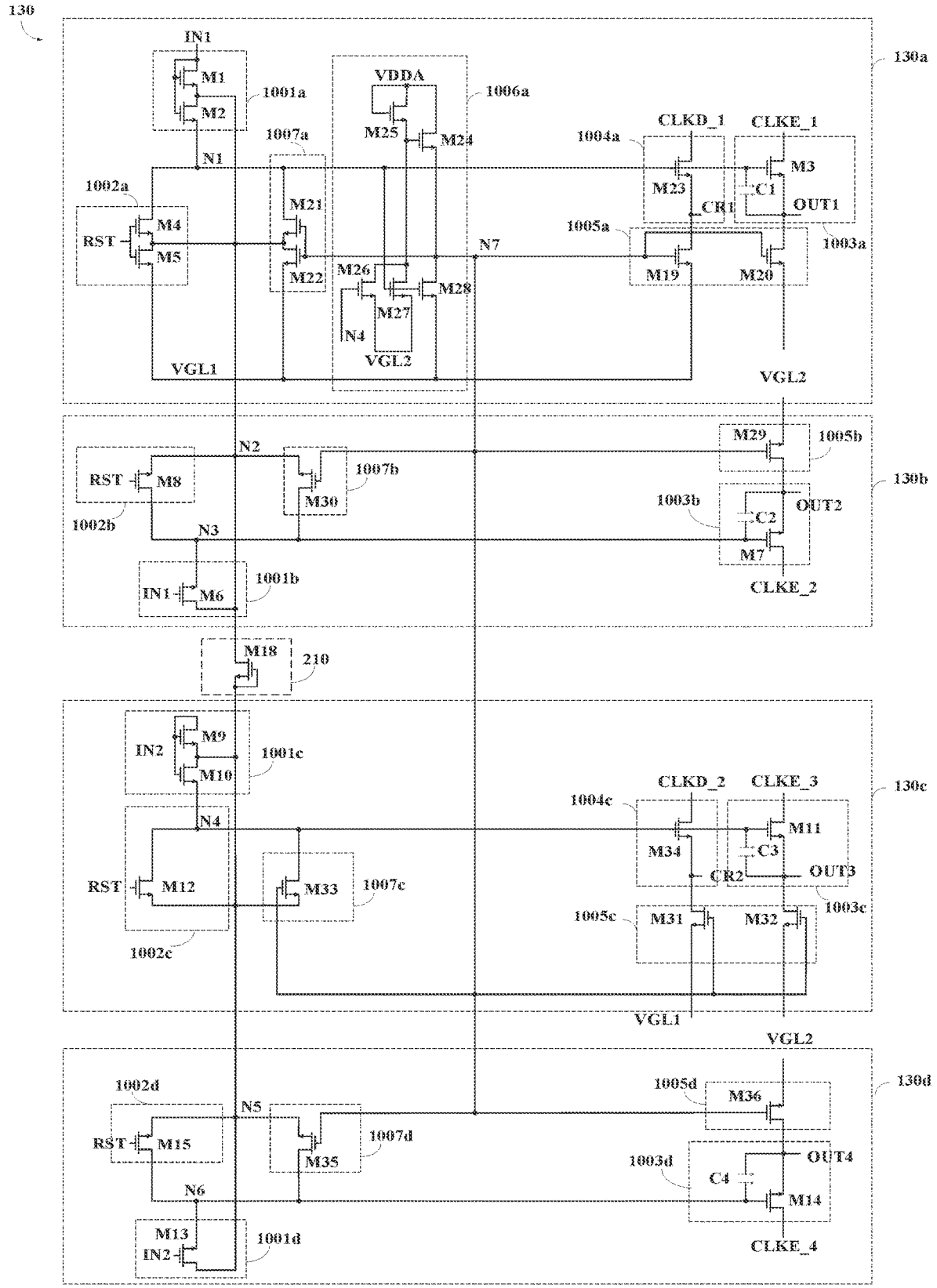
FIG. 9 is a circuit diagram schematically illustrating an exemplary circuit for the shift register unit circuit shown in FIG. 8.

Referring to FIG. 9, it schematically illustrates an exemplary circuit of the shift register unit circuit 130 shown in FIG. 8. It should be noted that the exemplary circuit of the shift register unit circuit 130 shown in FIG. 9 is similar to the exemplary circuit of the shift register unit circuit 120 shown in FIG. 6, so only the differences between the exemplary circuit of the shift register unit circuit 130 in FIG. 9 and the exemplary circuit of the shift register unit circuit 120 shown in FIG. 6 will be described hereinafter, and the parts that are the same between the two will not be repeatedly described.

The first sub-unit transfer circuit 1004*a* may include a twenty-third transistor M23 with its first electrode connected to the first transfer clock terminal CLKD_1, its second electrode connected to the first transfer terminal CR1, and its control electrode thereof connected to the first node N1.

The first sub-unit first control circuit 1006*a* may comprise: a twenty-fourth transistor M24 with its first electrode connected to the third voltage terminal VDDA and its second electrode connected to the seventh node N7; a twenty-fifth transistor M25 with its first electrode and control electrode are both connected to the third voltage terminal VDDA; a twenty-sixth transistor M26 with its second electrode connected to the second voltage terminal VGL2 and its control electrode connected to the fourth node N4; a twenty-seventh transistor M27 with its control electrode connected to the first node N1 and its second electrode connected to the second voltage terminal VGL2; a twenty-eighth transistor M28 with its first electrode connected to the seventh node N7, its second electrode connected to the first voltage terminal VGL1, and its control electrode is connected to the first node N1; wherein the control electrode of the twenty-fourth transistor M24, the second electrode of the twenty-fifth transistor M25, the first electrode of the twenty-sixth transistor M26 and the first electrode of the twenty-seventh transistor M27 are connected together.

It should be noted that the twenty-fifth transistor M25 and the twenty-seventh transistor M27 can be designed to have such a width-to-length ratio (which determines the equivalent on-resistance of the transistor) that the potential at the second electrode of the twenty-fifth transistor M25 (i.e., the potential at the first electrode of the twenty-seventh transistor M27 and the control electrode of the twenty-fourth transistor M24) is set at an inactive potential when the twenty-fifth transistor M25 and the twenty-seventh transistor M27 are both turned on. Similarly, the twenty-fifth transistor M25 and the twenty-sixth transistor M26 can also be designed to have such a width-to-length ratio that the potential at the second electrode of the twenty-fifth transistor M25 (i.e., the potential at the first electrode of the twenty-sixth transistor M26 and the control electrode of the twenty-fourth transistor M24) is set to an inactive potential when the twenty-fifth transistor M25 and the twenty-sixth transistor M26 are both turned on.

Thus, for the first sub-unit first control circuit 1006*a*, when the third voltage terminal VDDA is at an active potential (e.g., at a high potential for an N-type transistor), the twenty-fifth transistor M25 is turned on. In this case, when at least one of the first node N1 and the fourth node N4 is at an active potential, at least one of the twenty-sixth transistor M26 and the twenty-seventh transistor M27 is turned on, so that the potential at the control electrode of the twenty-fourth transistor M24 is at an inactive potential, causing the twenty-fourth transistor M24 turned off to disconnect the third voltage terminal VDDA from the seventh node N7 in conduction. In addition, when the first node N1 is at an active potential, the twenty-eighth transistor M28 is turned on to bring the seventh node N7 into conduction with the first voltage terminal VGL1. When both the first node N1 and the fourth node N4 are at an inactive potential, the twenty-sixth transistor M26 and the twenty-seventh transistor M27 are both turned off, so that the potential at the control electrode of the twenty-fourth transistor M24 is active, and thus the twenty-fourth transistor M24 is turned on to bring the third voltage terminal VDDA into conduction with the seventh node N7; and when the first node N1 is at an inactive potential, the twenty-eighth transistor M28 is turned off to disconnect the seventh node N7 from the first voltage terminal VGL1 in conduction.

It should also be noted that for the first sub-unit first control circuit 1006*a*, when the third voltage terminal VDDA is at an inactive potential (e.g., at a low potential for an N-type transistor), the twenty-fifth transistor M25 is turned off, and the twenty-fourth transistor M24 is also turned off, thus disconnecting the third voltage terminal VDDA from the seventh node N7 in conduction, so that the potential at the seventh node N7 is controlled in this case only by the twenty-eighth transistor M28. That is, in this case, when the first node N1 is at an active potential, the twenty-eighth transistor M28 is turned on to bring the seventh node N7 into conduction with the first voltage terminal VGL1, and when the first node N1 is at an inactive potential, the twenty-eighth transistor M28 is turned off to disconnect the seventh node N7 from the first voltage terminal VGL1 in conduction.

The first sub-unit second control circuit 1005*a* may comprise: a nineteenth transistor M19 with its first electrode connected to the first transfer terminal CR1, its second electrode connected to the first voltage terminal VGL1, and its control electrode connected to the seventh node N7; a twentieth transistor M20 with its first electrode connected to the first output terminal OUT1, its second electrode connected to the second voltage terminal VGL2, and its control electrode connected to the seventh node N7.

The first sub-unit third control circuit 1007*a* may comprise: a twenty-first transistor M21 with its first electrode connected to the first node N1, its second electrode connected to the second node N2, and its control electrode connected to the seventh node N7; and a twenty-second transistor M22 with its first electrode connected to the second node N2, its second electrode connected to the first voltage terminal VGL1, and its control electrode connected to the seventh node N7.

The second sub-unit first control circuit 1005*b* may comprise a twenty-ninth transistor M29 with its first electrode connected to the second output terminal OUT2, its second electrode connected to the second voltage terminal VGL2, and its control electrode connected to the seventh node N7. The second sub-unit second control circuit 1007*b* may comprise a thirtieth transistor M30 with its first electrode connected to the third node N3, its second electrode connected to the second node N2 and its control electrode connected to the seventh node N7.

The third sub-unit transfer circuit 1004*c* may comprise a thirty-fourth transistor M34 with its first electrode connected to the second transfer clock terminal CLKD_2, its second electrode connected to the second transfer terminal CR2, and its control electrode connected to the fourth node N4. The third sub-unit first control circuit 1005*c* may comprise: a thirty-first transistor M31 with its first electrode connected to the second transfer terminal CR2, its second electrode connected to the first voltage terminal VGL1 and its control electrode connected to the seventh node N7; and a thirty-second transistor M32, with its first electrode connected to the third output terminal OUT3, its second electrode connected to the second voltage terminal VGL2 and its control electrode connected to the seventh node N7. The third sub-unit second control circuit 1007*c* may include a thirty-third transistor M33 with its first electrode connected to the fourth node N4, its second electrode connected to the fifth node N5, and its control electrode connected to the seventh node N7.

The fourth sub-unit first control circuit 1005*d* may comprise a thirty-sixth transistor M36 with its first electrode connected to the fourth output terminal OUT4, its second electrode connected to the second voltage terminal VGL2, and its control electrode connected to the seventh node N7. The fourth sub-unit second control circuit 1007*d* comprises a thirty-fifth transistor M35 with its first electrode connected to the sixth node N6, its second electrode connected to said fifth node N5 and its control electrode connected to the seventh node N7.

Figure 10:
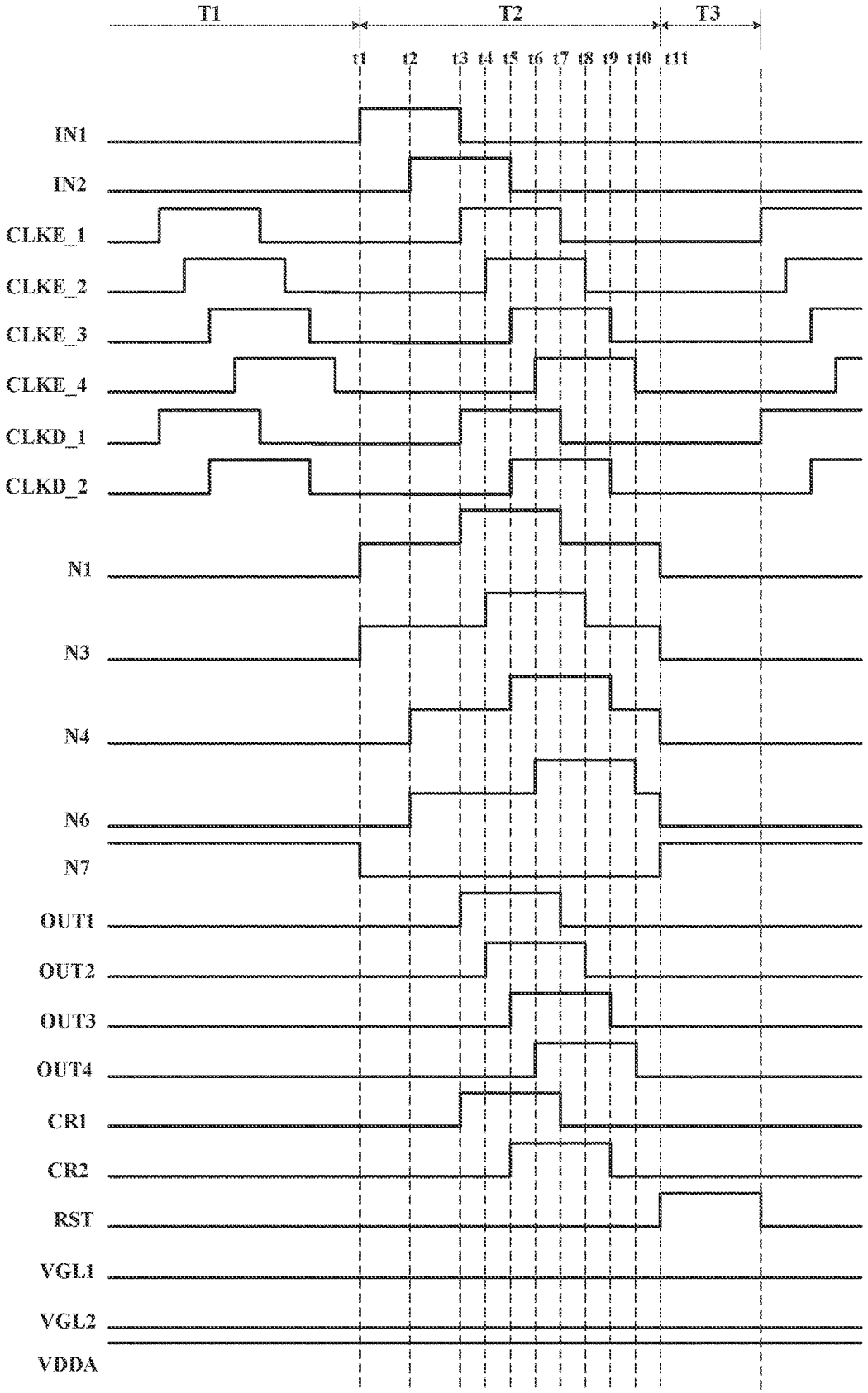
FIG. 10 is a timing diagram for the exemplary circuit of the shift register unit circuit shown in FIG. 9.

Referring to FIG. 10, it schematically illustrates a timing diagram that may be used for the exemplary circuit of the shift register unit circuit 130 shown in FIG. 9. It should be noted that the timing diagram shown in FIG. 10 is similar to the timing diagram shown in FIG. 7, with only the addition of the signals at the signal terminals and nodes added in the shift register unit circuit 130 shown in FIG. 9. Therefore, the timing diagram shown in FIG. 10 will be described hereinafter only with respect to its differences from the timing diagram shown in FIG. 7, and the parts that are the same between the two will not be repeatedly described.

As seen in FIG. 10, the first transfer clock signal received at the first transfer clock terminal CLKD_1 has the same waveform as the first clock signal received at the first clock terminal CLKE_1, the second transfer clock signal received at the second transfer clock terminal CLKD_2 has the same waveform as the third clock signal received at the third clock terminal CLKE_3; and the first transfer signal output from the first transfer terminal CR1 has the same waveform as the first output signal output from the first output terminal OUT1, the second transfer signal output from the second transfer terminal CR2 has the same waveform as the third output signal output from the third output terminal OUT3. In addition, during all time periods, the second voltage terminal VGL2 is applied with a low level voltage signal and the third voltage terminal VDDA is applied with a high level voltage signal, so that the seventh node N7 is at a low potential during the second time period T2 because the first node N1 and the fourth node N4 are at a high potential, and the seventh node N7 is at a high potential during the other time periods. Therefore, for the exemplary circuit of the shift register unit circuit 130 shown in FIG. 9, during the second time period T2, because N7=0, the first, second, third and fourth output terminals OUT1, OUT2, OUT3 and OUT4 and the first and second transfer terminals CR1, CR2 can output output signals and transfer signals respectively; while during the other time periods, because N7=1, the first, second, third and fourth output terminals OUT1, OUT2, OUT3 and OUT4 will be in conduction with the second voltage terminal VGL2, the first and second transfer terminals CR1, CR2 will be in conduction with the first voltage terminal VGL1, and the first, second, third, fourth, fifth and sixth nodes N1, N2, N3, N4, N5 and N6 are all in conduction with the first voltage terminal VGL1, so that signal noise during operation of the shift register unit circuit 130 can be eliminated to keep the clean waveforms of the output signals and the transfer signals.

Figure 11:
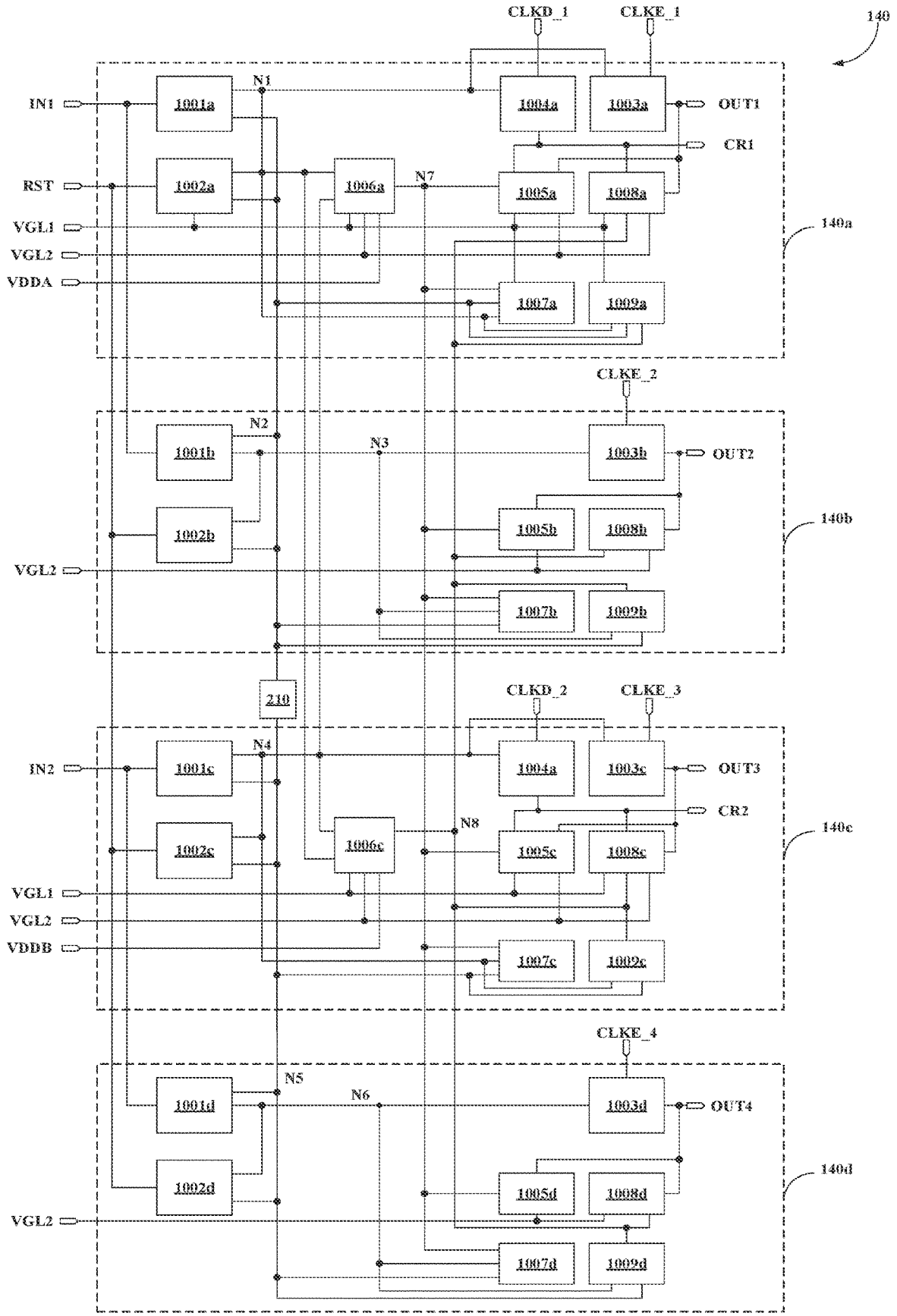
FIG. 11 is a schematic block diagram of an exemplary shift register unit circuit according to another exemplary embodiment of the present disclosure.

Referring now to FIG. 11, it schematically illustrates the structure of a shift register unit circuit 140 according to another exemplary embodiment of the present disclosure in the form of a block diagram. It should be noted that the shift register unit circuit 140 in FIG. 11 is structurally similar to the shift register unit circuit 130 shown in FIG. 8, so only the structural differences between the shift register unit circuit 140 in FIG. 11 and the shift register unit circuit 130 shown in FIG. 8 will be described hereinafter, and the parts that are the same between the two will not be repeatedly described.

As shown in FIG. 11, the shift register unit circuit 140 further includes a fourth voltage terminal VDDB configured to be applied with a fourth voltage signal.

The first sub-unit circuit 140*a* of the shift register unit circuit 140 further includes a first sub-unit fourth control circuit 1008*a* and a first sub-unit fifth control circuit 1009*a*. The first sub-unit fourth control circuit 1008*a* is configured to: in response to the eighth node N8 being at an active potential, bring the first transfer terminal CR1 into conduction with the first voltage terminal VGL1 and bring the first output terminal OUT1 into conduction with the second voltage terminal VGL2, and in response to the eighth node N8 being at an inactive potential, disconnect the first transfer terminal CR1 from the first voltage terminal VGL1 in conduction and disconnect the first output terminal OUT1 from the second voltage terminal VGL2 in conduction. The first sub-unit fifth control circuit 1009*a* is configured to: in response to the eighth node N8 being at an active potential, bring the first node N1 and the second node N2 into conduction with the first voltage terminal VGL1, and in response to the eighth node N8 being at an inactive potential, disconnect the first node N1 and the second node N2 from the first voltage terminal VGL1 in conduction.

The second sub-unit circuit 140*b* of the shift register unit circuit 140 further includes a second sub-unit third control circuit 1008*b* and a second sub-unit fourth control circuit 1009*b*. The second sub-unit third control circuit 1008*b* is configured to: in response to the eighth node N8 being at an active potential, bring the second output terminal OUT2 into conduction with the second voltage terminal VGL2, and in response to the eighth node N8 being at an inactive potential, disconnect the second output terminal OUT2 from the second voltage terminal VGL2 in conduction. The second sub-unit fourth control circuit 1009*b* is configured to: in response to the eighth node N8 being at an active potential, bring the third node N3 into conduction with the second node N2, and in response to the eighth node N8 being at an inactive potential, disconnect the third node N3 from the second node N2 in conduction.

The third sub-unit circuit 140*c* of the shift register unit circuit 140 further includes: a third sub-unit third control circuit 1006*c*, a third sub-unit fourth control circuit 1008*c*, and a third sub-unit fifth control circuit 1009*c*.

The third sub-unit third control circuit 1006*c* is configured to: when the fourth voltage terminal VDDB is at an active potential, in response to either of the first node N1 and the fourth node N4 being at an active potential, disconnect the fourth voltage terminal VDDB from the eighth node N8 in conduction, and in response to the fourth node N4 being at an active potential, bring the eighth node N8 into conduction with the first voltage terminal VGL1, and in response to both the first node N1 and the fourth node N4 being at an inactive potential, disconnect the eighth node N8 from the first voltage terminal VGL1 in conduction and bring the eighth node N8 into conduction with the fourth voltage terminal VDDB; and when the fourth voltage terminal VDDB is at an inactive potential, in response to the fourth node N4 being at an active potential, bring the eighth node N8 into conduction with the first voltage terminal VGL1, and in response to the fourth node N4 is at an inactive potential, disconnect the eighth node N8 from the first voltage terminal VGL1 in conduction. The third sub-unit fourth control circuit 1008*c* is configured to: in response to the eighth node N8 being at an active potential, bring the second transfer terminal CR2 into conduction with the first voltage terminal VGL1 and bring the third output terminal OUT3 into conduction with the second voltage terminal VGL2, and in response to the eighth node N8 being at an inactive potential, disconnect the second transfer terminal CR2 from the first voltage terminal VGL1 in conduction and disconnect the third output terminal OUT3 from the second voltage terminal VGL2 in conduction. The third sub-unit fifth control circuit 1009*c* is configured to: in response to the eighth node N8 being at an active potential, bring the fourth node N4 into conduction with the fifth node N5, and in response to the eighth node N8 being at an inactive potential, disconnect the fourth node N4 from the fifth node N5 in conduction.

The fourth sub-unit circuit 140*d* of the shift register unit circuit 140 further includes a fourth sub-unit third control circuit 1008*d* and a fourth sub-unit fourth control circuit 1009*d*.

The fourth sub-unit third control circuit 1008*d* is configured to: in response to the eighth node N8 being at an active potential, bring the fourth output terminal OUT4 into conduction with the second voltage terminal VGL2, and in response to the eighth node N8 being at an inactive potential, disconnect the fourth output terminal OUT4 from the second voltage terminal VGL2 in conduction. The fourth sub-unit fourth control circuit 1009*d* is configured to: in response to the eighth node N8 being at an active potential, bring the fifth node N5 into conduction with the sixth node N6, and in response to the eighth node N8 being at an inactive potential, disconnect the fifth node N5 from the sixth node N6 in conduction.

Figure 12:
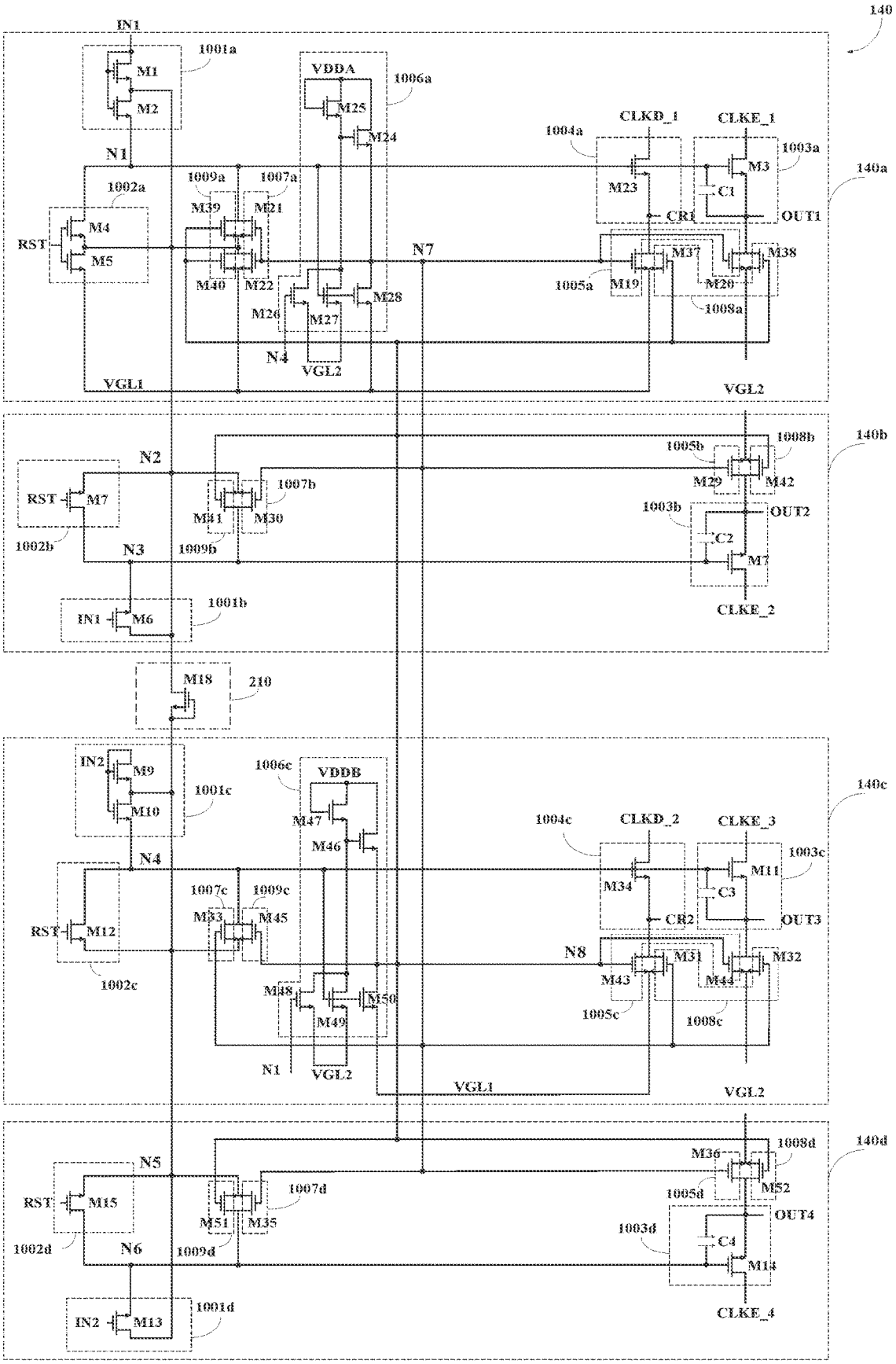
FIG. 12 is a circuit diagram schematically illustrating an exemplary circuit for the shift register unit circuit shown in FIG. 11.

Referring to FIG. 12, it schematically illustrates an exemplary circuit of the shift register unit circuit 140 shown in FIG. 11. It should be noted that the exemplary circuit of the shift register unit circuit 140 shown in FIG. 12 is similar to the exemplary circuit of the shift register unit circuit 130 shown in FIG. 9, so only the differences between the exemplary circuit of the shift register unit circuit 140 in FIG. 12 and the exemplary circuit of the shift register unit circuit 130 shown in FIG. 9 will be described hereinafter, and the parts that are the same between the two will not be repeatedly described.

The first sub-unit fourth control circuit 1008*a* may comprise: a thirty-seventh transistor M37 with its first electrode connected to a first transfer terminal CR1, its second electrode connected to a first voltage terminal VGL1, its control electrode connected to the eighth node N8; and a thirty-eighth transistor M38 with its first electrode connected to a first output terminal OUT1, its second electrode connected to a second voltage terminal VGL2, its control electrode connected to the eighth node N8. The first sub-unit fifth control circuit 1009*a* may comprise: a thirty-ninth transistor M39 with its first electrode connected to the first node N1, its second electrode connected to the second node N2, and its control electrode connected to the eighth node N8; and a fortieth transistor M40 with its first electrode connected to the second node N2, its second electrode connected to the first voltage terminal VGL1, its control electrode connected to the eighth node N8.

The second sub-unit third control circuit 1008*b* may comprise a forty-second transistor M42 with its first electrode connected to the second output terminal OUT2, its second electrode connected to the second voltage terminal VGL2 and its control electrode connected to the eighth node N8. The second sub-unit fourth control circuit 1009*b* may comprise a forty-first transistor M41 with its first electrode connected to the third node N3, its second electrode connected to the second node N2, and its control electrode connected to the eighth node N8.

The third sub-unit third control circuit 1006*c* may comprise: a forty-sixth transistor M46 with its first electrode connected to the fourth voltage terminal VDDB and its second electrode connected to the eighth node N8; a forty-seventh transistor M47 with its first electrode and control electrode both connected to the fourth voltage terminal VDDB; a forty-eighth transistor M48 with its second electrode connected to the second voltage terminal VGL2 and its control electrode connected to the first node N1; a forty-ninth transistor M49 with its control electrode connected to the fourth node N4 and its second electrode connected to the second voltage terminal VGL2; a fiftieth transistor M50 with its first electrode connected to the eighth node N8, its second electrode connected to the first voltage terminal VGL1, and its control electrode connected to the fourth node N4; wherein the control electrode of the forty-sixth transistor M46, the second electrode of the forty-seventh transistor M47, the first electrode of the forty-eighth transistor M48, and the first electrode of the forty-ninth transistor M49 are connected together.

It should be noted that the forty-seventh transistor M47 and the forty-eighth transistor M48 can be designed to have such a width-to-length ratio (which determines the equivalent on-resistance of a transistor) that the potential at the second electrode of the forty-seventh transistor M47 (that is, the potential at the first electrode of the forty-ninth transistor M49 and the control electrode of the forty-sixth transistor M46) is set at an inactive potential when the forty-seventh transistor M47 and the forty-eighth transistor M48 are both turned on. Similarly, the forty-seventh transistor M47 and the forty-ninth transistor M49 can be designed to have such a width-to-length ratio that the potential at the second electrode of the forty-seventh transistor M47 (that is, the potential at the first electrode of the forty-eighth transistor M48 and the control electrode of the forty-sixth transistor M46) is set at an inactive potential when the forty-seventh transistor M47 and the forty-ninth transistor M49 are both turned on.

Thus, for the third sub-unit third control circuit 1006*c*, the forty-seventh transistor M47 is turned on when the fourth voltage terminal VDDB is at an active potential (e.g., at a high potential for an N-type transistor). When at least one of the first node N1 and the fourth node N4 is at an active potential, at least one of the forty-eighth transistor M48 and the forty-ninth transistor M49 is turned on, so that the potential at the control electrode of the forty-sixth transistor M46 is at an inactive potential, and thus the forty-sixth transistor M46 is turned off, disconnecting the fourth voltage terminal VDDB from the eighth node N8 in conduction. In addition, when the fourth node N4 is at an active potential, the fiftieth transistor M50 is turned on to bring the eighth node N8 into conduction with the first voltage terminal VGL1. When both the first node N1 and the fourth node N4 are at an inactive potential, the forty-eighth transistor M48 and the forty-ninth transistor M49 are both turned off, so that the potential at the control electrode of the forty-sixth transistor M46 is at an active potential, causing the forty-sixth transistor M46 turned on to bring the fourth voltage terminal VDDB into conduction with the eighth node N8; and, when the fourth node N4 is at an inactive potential, the fiftieth transistor M50 is turned off to disconnect the eighth node N8 from the first voltage terminal VGL1 in conduction.

In addition, for the third sub-unit third control circuit 1006*c*, when the fourth voltage terminal VDDB is at an inactive potential (e.g., at a low potential for an N-type transistor), the forty-seventh transistor M47 is turned off, and the forty-sixth transistor M46 is also turned off, thus disconnecting the fourth voltage terminal VDDB from the eighth node N8 in conduction, so that the potential at the eighth node N8 is only controlled by the fiftieth transistor M50. That is, in this case, when the fourth node N4 is at an active potential, the fiftieth transistor M50 is turned on, bring the eighth node N8 into conduction with the first voltage terminal VGL1, and when the fourth node N4 is at an inactive potential, the fiftieth transistor M50 is turned off to disconnect the eighth node N8 from the first voltage terminal VGL1 in conduction.

The third sub-unit fourth control circuit 1005*c* may include: a forty-third transistor M43 with its first electrode connected to the second transfer terminal CR2, its second electrode connected to the first voltage terminal VGL1, and its control electrode connected to the eighth node N8; a forty-fourth transistor M44 with its first electrode connected to the third output terminal OUT3, its second electrode connected to the second voltage terminal VGL2, and its control electrode connected to the eighth node N8. The third sub-unit fifth control circuit 1009*c* may include a forty-fifth transistor M45 with its first electrode connected to the fourth node N4, its second electrode connected to the fifth node N5, and its control electrode connected to the eighth node N8.

The fourth sub-unit third control circuit 1008*d* may comprise a fifty-second transistor M52 with its first electrode connected to the fourth output terminal OUT4, its second electrode connected to the second voltage terminal VGL2, and its control electrode connected to the eighth node N8. The fourth sub-unit fourth control circuit 1009*d* may comprise a fifty-first transistor M51 with its first electrode connected to the sixth node N6, its second electrode connected to the fifth node N5, and its control electrode connected to the eighth node N8.

Figure 13:
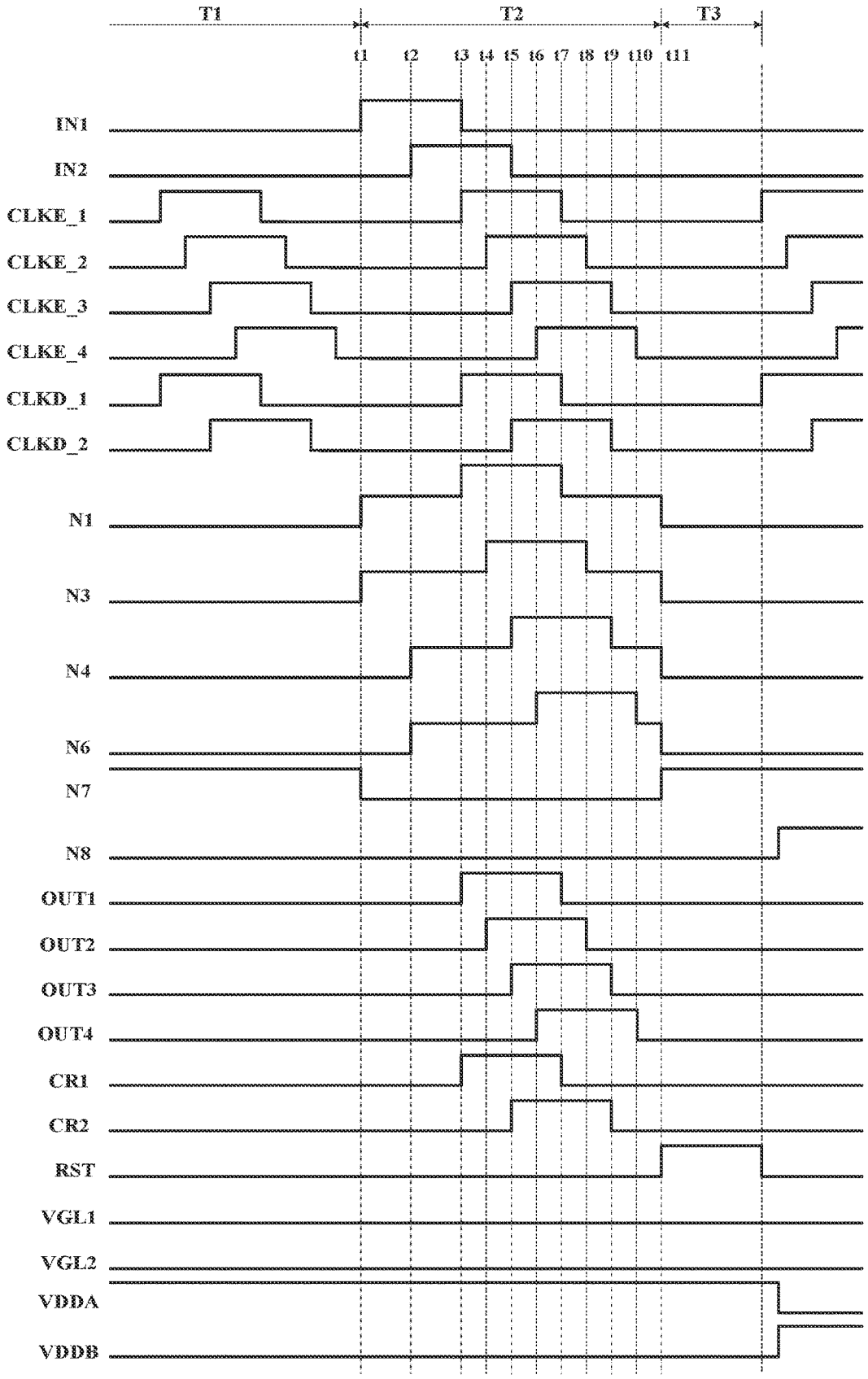
FIG. 13 is a timing diagram of the exemplary circuit of the shift register unit circuit shown in FIG. 12.

Referring to FIG. 13, it schematically illustrates a timing diagram that may be used for the exemplary circuit of the shift register unit circuit 140 shown in FIG. 12. It should be noted that the timing diagram shown in FIG. 13 is similar to the timing diagram shown in FIG. 10, with only the addition of the signals at the signal terminals and nodes added in the shift register unit circuit 140 shown in FIG. 12. Therefore, the timing diagram shown in FIG. 13 will be described only with respect to its differences from the timing diagram shown in FIG. 10 hereinafter, and the parts that are the same between the two will not be repeatedly described.

As can be seen in FIG. 13, the fourth voltage signal received at the fourth voltage terminal VDDB has the opposite phase to the third voltage signal received at the third voltage terminal VDDA. That is, when the third voltage signal is at a high potential, the fourth voltage signal is at a low potential. In addition, as shown in FIG. 13, during operation of the shift register unit circuit 140, the potential of the third voltage signal and the potential of the fourth voltage signal can shift from each other. That is, the third voltage signal can change from a high potential to a low potential, and the fourth voltage signal can change from a low potential to a high potential. As a result, during the operation of the shift register unit circuit 140, the twenty-fifth transistor M25 and the forty-seventh transistor M47 can each be turned on in only about 50% of the time of the operation, so that the loads on the twenty-fifth transistor M25 and the forty-seventh transistor M47 can be reduced, and their lifespans can be extended.

As shown in FIG. 13, when the third voltage terminal VDDA is applied with a high level voltage signal and the fourth voltage terminal VDDB is applied with a low level voltage signal, i.e. VDDA=1 and VDDB=0, it is still possible to keep the seventh node N7 at a low potential during the second time period T2 and at a high potential during the other time periods, while the eighth node N8 is always kept at a low potential. Thus, for the exemplary circuit of the shift register unit circuit 140 shown in FIG. 12, during the second time period T2, because N7=0 and N8=0, the first, second, third, and fourth output terminals OUT1, OUT2, OUT3, and OUT4 and the first and second transfer terminals CR1 and CR2 can output output signals and transfer signals respectively; while during the other time periods, since N7=1 and N8=0, the first, second, third and fourth output terminals OUT1, OUT2, OUT3 and OUT4 will be in conduction with the second voltage terminal VGL2, the first and second transfer terminals CR1, CR2 will be in conduction with the first voltage terminal VGL1, and the first, second, third, fourth, fifth and sixth nodes N1, N2, N3, N4 N5, and N6 are all in conduction with the first voltage terminal VGL1, thereby eliminating the signal noise in the shift register unit circuit 130 and keeping the output and transfer signals with clean waveforms.

It is easily appreciated that when the third voltage terminal VDDA is applied with a low level voltage signal and the fourth voltage terminal VDDB is applied with a high level voltage signal, i.e. VDDA=0 and VDDB=1, due to the third sub-unit third control circuit 1006*c*, it is possible to keep the eighth node N8 at a low potential during the second time period T2 and at a high potential during the other time periods, while the seventh node N7 is always kept at a low potential. Thus, for the exemplary circuit of the shift register unit circuit 140 shown in FIG. 12, during the second time period T2, because N7=0 and N8=0, the first, second, third and fourth output terminals OUT1, OUT2, OUT3 and OUT4 and the first and second transfer terminals CR1 and CR2 can output output signals and transfer signals respectively; while during the other time periods, since N7=0 and N8=1, the first, second, third and fourth output terminals OUT1, OUT2, OUT3 and OUT4 will be in conduction with the second voltage terminal VGL2, the first and second transfer terminals CR1, CR2 will be in conduction with the first voltage terminal VGL1, and the first, second, third, fourth, fifth and sixth nodes N1, N2, N3, N4 N5 and N6 are all in conduction with the first voltage terminal VGL1.

Thus, the shift register unit circuit 140 can also control the outputs of the first, second, third, and fourth output terminals OUT1, OUT2, OUT3, and OUT4 and the first and second transfer terminals CR1, CR2, and control the potentials of the first, second, third, fourth, fifth, and sixth nodes N1, N2, N3, N4, N5, and N6 by using the potential at the eighth node N8, thereby further ensuring that the signal noise in the shift register unit circuit 140 is eliminated and the output and transfer signals are kept with clean waveforms. Also, the turn-on time of the twenty-fifth transistor M25 and the forty-seventh transistor M47 can be reduced by the shift of the voltage signals applied at the third voltage terminal VDDA and the fourth voltage terminal VDDB, so that their loads can be reduced and their lifespans can be extended.

Figure 14:
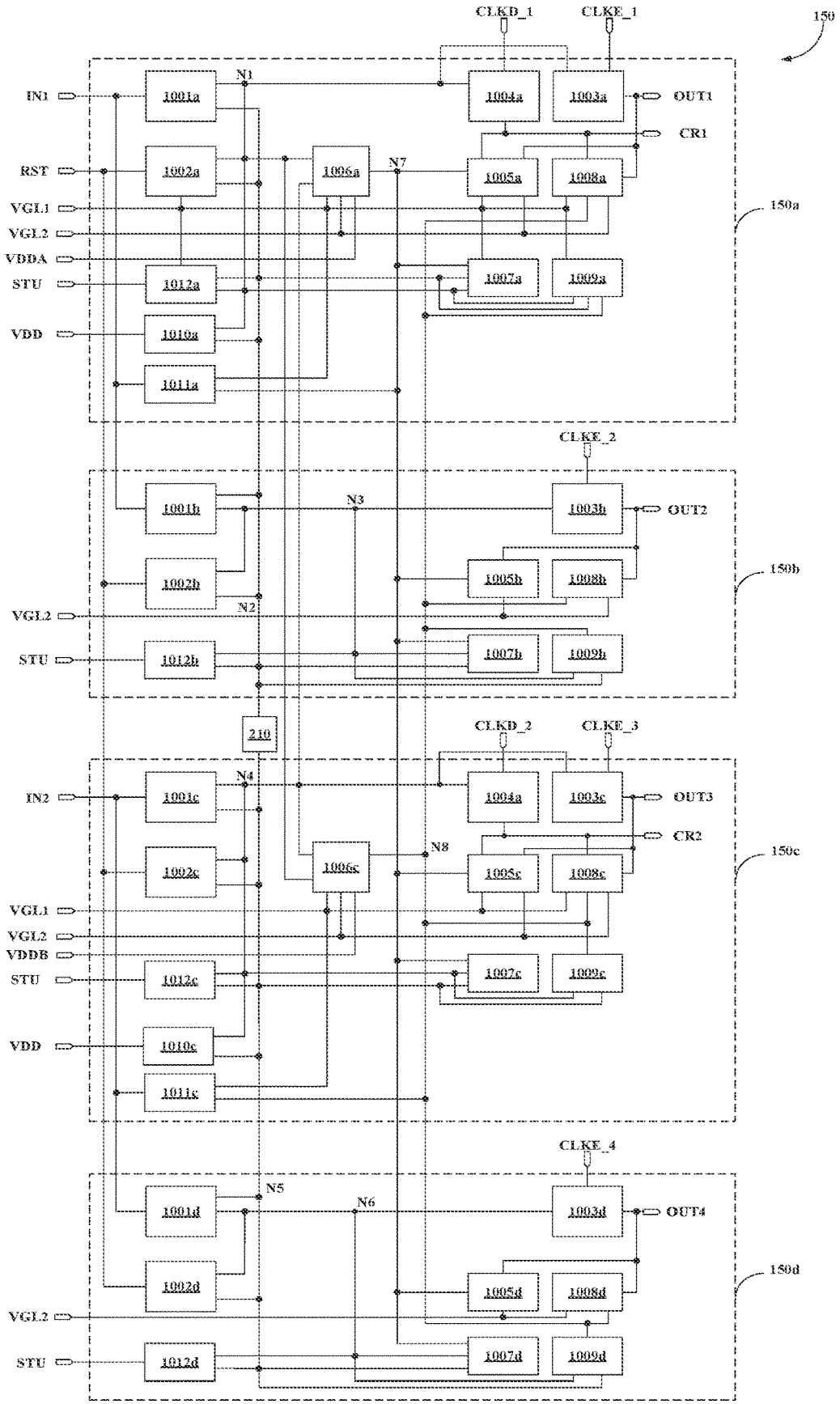
FIG. 14 is a schematic block diagram of a shift register unit circuit according to another exemplary embodiment of the present disclosure.

Referring now to FIG. 14, it schematically illustrates the structure of a shift register unit circuit 150 according to another exemplary embodiment of the present disclosure in the form of a block diagram. It should be noted that the shift register unit circuit 150 in FIG. 14 is structurally similar to the shift register unit circuit 140 shown in FIG. 11, so only the structural differences between the shift register unit circuit 150 in FIG. 14 and the shift register unit circuit 140 shown in FIG. 11 will be described hereinafter, and the parts that are the same between the two will not be repeatedly described.

As shown in FIG. 14, the shift register unit circuit 150 further includes a fifth voltage terminal VDD and a reset terminal STU. The fifth voltage terminal VDD is configured to be applied with a fifth voltage signal, and the reset terminal STU is configured to receive a reset pulse. The reset pulses are generally active at the beginning and end of the time period for a frame of image data in order to reset the potentials of each output terminal, each transfer terminal and each node of all the shift register unit circuits 150. This will be described hereinafter. The fifth voltage signal received at the fifth voltage terminal VDD is used to power the second node N2 and the fifth node N5 when the first node N1 and the fourth node N4 are at an active potential to ensure that the second node N2 and the fifth node N5 are at and remain at an active potential. For an N-type transistor, the fifth voltage signal applied at the fifth voltage terminal VDD is always a high level voltage signal.

The first sub-unit circuit 150*a* of the shift register unit circuit 150 further includes a first sub-unit sixth control circuit 1010*a*, a first sub-unit seventh control circuit 1011*a*, and a first sub-unit reset circuit 1012*a*.

The first sub-unit sixth control circuit 1010*a* is configured to: in response to the first node N1 being at an active potential, bring the second node N2 into conduction with the fifth voltage terminal VDD, and in response to the first node N1 being at an inactive potential, disconnect the second node from the fifth voltage terminal in conduction. The first sub-unit seventh control circuit 1011*a* is configured to: in response to the first input pulse received at the first input terminal IN1 being active, bring the seventh node N7 into conduction with the first voltage terminal VGL1, and in response to the first input pulse received at the first input terminal IN1 being inactive, disconnect the seventh node N7 from the first voltage terminal VGL1 in conduction. The first sub-unit reset circuit 1012*a* is configured to: in response to the reset pulse received at the reset terminal STU being active, bring the first node N1 and the second node N2 into conduction with the first voltage terminal VGL1, and in response to the reset pulse received at the reset terminal STU being inactive, disconnect the first node N1 and the second node N2 from the first voltage terminal VGL1 in conduction.

The second sub-unit circuit 150*b* of the shift register unit circuit 150 further includes a second sub-unit reset circuit 1012*b* configured to: in response to the reset pulse received at the reset terminal STU being active, bring the third node N3 into conduction with the second node N2, and in response to the reset pulse received at the reset terminal STU being inactive, disconnect the third node N3 from the second node N2 in conduction.

The third sub-unit circuit 150*c* of the shift register unit circuit 150 further includes a third sub-unit sixth control circuit 1010*c*, a third sub-unit seventh control circuit 1011*c*, and a third sub-unit reset circuit 1012*c*.

The third sub-unit sixth control circuit 1010*c* is configured to: in response to the fourth node N4 being at an active potential, bring the fifth node N5 into conduction with the fifth voltage terminal VDD, and in response to the fourth node N4 being at an inactive potential, disconnect the fifth node N5 from the fifth voltage terminal VDD in conduction. The third sub-unit seventh control circuit 1011*c* is configured to: in response to the second input pulse received at the second input terminal IN2 being active, bring the eighth node N8 into conduction with the first voltage terminal VGL1, and in response to the second input pulse received at the second input terminal IN2 being inactive, disconnect the eighth node N8 from the first voltage terminal VGL1 in conduction. The third sub-unit reset circuit 1012*c* is configured to: in response to the reset pulse received at the reset terminal STU being active, bring the fourth node N4 into conduction with the fifth node N5, and in response to the reset pulse received at the reset terminal STU being inactive, disconnect the fourth node N4 from the fifth node N5 in conduction.

The fourth sub-unit circuit 150*d* of the shift register unit circuit 150 further includes a fourth sub-unit reset circuit 1012*d* configured to: in response to the reset pulse received at the reset terminal STU being active, bring the fifth node N5 into conduction with the sixth node N6, and in response to the reset pulse received at the reset terminal STU being inactive, disconnect the fifth node N5 from the sixth node N6 in conduction.

Figure 15:
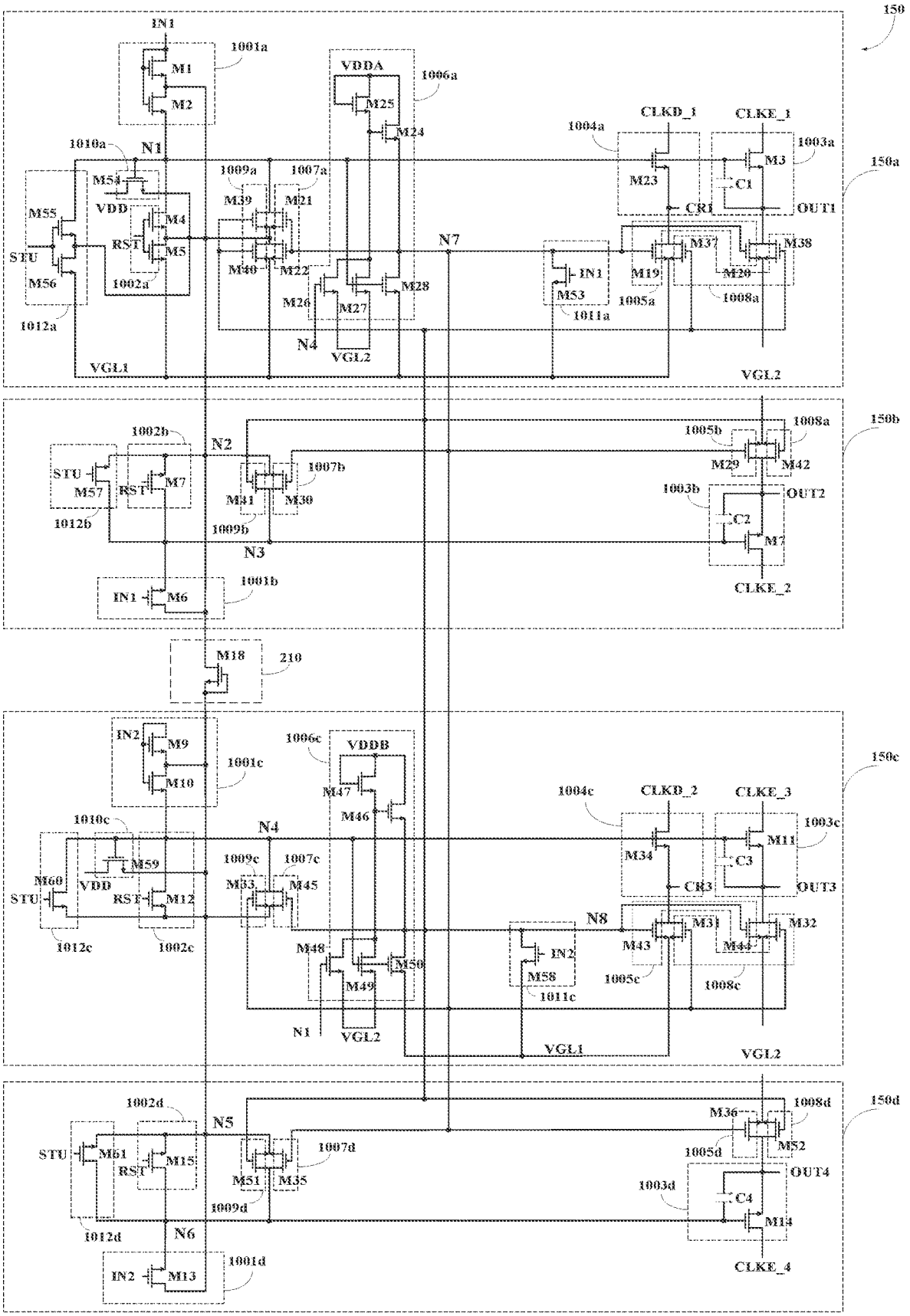
FIG. 15 is a circuit diagram schematically illustrating an exemplary circuit for the shift register unit circuit shown in FIG. 14.

Referring now to FIG. 15, it schematically illustrates an exemplary circuit of the shift register unit circuit 150 shown in FIG. 14. It should be noted that the exemplary circuit of the shift register unit circuit 150 shown in FIG. 15 is similar to the exemplary circuit of the shift register unit circuit 140 shown in FIG. 12, so only the differences between the exemplary circuit of the shift register unit circuit 150 in FIG. 15 and the exemplary circuit of the shift register unit circuit 140 shown in FIG. 12 will be described hereinafter, and the parts that are the same between the two will not be repeatedly described.

The first sub-unit sixth control circuit 1010*a* may include a fifty-fourth transistor M54 with its first electrode connected to the fifth voltage terminal VDD, its second electrode connected to the second node N2, and its control electrode connected to the first node N1. The first sub-unit seventh control circuit 1011*a* may include a fifty-third transistor M53 with its first electrode connected to the seventh node N7, its second electrode connected to the first voltage terminal VGL1, and its control electrode connected to the first input terminal IN1. The first sub-unit reset circuit 1012*a* may include: a fifty-fifth transistor M55 with its first electrode connected to the first node N1, its second electrode connected to the second node N2, and its control electrode connected to the reset terminal STU; and a fifty-sixth transistor M56 with its first electrode connected to the second node N2, its second electrode connected to the first voltage terminal VGL1, and its control electrode connected to the reset terminal STU.

The second sub-unit reset circuit 1012*b* may include a fifty-seventh transistor M57 with its first electrode connected to the third node N3, its second electrode connected to the second node N2, and its control electrode connected to the reset terminal STU.

The third sub-unit sixth control circuit 1010*c* may include a fifty-ninth transistor M59 with its first electrode connected to the fifth voltage terminal VDD, its second electrode connected to the fifth node N5, and its control electrode connected to the fourth node N4. The third sub-unit seventh control circuit 1011*c* may include a fifty-eighth transistor M58 with its first electrode connected to the eighth node N8, its second electrode connected to the first voltage terminal VGL1, and its control electrode connected to the second input terminal IN2. The third sub-unit reset circuit 1012*c* includes the sixtieth transistor M60 with its first electrode connected to the fourth node N4, its second electrode connected to the fifth node N5, and its control electrode connected to the reset terminal STU.

The fourth sub-unit reset circuit 1012*d* may include a sixty-first transistor M61 with its first electrode connected to the sixth node N6, its second electrode connected to the fifth node N5, and its control electrode connected to the reset terminal STU.

Figure 16:
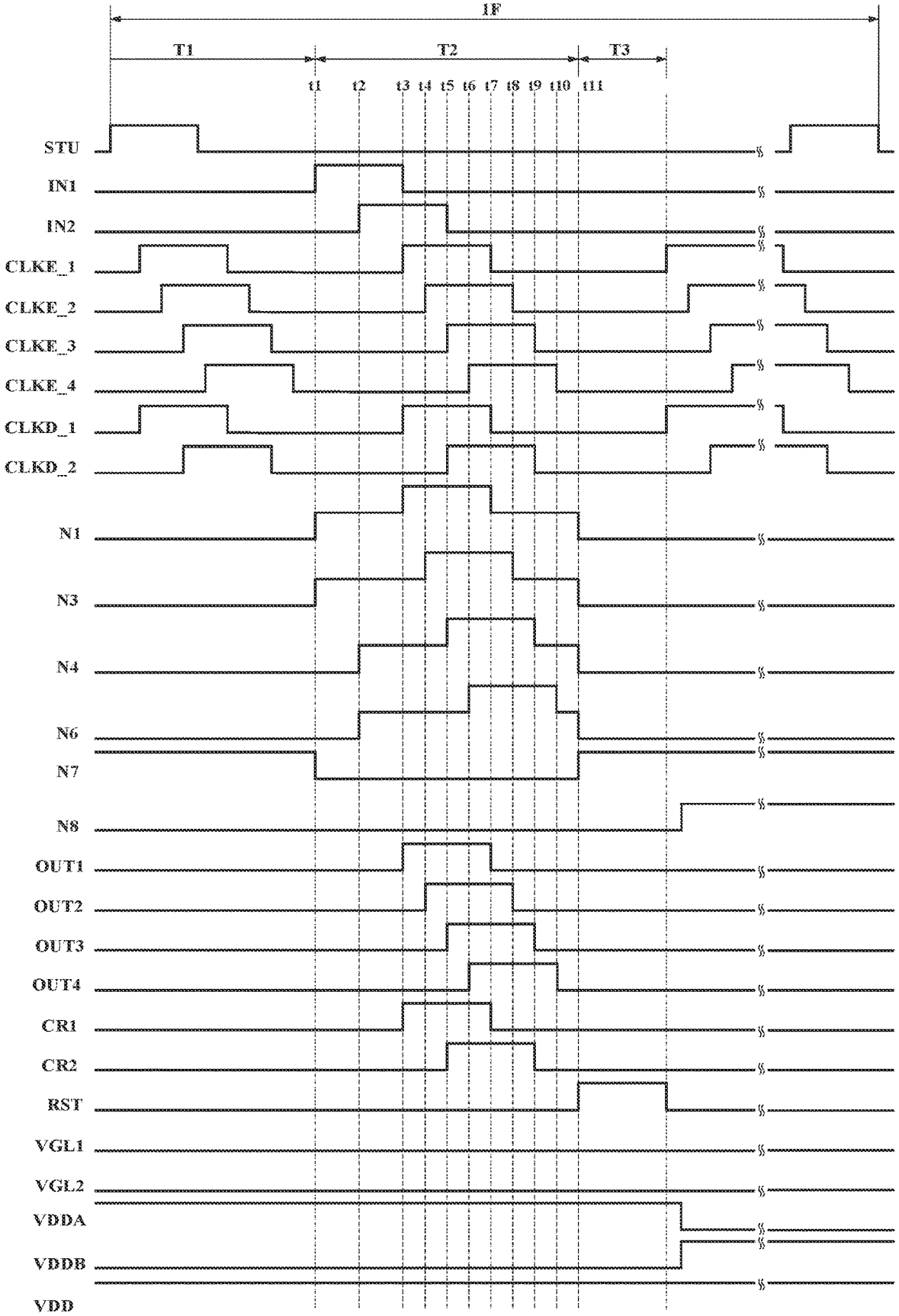
FIG. 16 is a timing diagram for the exemplary circuit of the shift register unit circuit shown in FIG. 14.

Referring to FIG. 16, it schematically illustrates a timing diagram that may be used for the exemplary circuit of the shift register unit circuit 150 shown in FIG. 15. It should be noted that the timing diagram shown in FIG. 16 is similar to the timing diagram shown in FIG. 13, with only the addition of the signals at the signal terminals and nodes added in the shift register unit circuit 150 in FIG. 15. Therefore, the timing diagram shown in FIG. 16 will be described hereinafter only with respect to its differences from the timing diagram shown in FIG. 13, and the parts that are the same between the two will not be repeatedly described.

FIG. 16 illustrates the operation time 1F of the shift register unit circuit 150 for operation on a frame of image data. As shown in FIG. 16, during the operation time 1F, the fifth voltage terminal VDD is applied with a high level voltage signal, so that VDD=1. As can also be seen in FIG. 16, the reset pulse received at the reset terminal STU is active at the beginning of the operation time 1F (the rising edge of this reset pulse is shown in FIG. 16 aligned with the beginning moment of the operation time 1F, but this is not restrictive; in other exemplary embodiments, the rising edge of the reset pulse may not be aligned with the beginning moment of the operation time used for a frame of image data), so that the potentials of each output terminal, each transfer terminal and each node of the shift register unit circuit 150 are reset, and subsequent operations can be performed for a frame of image data; at the end of the operation time 1F, the reset pulse received at the reset terminal STU is again active (the falling edge of this another reset pulse is shown in FIG. 16 aligned with the end moment of the operation time 1F, but this is also non-limiting; in some other exemplary embodiments, the falling edge of the reset pulse may not be aligned with the end moment of the operation time used for a frame of image data), so that at the end of the operation time 1F, the potentials of each output terminal, each transfer terminal and each node of the shift register unit circuit 150 are reset again, thereby making the shift register unit circuit 150 ready for the next operation. During the operation time 1F, VDD=1.

Figure 17:
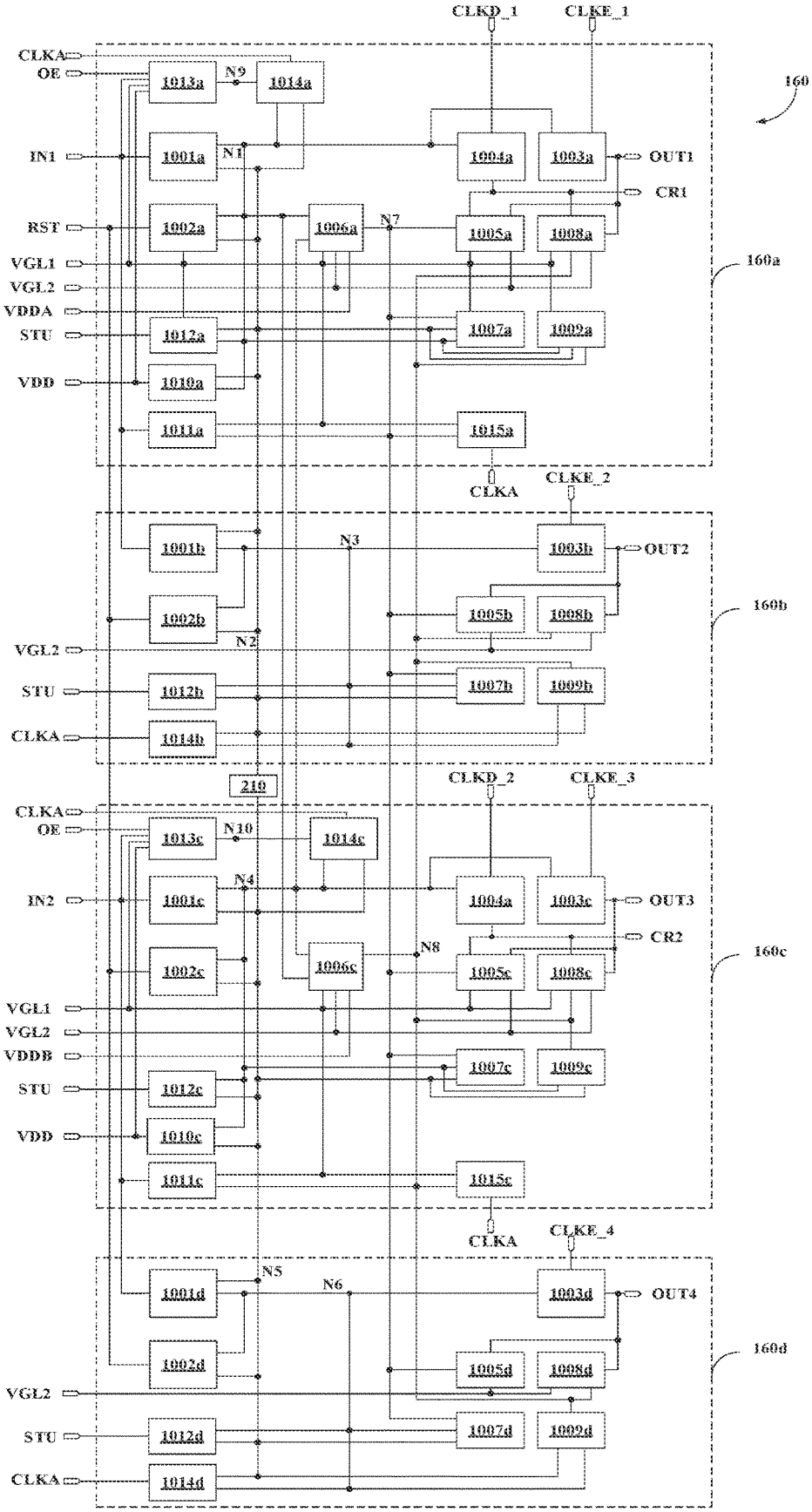
FIG. 17 is a schematic block diagram of a shift register unit circuit according to another exemplary embodiment of the present disclosure.

Referring now to FIG. 17, it schematically illustrates the structure of a shift register unit circuit 160 according to another exemplary embodiment of the present disclosure in the form of a block diagram. It should be noted that the shift register unit circuit 160 in FIG. 17 is structurally similar to the shift register unit circuit 150 shown in FIG. 14, so only the structural differences between the shift register unit circuit 160 in FIG. 17 and the shift register unit circuit 150 shown in FIG. 14 will be described hereinafter, and the parts that are the same between the two will not be repeatedly described.

The shift register unit circuit 160 shown in FIG. 17 further includes a detection control signal terminal OE and a detection pulse terminal CLKA. The detection control signal terminal OE is configured to apply a detection control pulse and the detection pulse terminal CLKA is configured to apply a detection pulse.

As shown in FIG. 17, the first sub-unit circuit 160*a* further includes a first sub-unit first detection control circuit 1013*a*, a first sub-unit second detection control circuit 1014*a*, and a first sub-unit third detection control circuit 1015*a*. The first sub-unit first detection control circuit 1013*a* is configured to: in response to the detection control pulse received at the detection control signal terminal OE being active, bring the ninth node N9 into conduction with the first input terminal IN1 and the fifth voltage terminal VDD, and in response to the detection control pulse received at the detection control signal terminal OE being inactive, disconnect the ninth node N9 from the first input terminal IN1 and the fifth voltage terminal VDD in conduction. The first sub-unit second detection control circuit 1014*a* is configured to: in response to the ninth node N9 being at an active potential and the detection pulse received at the detection pulse terminal CLKA being active, bring the detection pulse terminal CLKA into conduction with the first node N1 and the second node N2, and in response to the ninth node N9 being at an inactive potential or the detection pulse received at the detection pulse terminal CLKA being inactive, disconnect the detection pulse terminal CLKA from the first node N1 and the second node N2 in conduction. The first sub-unit third detection control circuit 1015*a* is configured to: in response to the detection pulse received at the detection pulse terminal CLKA being active, bring the seventh node N7 into conduction with the first voltage terminal VGL1, and in response to the detection pulse received at the detection pulse terminal CLKA being inactive, disconnect the seventh node N7 from the first voltage terminal VGL1 in conduction.

The second sub-unit circuit 160*b* further includes a second sub-unit detection control circuit 1014*b* configured to: in response to the detection pulse received at the detection pulse terminal CLKA being active, bring the second node N2 into conduction with the third node N3, and in response to the detection pulse received at the detection pulse terminal CLKA being inactive, disconnect the second node N2 from the third node N3 in conduction.

The third sub-unit circuit 160*c* further includes a third sub-unit first detection control circuit 1013*c*, a third sub-unit second detection control circuit 1014*c*, and a third sub-unit third detection control circuit 1015*c*. The third sub-unit first detection control circuit 1013*c* is configured to: in response to the detection control pulse received at the detection control signal terminal OE being active, bring the tenth node N10 into conduction with the second input terminal IN2 and the fifth voltage terminal VDD, and in response to the detection control pulse received at the detection control signal terminal OE being inactive, disconnect the tenth node N10 from the second input terminal IN2 and the fifth voltage terminal VDD in conduction. The third sub-unit second detection control circuit 1014*c* is configured to: in response to the tenth node N10 being at an active potential and the detection pulse received at the detection pulse terminal CLKA being active, bring the detection pulse terminal CLKA into conduction with the fourth node N4 and the fifth node N5, and in response to the tenth node N10 being at an inactive potential or the detection pulse received at the detection pulse terminal CLKA being inactive, disconnect the detection pulse terminal CLKA from the fourth node N4 and the fifth node N5 in conduction. The third sub-unit third detection control circuit 1015*c* is configured to: in response to the detection pulse received at the detection pulse terminal CLKA being active, bring the eighth node N8 into conduction with the first voltage terminal VGL1, and in response to the detection pulse received at the detection pulse terminal CLKA being inactive, disconnect the eighth node N8 from the first voltage terminal VGL1 in conduction.

The fourth sub-unit circuit 160*d* further includes a fourth sub-unit detection control circuit 1014*d* configured to: in response to the detection pulse received at the detection pulse terminal CLKA being active, bring the fifth node N5 into conduction with the sixth node N6, and in response to the detection pulse received at the detection pulse terminal CLKA being inactive, disconnect the fifth node N5 from the sixth node N6 in conduction.

As can be seen from FIG. 17 and from the above description, each sub-unit circuit of the shift register unit circuit 160 includes a corresponding detection control circuit in addition to each circuit described with respect to the previous shift register unit circuit. Accordingly, when the shift register unit circuit 160 is selected for detection, i.e., when the detection control pulse received at the detection control signal terminal OE is active and at least partially coincides in timing with an active first input pulse received at the first input terminal IN1 and/or an active second input pulse received at the second input terminal IN2, the shift register unit circuit 160 will output a detection signal to compensate the driving transistors of the pixels. This will be described in detail below. It is easily understood that the shift register unit circuit 160 can be applied in the gate driving circuit for driving an OLED display device.

Figure 18:
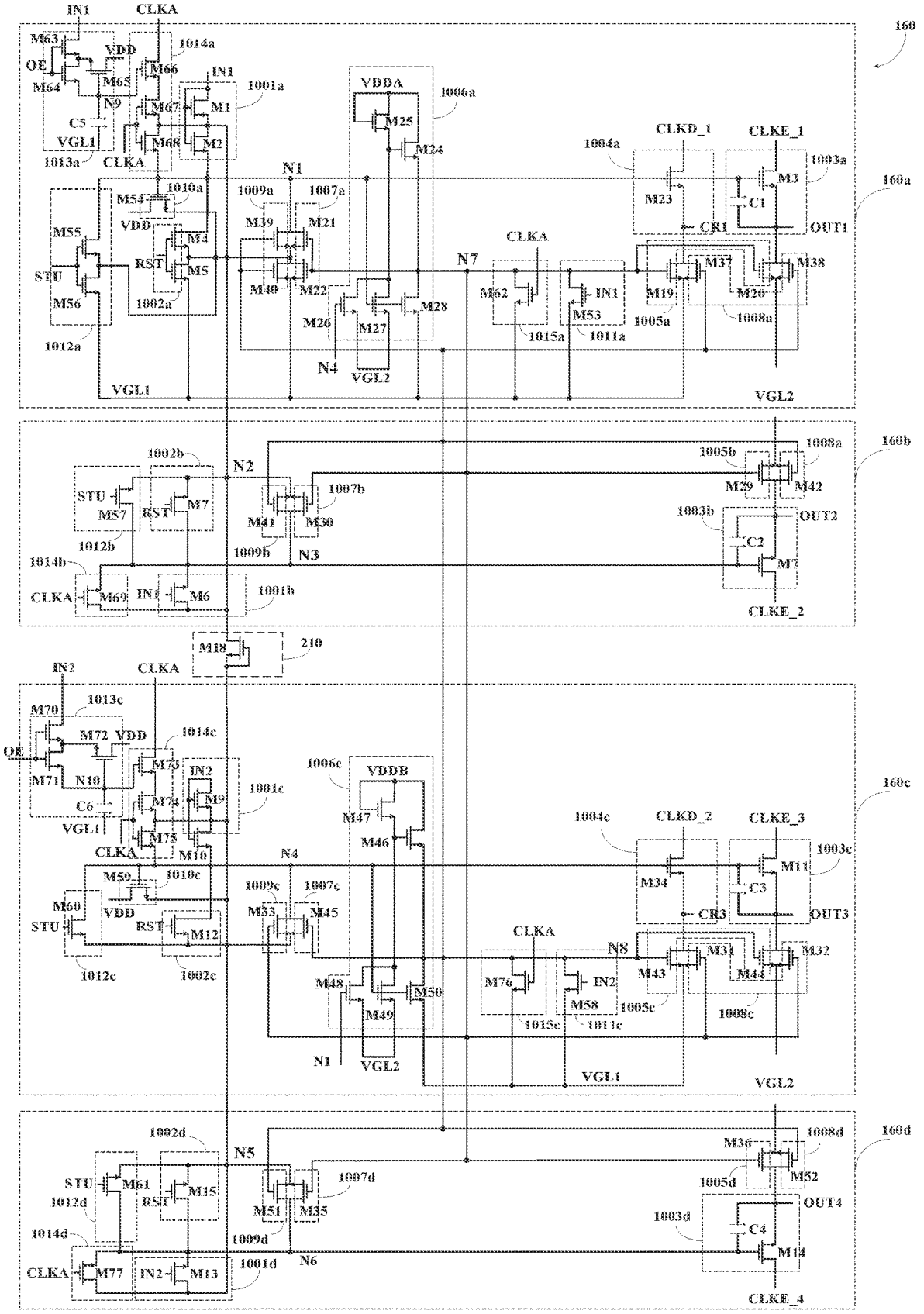
FIG. 18 is a circuit diagram schematically illustrating an exemplary circuit for the shift register unit circuit shown in FIG. 17.

Referring to FIG. 18, it schematically illustrates an exemplary circuit of the shift register unit circuit 160 shown in FIG. 17. It should be noted that the exemplary circuit of the shift register unit circuit 160 shown in FIG. 18 is similar to the exemplary circuit of the shift register unit circuit 150 shown in FIG. 15, so only the differences between the exemplary circuit of the shift register unit circuit 160 in FIG. 18 and the exemplary circuit of the shift register unit circuit 150 shown in FIG. 15 will be described hereinafter, and the parts that are the same between the two will not be repeatedly described.

The first sub-unit first detection control circuit 1013*a* may comprise: a sixty-third transistor M63 with its first electrode connected to the first input terminal IN1 and its control electrode connected to the detection control signal terminal OE; a sixty-fourth transistor M64 with its second electrode connected to the ninth node N9 and its control electrode connected to the detection control signal terminal OE; a sixty-fifth transistor M65 with its first electrode connected to the fifth voltage terminal VDD and its control electrode connected to the ninth node N9; a fifth capacitor C5 with its second electrode connected to the first voltage terminal VGL1; wherein the second electrode of the sixty-third transistor M63, the first electrode of the sixty-fourth transistor M64, the second electrode of the sixty-fifth transistor M65 and the first electrode of the fifth capacitor C5 are connected together. The first sub-unit second detection control circuit 1014*a* may comprise: a sixty-sixth transistor M66 with its first electrode connected to the detection pulse terminal CLKA and its control electrode connected to the ninth node N9; a sixty-seventh transistor M67 with its second electrode connected to the second node N2 and its control electrode connected to the detection pulse terminal CLKA; a sixty-eighth transistor M68 with its first electrode connected to the second node N2, its second electrode connected to the first node N1, and its control electrode connected to the detection pulse terminal CLKA; wherein the second electrode of the sixty-sixth transistor M66 is connected to the first electrode of the sixty-seventh transistor M67. The first sub-unit third detection control circuit 1015*a* may include a sixty-second transistor M62 with its first electrode connected to the seventh node N7, its second electrode connected to the first voltage terminal VGL1, and its control electrode connected to the detection pulse terminal CLKA.

The second sub-unit detection control circuit 1014*b* may include a sixty-ninth transistor with its first electrode connected to the second node N2, its second electrode connected to the third node N3, and its control electrode connected to the detection pulse terminal CLKA.

The third sub-unit first detection control circuit 1013*c* may comprise: a seventieth transistor M70 with its first electrode connected to the second input terminal IN2 and its control electrode connected to the detection control signal terminal OE; a seventy-first transistor M71 with its second electrode connected to the tenth node N10 and its control electrode connected to the detection control signal terminal OE; a seventy-second transistor M72 with its first electrode connected to the fifth voltage terminal VDD and its control electrode connected to the tenth node N10; a sixth capacitor C6 with its second electrode connected to the first voltage terminal VGL1; wherein the second electrode of the seventieth transistor M70, the first electrode of the seventy-first transistor M71, the second electrode of the seventy-second transistor M72 and the first electrode of the sixth capacitor C6 are connected together. The third sub-unit second detection control circuit 1014*c* may comprise: a seventy-third transistor M73 with its first electrode connected to the detection pulse terminal CLKA and its control electrode connected to the tenth node N10; a seventy-fourth transistor M74 with its second electrode connected to the fifth node N5 and its control electrode connected to the detection pulse terminal CLKA; a seventy-fifth transistor M75 with its first electrode connected to the fifth node N5, its second electrode connected to the fourth node N4, and its control electrode connected to the detection pulse terminal CLKA; wherein the second electrode of the seventy-third transistor M73 is connected to the first electrode of the seventy-fourth transistor M74. The third sub-unit third detection control circuit 1015*c* may include a seventy-sixth transistor M76 with its first electrode connected to the eighth node N8, its second electrode connected to the first voltage terminal VGL1, and its control electrode connected to the detection pulse terminal CLKA.

The fourth sub-unit detection control circuit 1014*d* may include a seventy-seventh transistor M77 with its first electrode connected to the fifth node N5, its second electrode connected to the sixth node N6, and its control electrode connected to the detection pulse terminal CLKA.

Figure 19:
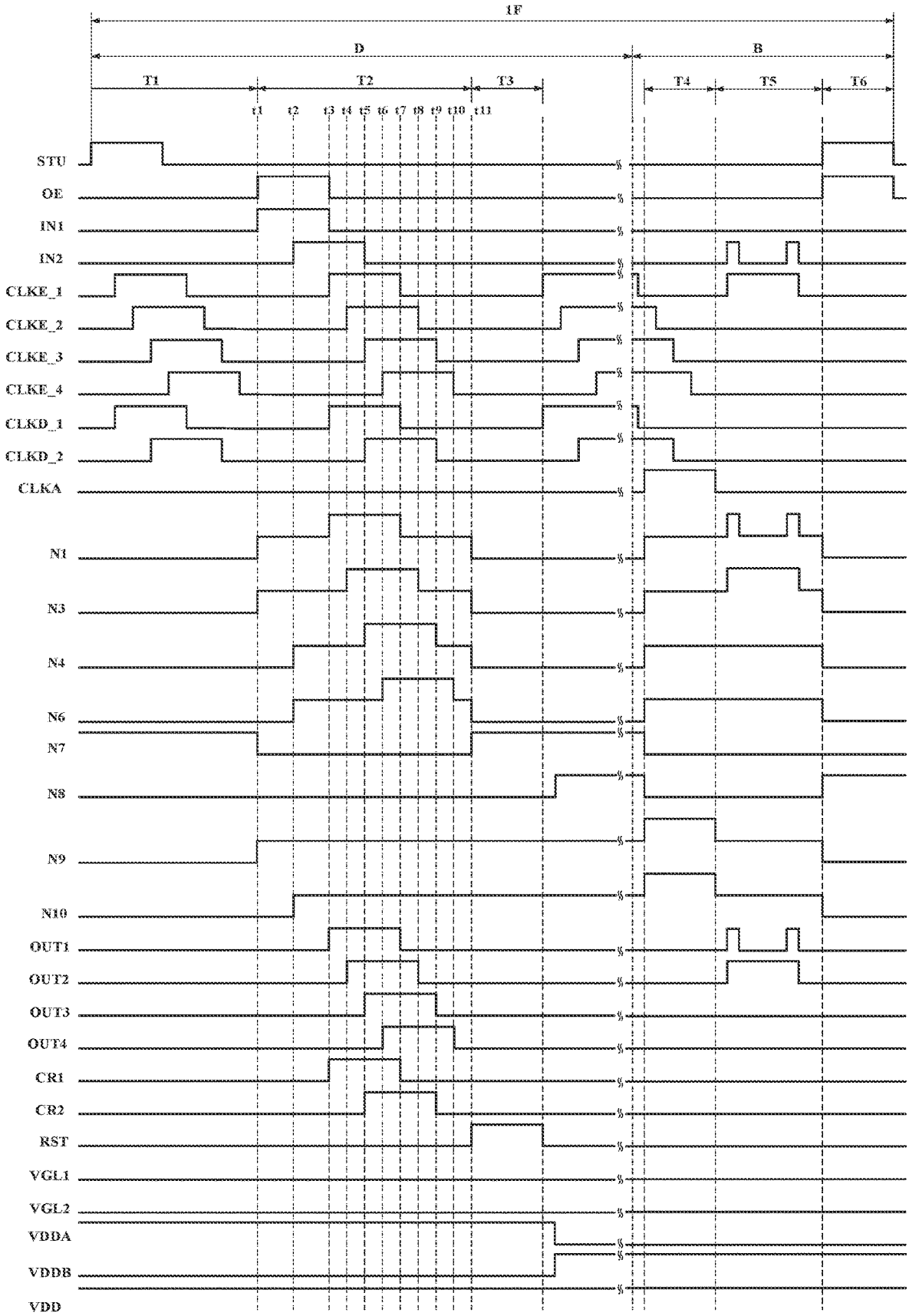
FIG. 19 is a timing diagram for the exemplary circuit of the shift register unit circuit shown in FIG. 18.

Referring to FIG. 19, it exemplarily illustrates a timing diagram that may be used for the exemplary circuit of the shift register unit circuit 160 shown in FIG. 18. It should be noted that the timing diagram shown in FIG. 19 is similar to the timing diagram shown in FIG. 16, with only the addition of the signals at the signal terminals and nodes added in the shift register unit circuit 160 shown in FIG. 18. Accordingly, the timing diagram shown in FIG. 19 will be described hereinafter only with respect to its differences from the timing diagram shown in FIG. 16, and the parts that are the same between the two will not be repeatedly described.

In the timing diagram shown in FIG. 19, the operation time 1F for operation of one frame of image data is divided into two parts: the displaying time D and the blanking time B. The timing of the shift register unit circuit 160 in the displaying time D is similar to the timing diagram shown in FIG. 16 except for the detection pulse terminal CLKA, the detection control signal terminal OE, the ninth node N9, and the tenth node N10.

The detection pulse received at the detection pulse terminal CLKA remains at a low potential during the displaying time D, that is, CLKA=0 during the displaying time D. During the displaying time D, the detection control pulse received at the detection control signal terminal OE is active from the moment t1 to the moment t3, whereby the time period during which the detection control pulse is active coincides with the time period during which the first input pulse received at the first input terminal IN1 is active, and also partially coincides with the time period during which the second input pulse received at the second input terminal IN2 is active (for example, the time period from the moment t2 to the moment t3 as shown in FIG. 19). It should be noted that the waveform of the detection control pulse shown in FIG. 19 is exemplary and not-limiting. The detection control pulse received at the detection control signal terminal OE is a random signal generated by an external device, which determines whether to output a detection signal through the shift register unit circuit to compensate the driving transistors of the pixels by whether it coincides or partially coincides with the active time period(s) of the first input pulse and/or the second input pulse received by the shift register unit circuit 160. Thus, in some other exemplary embodiments of the present disclosure, the time period during which the detection control pulse is active may not coincide with the time period during which the second input pulse is active, or may not even coincide with the time period during which the first input pulse is active, thereby causing the shift register unit circuit to be unselected to output the detection signal. It is easily understood that when a plurality of shift register unit circuits 160 are cascaded with each other to form a gate driver, by the detection control pulse(s) received at the detection control signal terminal OE, any row or rows of that gate driver can randomly be selected to output the detection signal(s) so as to compensate the driving transistors of the pixels of the corresponding row(s).

Referring to FIG. 19 and in conjunction with referring to FIG. 18, from the moment t1 to the moment t3, OE=1, so the sixty-third transistor M63 and the sixty-fourth transistor M64 are both turned on, bringing the ninth node N9 into conduction with the first input terminal IN1. At this time, IN1=1, so N9=1. Because N9=1, the sixty-fifth transistor M65 is turned on, which brings the ninth node N9 into conduction with the fifth voltage terminal VDD. Because VDD=1, the fifth voltage terminal VDD continues to supply power to the ninth node N9 to keep the ninth node N9 at a high potential. And because N9=1, the fifth capacitor C5 is charged. After the moment t3, OE=0, so the sixty-third transistor M63 and the sixty-fourth transistor M64 are both turned off, thus disconnecting the ninth node N9 from the first input terminal IN1 and the fifth voltage terminal VDD in conduction. However, the ninth node N9 remains at a high potential because of the fifth capacitor C5. Because N9=1, the sixty-sixth transistor M66 is turned on. However, since CLKA=0, the sixty-seventh transistor M67 and the sixty-eighth transistor M68 are turned off, making it impossible to bring the detection pulse terminal CLKA into conduction with the first node N1 and the second node N2.

Continuing to refer to FIG. 19 and in conjunction with referring to FIG. 18, from the moment t2 to the moment t3, OE=1, so the seventieth transistor M70 and the seventy-first transistor M71 are both turned on, bringing the tenth node N10 into conduction with the second input terminal IN2. At this time, IN2=1, so N10=1. Because N10=1, the seventy-second transistor M72 is turned on, which brings the tenth node N10 into conduction with the fifth voltage terminal VDD. Because VDD=1, the fifth voltage terminal VDD continues to supply power to the tenth node N10 to keep the tenth node N10 at a high potential. And because N10=1, the sixth capacitor C6 is charged. After the moment t3, OE=0, so the seventieth transistor M70 and the seventy-first transistor M71 are both turned off, thus disconnecting the tenth node N10 from the second input terminal IN2 and the fifth voltage terminal VDD. However, the tenth node N10 remains at a high potential because of the sixth capacitor C6. Since N10=1, the seventy-third transistor M73 is turned on. However, because CLKA=0, the seventy-fourth transistor M74 and the seventy-fifth transistor M75 are turned off, making it impossible to bring the detection pulse terminal CLKA into conduction with the fourth node N4 and the fifth node N5.

In addition, because CLKA=1, the sixty-ninth transistor M69 is turned off, so that the second node N2 cannot be in conduct with the third node N3; similarly, the seventy-seventh transistor M77 is turned off, so that the fifth node N5 cannot be in conduction with the sixth N6.

Thus, during displaying time D, although the ninth node N9 and tenth node N10 change from a low potential to a high potential and remain at a high potential, the potentials of the ninth node N9 and tenth node N10 do not have any effect on the output of the shift register unit circuit 160 because CLKA=0. Thus, during displaying time D, the signal timing of the other signal terminals and nodes of the shift register unit circuit 160 is similar to the timing diagram shown in FIG. 16 and will not be repeatedly described here.

As shown in FIG. 19, during the blanking time B, the detection pulse received at the detection pulse terminal CLKA is active during the fourth time period T4, i.e., CLKA=1. Because CLKA=1, the sixty-seventh transistor M67, the sixty-eighth transistor M68, the seventy-fourth transistor M74, the seventy-fifth transistor M75, the sixty-ninth transistor M69 and the seventy-seventh transistors M77 are all turned on, thereby causing the first, third, fourth, and sixth nodes N1, N3, N4, and N6 all at a high potential. During the fifth time period T5, CLKA=0, but the first, third, fourth, and sixth nodes N1, N3, N4, and N6 remain at a high potential due to the first, second, third, and fourth capacitors C1, C2, C3 and C4. As shown in FIG. 19, during the fifth time period T5, the first clock signal received at the first clock terminal CLKE_1 and the second clock signal received at the second clock terminal CLKE_2 have detection signal waveforms, thereby causing the first output terminal OUT1 and the second output terminal OUT2 to output detection signals accordingly. During the sixth time period T6, STU=1 and OE=1. Since OE=1, the sixty-third transistor M63 and the sixty-fourth transistor M64 are turned on, and IN1=0 at this time, so that the fifth capacitor C5 is discharged, thus causing N9=0. Similarly, the seventieth transistor M70 and the seventy-first transistor M71 are turned on, and IN2=0 at this time, so that the sixth capacitor C6 is discharged, thus causing N10=0. In addition, as previously described, because STU=1, the fifty-fifth transistor M55, the fifty-sixth transistor M56, the fifty-seventh transistor M57, the sixtieth transistor M60 and the sixty-first transistor M61 are turned on, so that the nodes N1 to N6 are all in conduction with the first voltage terminal VGL1, thus causing the nodes N1 to N6 all at a low potential. Because the nodes N1 to N6 are all at a low potential, the seventh node N7 and/or the eighth node N8 are consequently at a high potential, so that the outputs of the first, second, third, and fourth output terminals OUT1, OUT2, OUT3, and OUT4 and the first and second transfer terminals CR1 and CR2 are all low. Thus, a reset of the shift register unit circuit 160 can be achieved.

Figure 20:
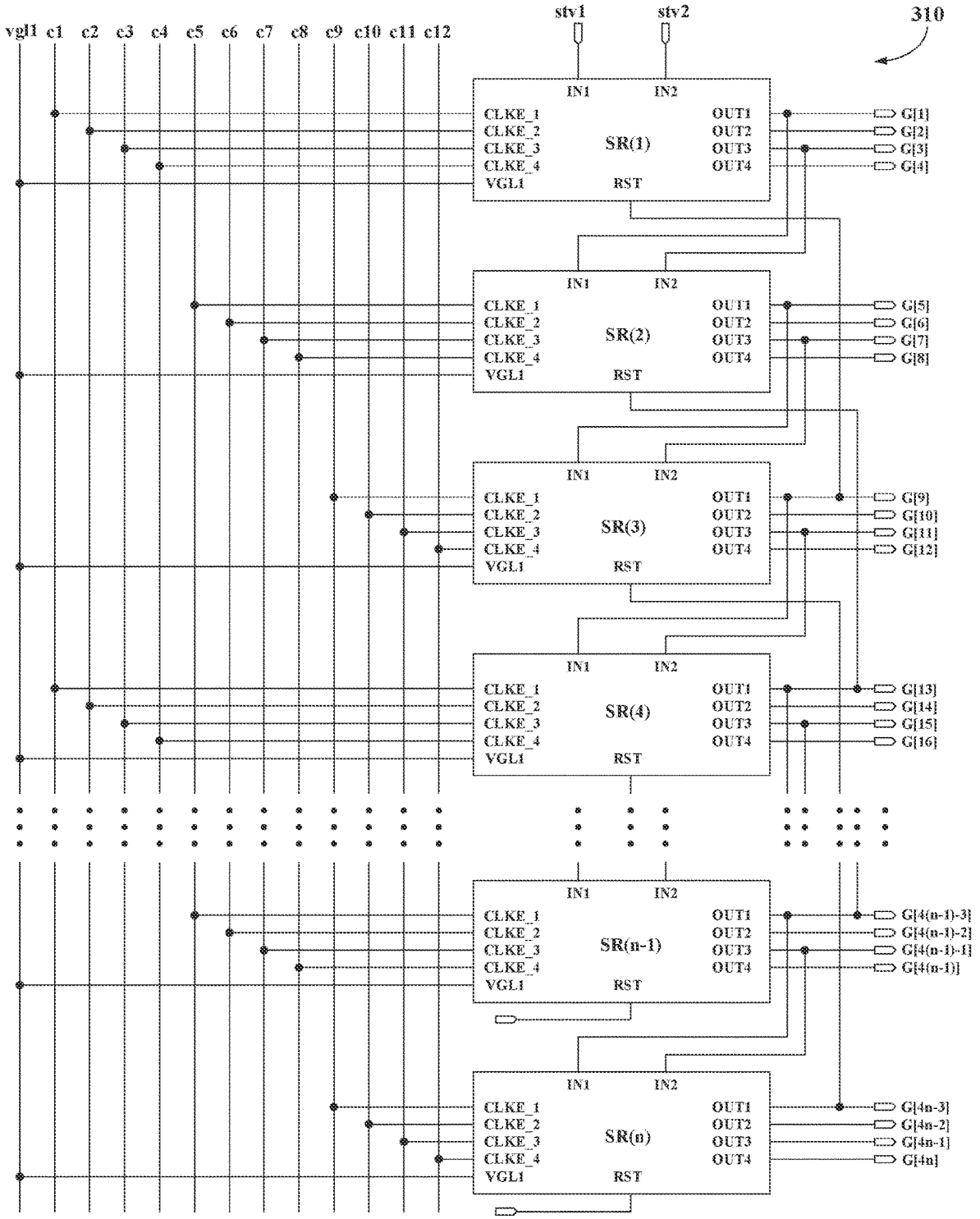
FIG. 20 schematically illustrates a gate driver according to an exemplary embodiment of the present disclosure.

Referring now to FIG. 20, it schematically illustrates a gate driver 310 according to an exemplary embodiment of the present disclosure. The gate driver 310 includes n cascaded shift register unit circuits SR(1), SR(2), . . . , SR(n−1), and SR(n), each of which may take the forms of the shift register unit circuits 100, 110, 120 as described above with respect to FIGS. 1 to 6, wherein n may be a positive integer greater than or equal to 3. In the gate driver 310, the first input terminal IN1 of each of the shift register unit circuits, except for the first shift register unit circuit SR(1), is connected to the first output terminal OUT1 of the adjacent previous shift register unit circuit, and a second input terminal IN2 of each of the shift register unit circuits is connected to the third output OUT3 of the adjacent previous shift register unit circuit. In addition, for the gate driver 310, the reset terminal RST of the (m−2)th shift register unit circuit SR(m−2) of the shift register unit circuits, except for the (n−1)st shift register unit circuit SR(n−1) and the nth shift register unit circuit SR(n), is connected to the first output terminal OUT1 of the (m)th shift register unit circuit SR(m), where m is a positive integer greater than 2 and less than or equal to n. As shown in FIG. 20, the first input terminal IN1 of the shift register unit circuit SR(1) is connected to the first initial signal terminal stv1, and its second input terminal IN2 is connected to the second initial signal terminal stv2.

The n shift register unit circuits SR(1), SR(2), . . . , SR(n−1) and SR(n) in the gate driver 310 can be connected to 4n gate lines G[1], G[2], . . . , G[4n−1] and G[4n], respectively, wherein each of the four outputs of each shift register unit circuit can be connected to a gate line. The first voltage terminal VGL1 of each of the shift register unit circuits may be connected to a first voltage line vgl1 operable for transmitting a first voltage signal, and the clock terminal of each of the shift register unit circuits may be connected to a clock line operable for transmitting a corresponding clock signal. Specifically, in the n shift register unit circuits SR(1), SR(2), . . . , SR(n−1) and SR(n) of the gate driver 310, the first clock terminal CLKE_1 of the (3k−2)th shift register unit circuit SR(3k−2) may be connected to the first clock line c1, the second clock terminal CLKE_2 thereof may be connected to the second clock line c2, the third clock terminal CLKE_3 thereof may be connected to the third clock line c3, and the fourth clock terminal CLKE_4 thereof may be connected to the fourth clock line c4. The first clock terminal CLKE_1 of the (3k−1)th shift register unit circuit SR(3k−1) may be connected to the fifth clock line c5, the second clock terminal CLKE_2 thereof may be connected to the sixth clock line c6, the third clock terminal CLKE_3 thereof may be connected to the seventh clock line c7, and the fourth clock terminal CLKE_4 thereof may be connected to the eighth clock line c8. The first clock terminal CLKE_1 of the (3k)th shift register unit circuit SR(3k) may be connected to the ninth clock line c9, the second clock terminal CLKE_2 thereof may be connected to the tenth clock line c10, the third clock terminal CLKE_3 thereof may be connected to the eleventh clock line c11, the fourth clock terminal CLKE_4 thereof may be connected to the twelfth clock line c12. In above, k is a positive integer and 3k is less than or equal to n. For the clock signals transmitted through the first clock line c1 to the twelfth clock line c12, each has a duty cycle of 1:3, and from the first clock signal transmitted on the first clock line c1 to the twelfth clock signal transmitted on the twelfth clock line c12, each clock signal is sequentially delayed in timing by one-fourth of the pulse width of the high level pulse signal in each cycle, thus enabling each shift register unit circuit to operate with the same (but "time-shifted") timing in order to sequentially generate output signals as the gate turn-on pulses.

Figure 21:
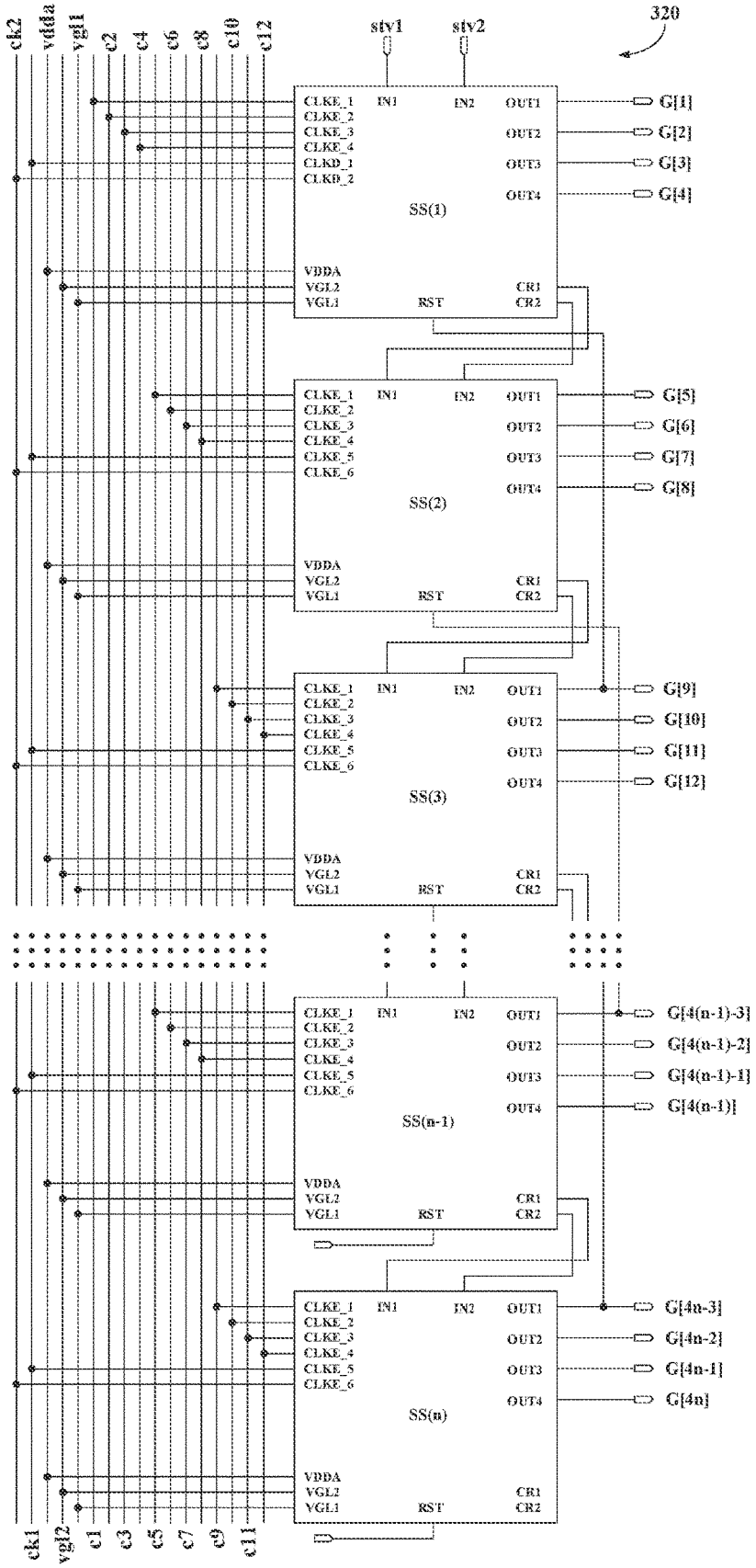
FIG. 21 schematically illustrates a gate driver according to another exemplary embodiment of the present disclosure.

Referring to FIG. 21, it schematically illustrates a gate driver 320 according to another exemplary embodiment of the present disclosure. The gate driver 320 includes n cascaded shift register unit circuits SS(1), SS(2), . . . , SS(n−1) and SS(n), each of which may take the form of the shift register unit circuit 130 as described above with respect to FIGS. 8 and 9, wherein n may be a positive integer greater than or equal to 3. Compared with FIG. 20, each of the shift register unit circuits SS(1), SS(2), . . . , SS(n−1) and SS(n) further includes a second voltage terminal VGL2, a third voltage terminal VDDA, a first transfer terminal CR1, a second transfer terminal CR2, a first transfer clock terminal CLKD_1 and a second transfer clock terminal CLKD_2. Thus, the first input terminal IN1 of each of the shift register unit circuits SS(1), SS(2), . . . , SS(n−1) and SS(n) may be connected to the first transfer terminal CR1 of the adjacent previous shift register unit circuit, and the second input IN2 may be connected to the second transfer terminal CR2 of the adjacent previous shift register unit circuit. In addition, the second voltage terminal VGL2 of each of the shift register unit circuits SS(1), SS(2), . . . , SS(n−1) and SS(n) may be connected to a second voltage line vg12 operable for transmitting a second voltage signal, and the third voltage terminal VDDA thereof may be connected to a third voltage line vdda operable for transmitting a third voltage signal, the first transfer clock terminal CLKD_1 thereof may be connected to a first transfer clock line ck1 operable for transmitting a first transfer clock signal, and the second transfer clock terminal CLKD_2 thereof may be connected to a second transfer clock line ck2 operable for transmitting a second transfer clock signal. The waveform of the first transfer clock signal may be the same as the first clock signal, and the waveform of the second transfer clock signal may be the same as the third clock signal. As shown in FIG. 21, for the gate driver 320, the reset terminal RST of the (m−2)th shift register unit circuit SS(m−2) of the shift register unit circuits is connected to the first output terminal OUT1 of the (m)th shift register unit circuit SS(m) except for the (n−1)th shift register unit circuit SS(n−1) and the (n)th shift register unit circuit SS(n), wherein m is a positive integer greater than 2 and less than or equal to n. However, it is easily understood that, alternatively, for the gate driver 320, the reset terminal RST of the (m−2)th shift register unit circuit SS(m−2) of the shift register unit circuits may also be connected to the first transfer terminal CR1 of the (m)th shift register unit circuit SS(m2), except for the (n−1)th shift register unit circuit SS(n−1) and the (n)th shift register unit circuit SS(n), wherein m is a positive integer greater than 2 and less than or equal to n. Similarly, for the shift register unit circuit with the first transfer terminal and the second transfer terminal described hereinafter, the reset terminal of each shift register unit circuit may be connected to the first output terminal or the first transfer terminal of a corresponding shift register unit circuit, and therefore will not be repeatedly described hereinafter. In addition, each of the shift register unit circuits SS(1), SS(2), SS(n−1) and SS(n) in the gate driver 320 has the other signal terminals connected in the same manner as the corresponding signal terminals in each of the n shift register unit circuits SR(1), SR(2), . . . , SR(n−1) and SR(n) in the gate driver 310 shown in FIG. 20, so they will not be repeatedly described here.

Figure 22:
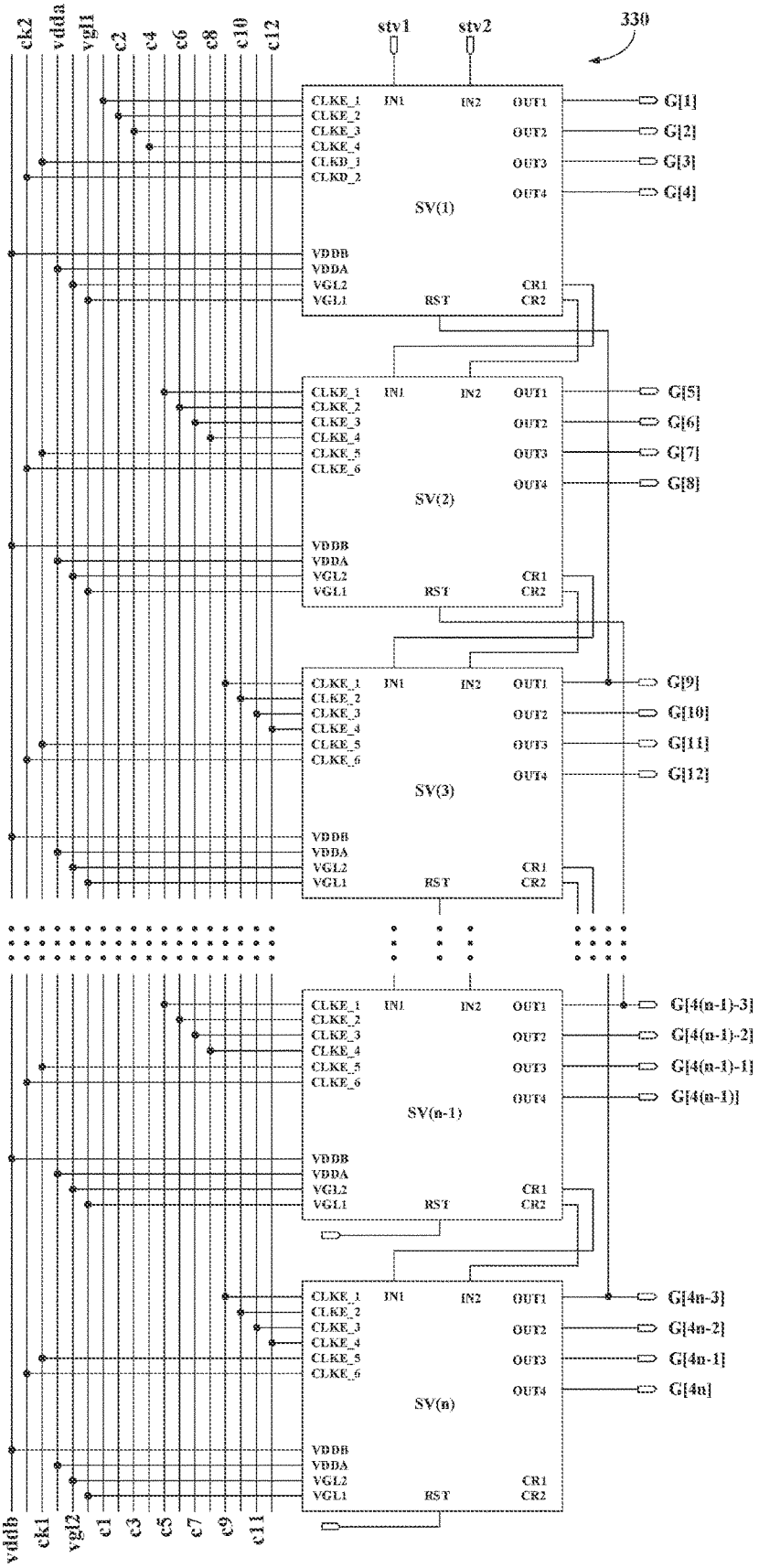
FIG. 22 schematically illustrates a gate driver according to another exemplary embodiment of the present disclosure.

Referring to FIG. 22, it schematically illustrates a gate driver 330 according to another exemplary embodiment of the present disclosure. The gate driver 330 includes n cascaded shift register unit circuits SV(1), SV(2), . . . , SV(n−1) and SV(n), each of which may take the form of the shift register unit circuit 140 as described above with respect to FIGS. 11 and 12, wherein n may be a positive integer greater than or equal to 3. Compared with FIG. 21, each of the shift register unit circuits SV(1), SV(2), . . . , SV(n−1) and SV(n) further includes a fourth voltage terminal VDDB, so that the fourth voltage terminal VDDB of each of the shift register unit circuits SV(1), SV(2), . . . , SV(n−1) and SV(n) may be connected to a fourth voltage line vddb operable for transmitting a fourth voltage signal. In addition, each of the shift register unit circuits SV(1), SV(2), . . . , SV(n−1) and SV(n) in the gate driver 330 has the other signal terminals connected in the same manner as the corresponding signal terminals in each of the n shift register unit circuits SS(1), SS(2), . . . , SS(n−1) and SS(n) in the gate driver 320 shown in FIG. 21, so they will not be repeatedly described here.

Figure 23:
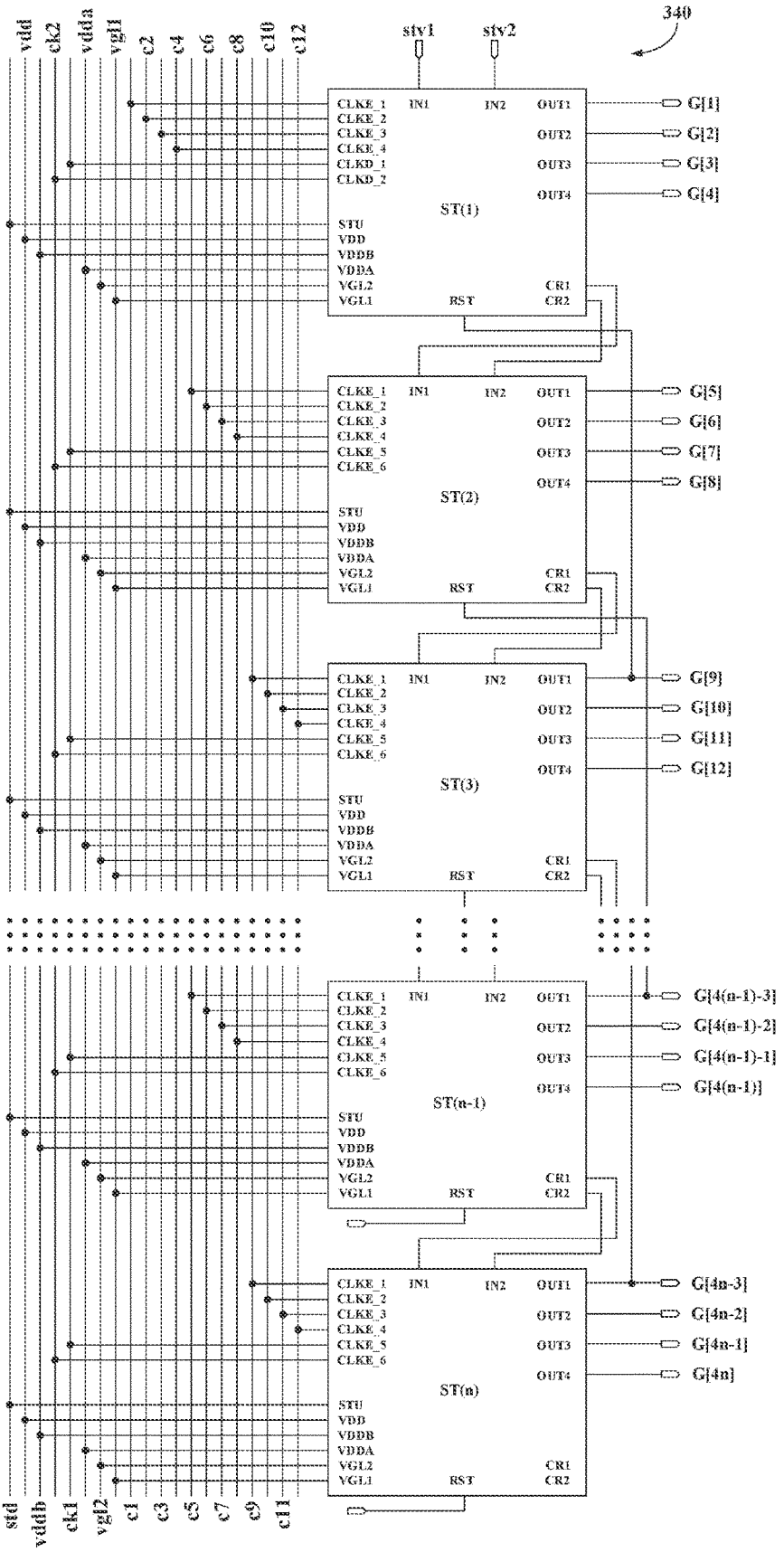
FIG. 23 schematically illustrates a gate driver according to another exemplary embodiment of the present disclosure.

Referring to FIG. 23, it schematically illustrates a gate driver 340 according to another exemplary embodiment of the present disclosure. The gate driver 340 includes n cascaded shift register unit circuits ST(1), ST(2), . . . , ST(n−1) and ST(n), each of which may take the form of the shift register unit circuit 150 as described above with respect to FIGS. 14 and 15, wherein n may be a positive integer greater than or equal to 3. Compared with FIG. 22, each of the shift register unit circuits ST(1), ST(2), . . . , ST(n−1) and ST(n) further includes a reset terminal STU and a fifth voltage terminal VDD, so that the reset terminal STU of each of the shift register unit circuits ST(1), ST(2), . . . , ST(n−1) and ST(n) may be connected to a reset pulse signal line stu operable for transmitting a reset pulse, and the fifth voltage terminal VDD thereof may be connected to a fifth voltage line vdd operable for transmitting a fifth voltage signal. In addition, each of the shift register unit circuits ST(1), ST(2), . . . , ST(n−1) and ST(n) in the gate driver 340 has the other signal terminals connected in the same manner as the corresponding signal terminals in each of the n shift register unit circuits SV(1), SV(2), . . . , SV(n−1) and SV(n) in the gate driver 330 shown in FIG. 22, so they will not be repeatedly described here.

Figure 24:
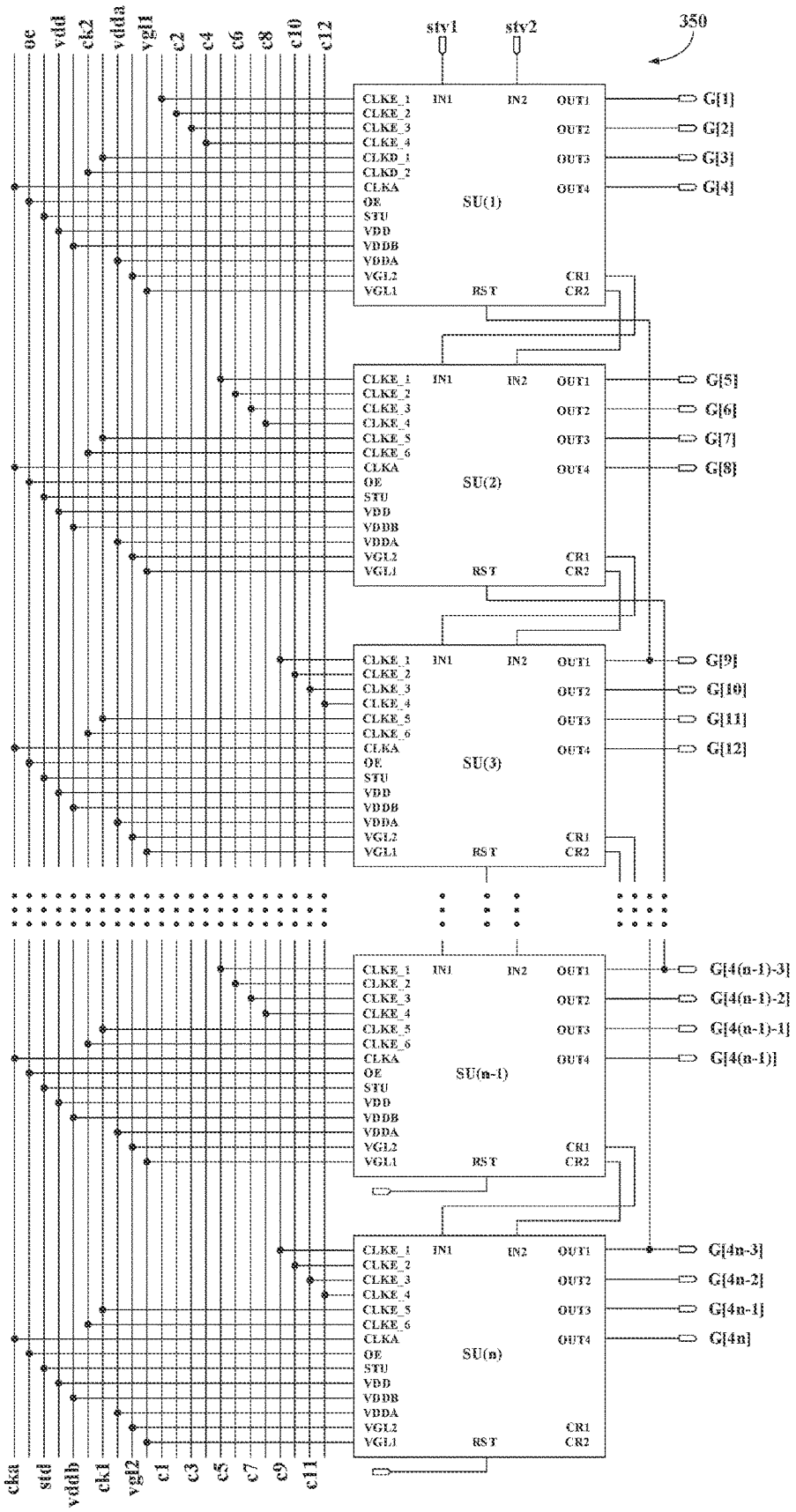
FIG. 24 schematically illustrates a gate driver according to another exemplary embodiment of the present disclosure.

Referring to FIG. 24, it schematically illustrates a gate driver 350 according to another exemplary embodiment of the present disclosure. The gate driver 350 includes n cascaded shift register unit circuits SU(1), SU(2), . . . , SU(n−1) and SU(n), each of which may take the form of the shift register unit circuit 160 as described above with respect to FIGS. 17 and 18, wherein n may be a positive integer greater than or equal to 3. Compared with FIG. 23, each of the shift register unit circuits SU(1), SU(2), . . . , SU(n−1)

and SU(n) further includes a detection control signal terminal OE and a detection pulse terminal CLKA, so that the detection control signal terminal OE of each of the shift register unit circuits SU(1), SU(2), . . . , SU(n−1) and SU(n) may be connected to a detection control signal line oe operable for transmitting a detection control signal, and the detection pulse terminal CLKA thereof may be connected to a detection pulse signal line cka operable for transmitting a detection pulse. In addition, each of the shift register unit circuits SU(1), SU(2), . . . , SU(n−1) and SU(n) in the gate driver 350 has the other signal terminals connected in the same manner as the corresponding signal terminals in each of the n shift register unit circuits ST(1), ST(2), . . . , ST(n−1) and ST(n) in the gate driver 340 shown in FIG. 23, so they will not be repeatedly described here.

Figure 25:
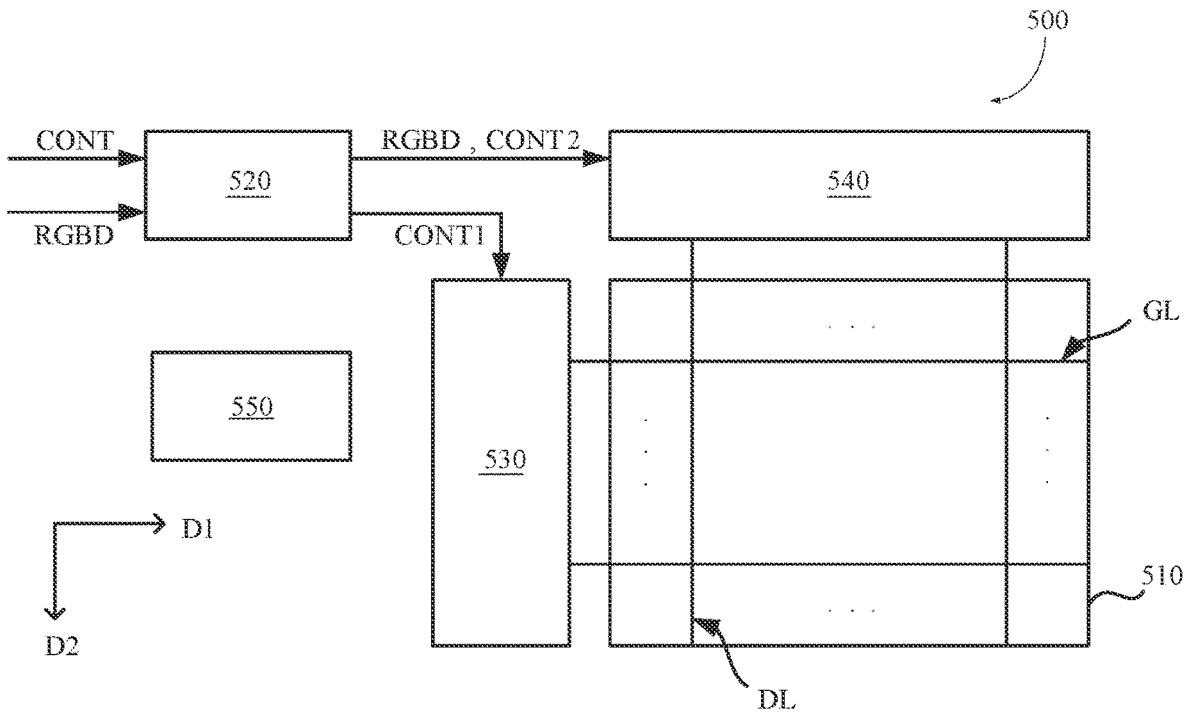
FIG. 25 schematically illustrates a display device including a gate driver according to an exemplary embodiment of the present disclosure.

FIG. 25 is a block diagram of a display device 500 according to an exemplary embodiment of the present disclosure. Referring to FIG. 25, the display device 500 may include a display panel 510, a timing controller 520, a gate driver 530, a data driver 540, and a voltage generator 550. The gate driver 530 may take the form of the gate driving circuit 310, 320, 330, 340, or 350 described above with respect to FIGS. 20 to 24, and the clock lines, voltage lines and control signal lines shown in FIGS. 20 to 24 are omitted in FIG. 25 for the convenience of illustration.

The display panel 510 is connected to a plurality of gate lines GL extending in a first direction D1 and a plurality of data lines DL extending in a second direction D2 that crosses (e.g., substantially perpendicular to) the first direction D1. The display panel 510 includes a plurality of pixels (not shown) arranged in an array. Each of the pixels may be electrically connected to a corresponding gate line in the gate lines GL and a corresponding data line in the data lines DL. The display panel 510 may be a liquid crystal display panel, an organic light emitting diode (OLED) display panel, or any other suitable type of display panel.

The timing controller 520 controls the operations of the display panel 510, the gate driver 530, the data driver 540 and the voltage generator 550. The timing controller 520 receives input image data RGBD and input control signal CONT from an external device (e.g., a host computer). The input image data RGBD may include a plurality of input pixel data for a plurality of pixels. Each input pixel data may include the red grayscale data R, the green grayscale data G and the blue grayscale data B for a corresponding one of the plurality of pixels. The input control signal CONT may include a master clock signal, a data enable signal, a vertical synchronization signal, a horizontal synchronization signal, etc. The timing controller 520 generates the output image data RGBD', the first control signal CONT1 and the second control signal CONT2 based on the input image data RGBD and the input control signal CONT. The implementation of the timing controller 520 is known in the art. The timing controller 520 can be implemented in a lot of ways (for example, using specialized hardwares) to perform the various functions discussed herein. A "processor" is an example of a timing controller 520 employing one or more microprocessors, wherein the microprocessors may be programmed using software (e.g., microcodes) to perform the various functions discussed herein. The timing controller 520 may be implemented with or without a processor, and may also be implemented as a combination of a specialized hardware to perform some functions and a processor to perform the other functions. Examples of timing controllers 520 include, but are not limited to, conventional microprocessors, application-specific integrated circuits (ASICs), and field-programmable gate arrays (FPGAs).

The gate driver 530 receives the first control signal CONT1 from the timing controller 520. The first control signal CONT1 may include various clock signals transmitted via the clock signal lines shown in FIGS. 20 to 24. The gate driver 530 generates a plurality of gate driving signals for outputting to the gate lines GL based on the first control signal CONT1. The gate driver 530 may sequentially apply the plurality of gate driving signals to the gate lines GL.

The data driver 540 receives the second control signal CONT2 and the output image data RGBD' from the timing controller 520. The data driver 540 generates a plurality of data voltages based on the second control signal CONT2 and the output image data RGBD'. The data driver 540 may apply the generated plurality of data voltages to the data lines DL.

The voltage generator 550 supplies power to the display panel 510, the timing controller 520, the gate driver 530, the data driver 540 and additional possible components. Specifically, the voltage generator 550 is configured to supply voltage signals transmitted via the various voltage lines shown in FIGS. 21 to 25, respectively, under the control of the timing controller 520. The configuration of the voltage generator 550 may be known in the art. In an exemplary implementation, the voltage generator 550 may comprise a voltage converter such as a DC/DC converter and a crossbar switch. The voltage converter generates a plurality of output voltages with different voltage levels from an input voltage. The crossbar switch may then selectively couple these output voltages to the various voltage lines shown in FIGS. 20 to 24 under the control of timing controller 520 in order to supply the requested voltage signals.

In various embodiments, the gate driver 530 and/or the data driver 540 may be provided on the display panel 510, or may be connected to the display panel 510 by means of, for example, a tape carrier package (TCP). For example, the gate driver 530 may be integrated into the display panel 510 as a gate driver on array (GOA) circuit.

Examples of a display device 500 include, but are not limited to, mobile phones, tablets, televisions, displays, laptops, digital photo frames, navigators.

Figure 26:
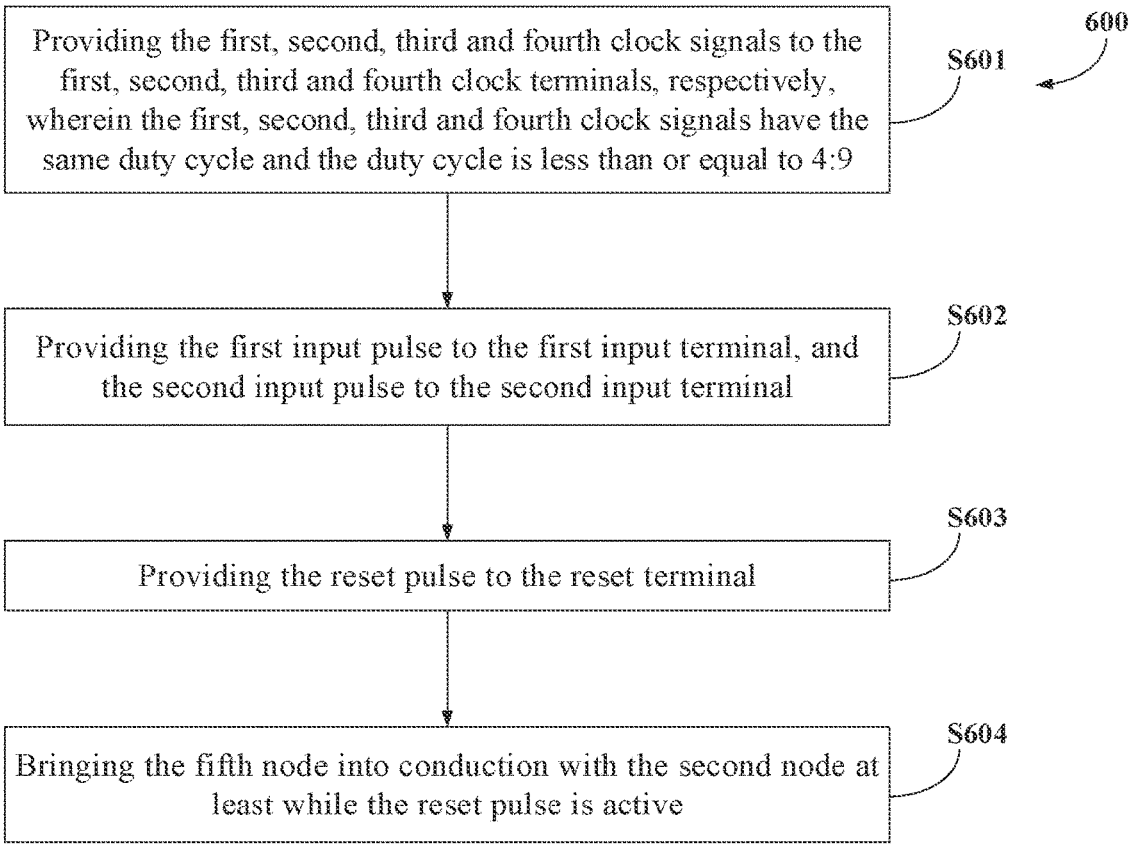
FIG. 26 schematically illustrates a method for driving the shift register unit circuits according to the exemplary embodiments of the present disclosure.

Referring now to FIG. 26, it illustrates a method 600 that may be used to drive a shift register unit circuit according to an exemplary embodiment of the present disclosure. The method 600 may include the following steps:

S601, providing the first, second, third and fourth clock signals to the first, second, third and fourth clock terminals, respectively, wherein the first, second, third and fourth clock signals have the same duty cycle and the duty cycle is less than or equal to 4:9;

S602, providing the first input pulse to the first input terminal, and the second input pulse to the second input terminal;

S603, providing the reset pulse to the reset terminal; and S604, bringing the fifth node into conduction with the second node at least while the reset pulse is active.

In some exemplary embodiments of the present disclosure, each clock signals has a duty cycle that may be 1:3.

The foregoing is a description of exemplary embodiments of the present disclosure, which should not be construed as limiting the scope of the present disclosure. A person of ordinary skill in the art may make several variations and modifications to the exemplary embodiments described without departing from the spirit of the present disclosure, and these variations and modifications should also be deemed to be covered by the scope of the present disclosure.

What is claimed is:

1. A shift register unit circuit comprising:

a first sub-unit circuit comprising:

a first sub-unit input circuit configured to, in response to a first input pulse received from a first input terminal being active, bring the first input terminal into conduction with a first node and a second node, and in response to the first input pulse being inactive, disconnect the first input terminal from the first node and the second node in conduction;

a first sub-unit output circuit configured to, in response to the first node being at an active potential, bring a first clock terminal configured to receive a first clock signal into conduction with a first output terminal configured to output a first output signal, and in response to the first node being at an inactive potential, disconnect the first clock terminal from the first output terminal in conduction; and a first sub-unit reset circuit configured to, in response to a reset pulse received from a reset terminal being active, bring the first node and the second node into conduction with a first voltage terminal configured to be applied with a first voltage signal, and in response to the reset pulse being inactive, disconnect the first node and the second node from the first voltage terminal in conduction;

a second sub-unit circuit comprising:

a second sub-unit input circuit configured to, in response to the first input pulse being active, bring the second node into conduction with a third node, and in response to the first input pulse being inactive, disconnect the second node from the third node in conduction;

a second sub-unit output circuit configured to, in response to the third node being at an active potential, bring a second clock terminal configured to receive a second clock signal into conduction with a second output terminal configured to output a second output signal, and in response to the third node being at an inactive potential, disconnect the second clock terminal from the second output terminal in conduction;

a second sub-unit reset circuit configured to, in response to the reset pulse being active, bring the third node into conduction with the second node, and in response to the reset pulse being inactive, disconnect the third node from the second node in conduction;

a third sub-unit circuit comprising:

a third sub-unit input circuit configured to, in response to a second input pulse received from a second input terminal being active, bring the second input terminal into conduction with a fourth node and a fifth node, and in response to the second input pulse being inactive, disconnect the second input terminal from the fourth node and the fifth node in conduction;

a third sub-unit output circuit configured to, in response to the fourth node being at an active potential, bring a third clock terminal configured to receive a third clock signal into conduction with a third output terminal configured to output a third output signal, and in response to the fourth node being at an inactive potential, disconnect the third clock terminal and the third output terminal in conduction;

a third sub-unit reset circuit configured to, in response to the reset pulse being active, bring the fourth node into conduction with the fifth node, and in response to the reset pulse being inactive, disconnect the fourth node from the fifth node in conduction; and a fourth sub-unit circuit comprising:

a fourth sub-unit input circuit configured to: in response to the second input pulse being active, bring the fifth node into conduction with a sixth node, and in response to the second input pulse being inactive, disconnect the fifth node from the sixth node in conduction;

a fourth sub-unit output circuit configured to: in response to the sixth node being at an active potential, bring a fourth clock terminal configured to receive a fourth clock signal into conduction with a fourth output terminal configured to output a fourth output signal, and in response to the sixth node being at an inactive potential, disconnect the fourth clock terminal from the fourth output terminal in conduction; and a fourth sub-unit reset circuit configured to: in response to the reset pulse being active, bring the sixth node into conduction with the fifth node, and in response to the reset pulse being inactive, disconnect the sixth node from the fifth node in conduction, wherein the fifth node is in conduction with the second node at least while the reset pulse is active.

2. The shift register unit circuit of claim 1, wherein the fifth node is connected with the second node by a wire.

3. The shift register unit circuit of claim 1, further comprising:

a conduction control circuit configured to, in response to at least one of the fourth node and the sixth node being at an active potential, bring the fifth node into conduction with the second node, and in response to both the fourth node and the sixth node being at an inactive potential, disconnect the fifth node from the second node in conduction.

4. The shift register unit circuit of claim 3, wherein the conduction control circuit comprises:

a sixteenth transistor having a first electrode connected to the second node, a second electrode connected to the fifth node and a control electrode connected to the fourth node; and a seventeenth transistor having a first electrode connected to the second node, a second electrode connected to the fifth node and a control electrode connected to the sixth node.

5. The shift register unit circuit of claim 1, further comprising:

a conduction control circuit configured to, in response to the fifth node being at an active potential, bring the fifth node into conduction with the second node, and in response to the fifth node being at an inactive potential, disconnect the fifth node from the second node in conduction.

6. The shift register unit circuit of claim 5, wherein the conduction control circuit comprises an eighteenth transistor having a first electrode connected to the second node, and having a second electrode and a control electrode both connected to the fifth node.

7. The shift register unit circuit of claim 1, wherein the first sub-unit input circuit comprises:

a first transistor having a first electrode and a control electrode both connected to the first input terminal, and a second electrode connected to the second node;

a second transistor having a first electrode connected to the second node, a second electrode connected to the first node, and a control electrode connected to the first input terminal, wherein the first sub-unit output circuit comprises:

a third transistor having a first electrode connected to the first clock terminal, a second electrode connected to the first output terminal, and a control electrode connected to the first node;

a first capacitor having a first electrode connected to the first node and a second electrode connected to the first output terminal, wherein the first sub-unit reset circuit comprises:

a fourth transistor having a first electrode connected to the first node, a second electrode connected to the second node, and a control electrode connected to the reset terminal;

a fifth transistor having a first electrode connected to the second node, a second electrode connected to the first voltage terminal, and a control electrode connected to the reset terminal, wherein the second sub-unit input circuit comprises a sixth transistor having a first electrode connected to the second node, a second electrode connected to the third node, and a control electrode connected to the first input terminal, wherein the second sub-unit output circuit comprises:

a seventh transistor having a first electrode connected to the second clock terminal, a second electrode connected to the second output terminal, and a control electrode connected to the third node;

a second capacitor having a first electrode connected to the third node and a second electrode connected to the second output terminal, the second sub-unit reset circuit comprises an eighth transistor having a first electrode connected to the third node, a second electrode connected to the second node, and a control electrode connected to the reset terminal, wherein the third sub-unit input circuit comprises:

a ninth transistor having a first electrode and a control electrode both connected to the second input terminal, and a second electrode connected to the fifth node;

a tenth transistor having a first electrode connected to the fifth node, a second electrode connected to the fourth node, and a control electrode connected to the second input terminal, wherein the third sub-unit output circuit comprises:

an eleventh transistor having a first electrode connected to the third clock terminal, a second electrode connected to the third output terminal, and a control electrode connected to the fourth node;

a third capacitor having a first electrode connected to the fourth node and a second electrode connected to the third output terminal, the third sub-unit reset circuit comprises a twelfth transistor having a first electrode connected to the fourth node, a second electrode connected to the fifth node, and a control electrode connected to the reset terminal, the fourth sub-unit input circuit comprises a thirteenth transistor having a first electrode connected to the fifth node, a second electrode connected to the sixth node, and a control electrode connected to the second input terminal, wherein the fourth sub-unit output circuit comprises:

a fourteenth transistor having a first electrode connected to the fourth clock terminal, a second electrode connected to the fourth output terminal, and a control electrode connected to the sixth node;

a fourth capacitor having a first electrode connected to the sixth node and a second electrode connected to the fourth output terminal, and wherein the fourth sub-unit reset circuit comprises a fifteenth transistor having a first electrode connected to the sixth node, a second electrode connected to the fifth node, and a control electrode connected to the reset terminal.

8. The shift register unit circuit of claim 7, wherein the first sub-unit circuit further comprises:

a first sub-unit transfer circuit configured to, in response to the first node being at an active potential, bring a first transfer clock terminal configured to receive a first transfer clock signal into conduction with a first transfer terminal configured to output a first transfer signal, and in response to the first node being at an inactive potential, disconnect the first transfer clock terminal from the first transfer terminal in conduction;

a first sub-unit first control circuit configured to:

when a third voltage terminal configured to be applied with a third voltage signal is at an active potential, in response to either of the first node and the fourth node being at an active potential, disconnect the third voltage terminal from a seventh node in conduction, and in response to the first node being at an active potential, bring the seventh node into conduction with the first voltage terminal, and in response to both the first node and the fourth node being at an inactive potential, disconnect the seventh node from the first voltage terminal in conduction and bring the seventh node into conduction with the third voltage terminal;

when the third voltage terminal is at an inactive potential, in response to the first node being at an active potential, bring the seventh node into conduction with the first voltage terminal, in response to the first node being at an inactive potential, disconnect the seventh node from the first voltage terminal in conduction;

a first sub-unit second control circuit configured to: in response to the seventh node being at an active potential, bring the first transfer terminal into conduction with the first voltage terminal and bring the first output terminal into conduction with a second voltage terminal configured to be applied with a second voltage signal, and in response to the seventh node being at an inactive potential, disconnect the first transfer terminal from the first voltage terminal in conduction, and disconnect the first output terminal from the second voltage terminal in conduction;

a first sub-unit third control circuit configured to, in response to the seventh node being at an active potential, bring the first node and the second node into conduction with the first voltage terminal, and in response to the seventh node being at an inactive potential, disconnect the first node and the second node from the first voltage terminal in conduction, wherein the second sub-unit circuit further comprises:

a second sub-unit first control circuit configured to, in response to the seventh node being at an active potential, bring the second output terminal into conduction with the second voltage terminal, and in response to the seventh node being at an inactive potential, disconnect the second output terminal from the second voltage terminal in conduction;

a second sub-unit second control circuit configured to, in response to the seventh node being at an active potential, bring the third node into conduction with the second node, and in response to the seventh node being at an inactive potential, disconnect the third node from the second node in conduction, wherein the third sub-unit circuit further comprises:

a third sub-unit transfer circuit configured to, in response to the fourth node being at an active potential, bring a second transfer clock terminal configured to receive a second transfer clock signal into conduction with a second transfer terminal configured to output a second transfer signal, and in response to the fourth node being at an inactive potential, disconnect the second transfer clock terminal from the second transfer terminal in conduction;

a third sub-unit first control circuit configured to, in response to the seventh node being at an active potential, bring the second transfer terminal into conduction with the first voltage terminal and bring the third output terminal into conduction with the second voltage terminal, and in response to the seventh node being at an inactive potential, disconnect the second transfer terminal from the first voltage terminal in conduction and disconnect the third output terminal from the second voltage terminal in conduction; and a third sub-unit second control circuit configured to, in response to the seventh node being at an active potential, bring the fourth node into conduction with the fifth node, and in response to the seventh node being at an inactive potential, disconnect the fourth node from the fifth node in conduction, and wherein the fourth sub-unit circuit further comprises:

a fourth sub-unit first control circuit configured to, in response to the seventh node being at an active potential, bring the fourth output terminal into conduction with the second voltage terminal, and in response to the seventh node being at an inactive potential, disconnect the fourth output terminal from the second voltage terminal in conduction; and a fourth sub-unit second control circuit configured to, in response to the seventh node being at an active potential, bring the fifth node into conduction with the sixth node, and in response to the seventh node being at an inactive potential, disconnect the fifth node from the sixth node in conduction.

9. The shift register unit circuit of claim 8, wherein the first sub-unit transfer circuit comprises a twenty-third transistor having a first electrode connected to the first transfer clock terminal, a second electrode connected to the first transfer terminal, and a control electrode connected to the first node, wherein the first sub-unit first control circuit comprises:

a twenty-fourth transistor having a first electrode connected to the third voltage terminal and a second electrode connected to the seventh node;

a twenty-fifth transistor having a first electrode and a control electrode both connected to the third voltage terminal;

a twenty-sixth transistor having a second electrode connected to the second voltage terminal and a control electrode connected to the fourth node;

a twenty-seventh transistor having a control electrode connected to the first node and a second electrode connected to the second voltage terminal; and a twenty-eighth transistor having a first electrode connected to the seventh node, a second electrode connected to the first voltage terminal, and a control electrode connected to the first node, wherein a control electrode of the twenty-fourth transistor, a second electrode of the twenty-fifth transistor, a first electrode of the twenty-sixth transistor and a first electrode of the twenty-seventh transistor are connected together, wherein the first sub-unit second control circuit comprises:

a nineteenth transistor having a first electrode connected to the first transfer terminal, a second electrode connected to the first voltage terminal, and a control electrode connected to the seventh node; and a twentieth transistor having a first electrode connected to the first output terminal, a second electrode connected to the second voltage terminal, and a control electrode connected to the seventh node, wherein the first sub-unit third control circuit comprises:

a twenty-first transistor having a first electrode connected to the first node, a second electrode connected to the second node, and a control electrode connected to the seventh node;

a twenty-second transistor having a first electrode connected to the second node, a second electrode connected to the first voltage terminal, and a control electrode connected to the seventh node, wherein the second sub-unit first control circuit comprises a twenty-ninth transistor having a first electrode connected to the second output terminal, a second electrode connected to the second voltage terminal, and a control electrode connected to the seventh node, wherein the second sub-unit second control circuit comprises a thirtieth transistor having a first electrode connected to the third node, a second electrode connected to the second node, and a control electrode connected to the seventh node, wherein the third sub-unit transfer circuit comprises a thirty-fourth transistor having a first electrode connected to the second transfer clock terminal, a second electrode connected to the second transfer terminal, and a control electrode connected to the fourth node, wherein the third sub-unit first control circuit comprises:

a thirty-first transistor having a first electrode connected to the second transfer terminal, a second electrode connected to the first voltage terminal, and a control electrode connected to the seventh node;

a thirty-second transistor having a first electrode connected to the third output terminal, a second electrode connected to the second voltage terminal, and a control electrode connected to the seventh node, wherein the third sub-unit second control circuit comprises a thirty-third transistor having a first electrode connected to the fourth node, a second electrode connected to the fifth node, and a control electrode connected to the seventh node, wherein the fourth sub-unit first control circuit comprises a thirty-sixth transistor having a first electrode connected to the fourth output terminal, a second electrode connected to the second voltage terminal, and a control electrode connected to the seventh node, and wherein the fourth sub-unit second control circuit comprises a thirty-fifth transistor having a first electrode connected to the sixth node, a second electrode connected to the fifth node, and a control electrode connected to the seventh node.

10. The shift register unit circuit of claim 9, further comprising:

a fourth voltage terminal configured to be applied with a fourth voltage signal, wherein the first sub-unit circuit further comprises:

a first sub-unit fourth control circuit configured to, in response to an eighth node being at an active potential, bring the first transfer terminal into conduction with the first voltage terminal and bring the first output terminal into conduction with the second voltage terminal, and in response to the eighth node being at an inactive potential, disconnect the first transfer terminal from the first voltage terminal in conduction and disconnect the first output terminal from the second voltage terminal in conduction;

a first sub-unit fifth control circuit configured to, in response to the eighth node being at an active potential, bring the first node and the second node into conduction with the first voltage terminal, and in response to the eighth node being at an inactive potential, disconnect the first node and the second node from the first voltage terminal in conduction;

wherein the second sub-unit circuit further comprises:

a second sub-unit third control circuit configured to, in response to the eighth node being at an active potential, bring the second output terminal into conduction with the second voltage terminal, and in response to the eighth node being at an inactive potential, disconnect the second output terminal from the second voltage terminal in conduction;

a second sub-unit fourth control circuit configured to, in response to the eighth node being at an active potential, bring the third node into conduction with the second node, and in response to the eighth node being at an inactive potential, disconnect the third node from the second node in conduction;

wherein the third sub-unit circuit further comprises:

a third sub-unit third control circuit configured to, when the fourth voltage terminal is at an active potential, in response to either of the first node and the fourth node being at an active potential, disconnect the fourth voltage terminal from the eighth node in conduction, in response to the fourth node being at an active potential, bring the eighth node into conduction with the first voltage terminal, and in response to both the first node and the fourth node being at an inactive potential, disconnect the eighth node from the first voltage terminal in conduction and bring the eighth node into conduction with the fourth voltage terminal, when the fourth voltage terminal is at an inactive potential, in response to the fourth node being at an active potential, bring the eighth node into conduction with the first voltage terminal, and in response to the fourth node being at an inactive potential, disconnect the eighth node from the first voltage terminal in conduction;

a third sub-unit fourth control circuit configured to: in response to the eighth node being at an active potential, bring the second transfer terminal into conduction with the first voltage terminal and bring the third output terminal into conduction with the second voltage terminal, and in response to the eighth node being at an inactive potential, disconnect the second transfer terminal from the first voltage terminal in conduction and disconnect the third output terminal from the second voltage terminal in conduction;

a third sub-unit fifth control circuit configured to: in response to the eighth node being at an active potential, bring the fourth node into conduction with the fifth node, and in response to the eighth node being at an inactive potential, disconnect the fourth node from the fifth node in conduction;

wherein the fourth sub-unit circuit further comprises:

a fourth sub-unit third control circuit configured to, in response to the eighth node being at an active potential, bring the fourth output terminal into conduction with the second voltage terminal, and in response to the eighth node being at an inactive potential, disconnect the fourth output terminal from the second voltage terminal in conduction;

a fourth sub-unit fourth control circuit configured to, in response to the eighth node being at an active potential, bring the fifth node into conduction with the sixth node, and in response to the eighth node being at an inactive potential, disconnect the fifth node from the sixth node in conduction.

11. The shift register unit circuit of claim 10, wherein the first sub-unit fourth control circuit comprises:

a thirty-seventh transistor having a first electrode connected to the first transfer terminal, a second electrode connected to the first voltage terminal, and a control electrode connected to the eighth node;

a thirty-eighth transistor having a first electrode connected to the first output terminal, a second electrode connected to the second voltage terminal, and a control electrode connected to the eighth node;

wherein the first sub-unit fifth control circuit comprises:

a thirty-ninth transistor having a first electrode connected to the first node, a second electrode connected to the second node, and a control electrode connected to the eighth node;

a fortieth transistor having a first electrode is connected to the second node, a second electrode connected to the first voltage terminal, and a control electrode connected to the eighth node, wherein the second sub-unit third control circuit comprises a forty-second transistor having a first electrode connected to the second output terminal, a second electrode connected to the second voltage terminal, and a control electrode connected to the eighth node, wherein the second sub-unit fourth control circuit comprises a forty-first transistor having a first electrode connected to the third node, a second electrode connected to the second node, and a control electrode connected to the eighth node, wherein the third sub-unit third control circuit comprises:

a forty-sixth transistor having a first electrode connected to the fourth voltage terminal and a second electrode connected to the eighth node;

a forty-seventh transistor having a first electrode and a control electrode both connected to the fourth voltage terminal;

a forty-eighth transistor having a second electrode connected to the second voltage terminal and a control electrode connected to the first node;

a forty-ninth transistor having a control electrode connected to the fourth node and a second electrode connected to the second voltage terminal;

a fiftieth transistor having a first electrode connected to the eighth node, a second electrode connected to the first voltage terminal, and a control electrode connected to the fourth node;

wherein a control electrode of the forty-sixth transistor, a second electrode of the forty-seventh transistor, a first electrode of the forty-eighth transistor, and a first electrode of the forty-ninth transistor are connected together, wherein the third sub-unit fourth control circuit comprises:

a forty-third transistor having a first electrode connected to the second transfer terminal, a second electrode connected to the first voltage terminal, and a control electrode connected to the eighth node;

a forty-fourth transistor having a first electrode connected to the third output terminal, a second electrode connected to the second voltage terminal, and a control electrode connected to the eighth node, wherein the third sub-unit fifth control circuit comprises a forty-fifth transistor having a first electrode connected to the fourth node, a second electrode connected to the fifth node, and a control electrode connected to the eighth node, wherein the fourth sub-unit third control circuit comprises a fifty-second transistor having a first electrode connected to the fourth output terminal, a second electrode connected to the second voltage terminal, and a control electrode connected to the eighth node, and wherein the fourth sub-unit fourth control circuit comprises a fifty-first transistor having a first electrode connected to the sixth node, a second electrode connected to the fifth node, and a control electrode connected to the eighth node.

12. The shift register unit circuit of claim 11, further comprising:

a fifth voltage terminal configured to be applied with a fifth voltage signal;

a reset terminal configured to receive a reset pulse;

wherein the first sub-unit circuit further comprises:

a first sub-unit sixth control circuit configured to: in response to the first node being at an active potential, bring the second node into conduction with the fifth voltage terminal, and in response to the first node being at an inactive potential, disconnect the second node from the fifth voltage terminal in conduction;

a first sub-unit seventh control circuit configured to: in response to the first input pulse being active, bring the seventh node into conduction with the first voltage terminal, and in response to the first input pulse being inactive, disconnect the seventh node from the first voltage terminal in conduction;

a first sub-unit reset circuit configured to: in response to the reset pulse being active, bring the first node and the second node into conduction with the first voltage terminal, and in response to the reset pulse being inactive, disconnect the first node and the second node from the first voltage terminal in conduction;

wherein the second sub-unit circuit further comprises a second sub-unit reset circuit configured to, in response to the reset pulse being active, bring the third node into conduction with the second node, and in response to the reset pulse being inactive, disconnect the third node from the second node in conduction;

wherein the third sub-unit circuit further comprises:

a third sub-unit sixth control circuit configured to, in response to the fourth node being at an active potential, bring the fifth node into conduction with the fifth voltage terminal, and in response to the fourth node being at an inactive potential, disconnect the fifth node from the fifth voltage terminal in conduction;

a third sub-unit seventh control circuit configured to, in response to the second input pulse being active, bring the eighth node into conduction with the first voltage terminal, and in response to the second input pulse being inactive, disconnect the eighth node from the first voltage terminal in conduction;

a third sub-unit reset circuit configured to, in response to the reset pulse being active, bring the fourth node into conduction with the fifth node, and in response to the reset pulse being inactive, disconnect the fourth node from the fifth node in conduction;

wherein the fourth sub-unit circuit further comprises a fourth sub-unit reset circuit configured to, in response to the reset pulse being active, bring the fifth node into conduction with the sixth node, and in response to the reset pulse being inactive, disconnect the fifth node from the sixth node in conduction.

13. The shift register unit circuit of claim 12, wherein the first sub-unit sixth control circuit comprises a fifty-fourth transistor having a first electrode connected to the fifth voltage terminal, a second electrode connected to the second node, and a control electrode connected to the first node, wherein the first sub-unit seventh control circuit comprises a fifty-third transistor having a first electrode connected to the seventh node, a second electrode connected to the first voltage terminal, and a control electrode connected to the first input terminal, wherein the first sub-unit reset circuit comprises:

a fifty-fifth transistor having a first electrode connected to the first node, a second electrode connected to the second node, and a control electrode connected to the reset terminal;

a fifty-sixth transistor having a first electrode connected to the second node, a second electrode connected to the first voltage terminal, and a control electrode connected to the reset terminal, wherein the second sub-unit reset circuit comprises a fifty-seventh transistor having a first electrode connected to the third node, a second electrode connected to the second node, and a control electrode connected to the reset terminal, wherein the third sub-unit sixth control circuit comprises a fifty-ninth transistor having a first electrode connected to the fifth voltage terminal, a second electrode connected to the fifth node, and a control electrode connected to the fourth node, wherein the third sub-unit seventh control circuit comprises a fifty-eighth transistor having a first electrode connected to the eighth node, a second electrode connected to the first voltage terminal, and a control electrode connected to the second input terminal, wherein the third sub-unit reset circuit comprises a sixtieth transistor having a first electrode connected to the fourth node, a second electrode connected to the fifth node, and a control electrode connected to the reset terminal, and wherein the fourth sub-unit reset circuit comprises a sixty-first transistor having a first electrode connected to the sixth node, a second electrode connected to the fifth node, and a control electrode connected to the reset terminal.

14. The shift register unit circuit of claim 13, further comprising:

a detection control signal terminal configured to be applied with a detection control pulse;

a detection pulse terminal configured to be applied with a detection pulse;

wherein the first sub-unit circuit further comprises:

a first sub-unit first detection control circuit configured to: in response to the detection control pulse being active, bring a ninth node into conduction with the first input terminal and the fifth voltage terminal, and in response to the detection control pulse being inactive, disconnect the ninth node from the first input terminal and the fifth voltage terminal in conduction;

a first sub-unit second detection control circuit configured to: in response to the ninth node being at an active potential and the detection pulse being active, bring the detection pulse terminal into conduction with the first node and the second node, and in response to the ninth node being at an inactive potential or the detection pulse being inactive, disconnect the detection pulse terminal from the first node and the second node in conduction;

a first sub-unit third detection control circuit configured to: in response to the detection pulse being active, bring the seventh node into conduction with the first voltage terminal, and in response to the detection pulse being inactive, disconnect the seventh node from the first voltage terminal in conduction;

wherein the second sub-unit circuit further comprises a second sub-unit detection control circuit configured to, in response to the detection pulse being active, bring the second node into conduction with the third node, in response to the detection pulse being inactive, disconnect the second node from the third node in conduction;

wherein the third sub-unit circuit further comprises:

a third sub-unit first detection control circuit configured to: in response to the detection control pulse being active, bring a tenth node into conduction with the second input terminal and the fifth voltage terminal, and in response to the detection control pulse being inactive, disconnect the tenth node from the second input terminal and the fifth voltage terminal in conduction;

a third sub-unit second detection control circuit configured to: in response to the tenth node being at an active potential and the detection pulse being active, bring the detection pulse terminal into conduction with the fourth node and the fifth node, and in response to the tenth node being at an inactive potential or the detection pulse being inactive, disconnect the detection pulse terminal from the fourth node and the fifth node in conduction;

a third sub-unit third detection control circuit configured to: in response to the detection pulse being active, bring the eighth node into conduction with the first voltage terminal, and in response to the detection pulse being inactive, disconnect the eighth node from the first voltage terminal in conduction;

wherein the fourth sub-unit circuit further comprises a fourth sub-unit detection control circuit configured to, in response to the detection pulse being active, bring the fifth node into conduction with the sixth node, and in response to the detection pulse being inactive, disconnect the fifth node from the sixth node in conduction.

15. The shift register unit circuit of claim 14, wherein the first sub-unit first detection control circuit comprises:

a sixty-third transistor having a first electrode connected to the first input terminal and a control electrode connected to the detection control signal terminal;

a sixty-fourth transistor having a second electrode connected to the ninth node and a control electrode connected to the detection control signal terminal;

a sixty-fifth transistor having a first electrode connected to the fifth voltage terminal and a control electrode connected to the ninth node;

a fifth capacitor having a second electrode connected to the first voltage terminal;

wherein a second electrode of the sixty-third transistor, a first electrode of the sixty-fourth transistor, a second electrode of the sixty-fifth transistor and a first electrode of the fifth capacitor are connected together, wherein the first sub-unit second detection control circuit comprises:

a sixty-sixth transistor having a first electrode connected to the detection pulse terminal and a control electrode connected to the ninth node;

a sixty-seventh transistor having a second electrode connected to the second node and a control electrode connected to the detection pulse terminal;

a sixty-eighth transistor having a first electrode connected to the second node, a second electrode connected to the first node, and a control electrode connected to the detect pulse terminal;

wherein a second electrode of the sixty-sixth transistor is connected with a first electrode of the sixty-seventh transistor, wherein the first sub-unit third detection control circuit comprises a sixty-second transistor having a first electrode connected to the seventh node, a second electrode connected to the first voltage terminal, and a control electrode connected to the detection pulse terminal, wherein the second sub-unit detection control circuit comprises a sixty-ninth transistor having a first electrode connected to the second node, a second electrode connected to the third node, and a control electrode connected to the detection pulse terminal;

wherein the third sub-unit first detection control circuit comprises:

a seventieth transistor having a first electrode connected to the second input terminal and a control electrode connected to the detection control signal terminal;

a seventy-first transistor having a second electrode connected to the tenth node and a control electrode connected to the detection control signal terminal;

a seventy-second transistor having a first electrode connected to the fifth voltage terminal and a control electrode connected to the tenth node;

a sixth capacitor having a second electrode connected to the first voltage terminal, wherein a second electrode of the seventieth transistor, a first electrode of the seventy-first transistor, a second electrode of the seventy-second transistor and a first electrode of the sixth capacitor are connected together, wherein the third sub-unit second detection control circuit comprises:

a seventy-third transistor having a first electrode connected to the detection pulse terminal and a control electrode connected to the tenth node;

a seventy-fourth transistor having a second electrode connected to the fifth node and a control electrode connected to the detection pulse terminal;

a seventy-fifth transistor having a first electrode connected to the fifth node, a second electrode connected to the fourth node, and a control electrode connected to the detection pulse terminal, wherein a second electrode of the seventy-third transistor is connected with a first electrode of the seventy-fourth transistor, wherein the third sub-unit third detection control circuit comprises a seventy-sixth transistor having a first electrode connected to the eighth node, a second electrode connected to the first voltage terminal, and a control electrode connected to the detection pulse terminal, wherein the fourth sub-unit detection control circuit comprises a seventy-seventh transistor having a first electrode connected to the fifth node, a second electrode connected to the sixth node, and a control electrode connected to the detection pulse terminal.

16. The shift register unit circuit of claim 15, wherein first to seventy-seventh transistors are N-type transistors.

17. A gate driver comprising N cascaded shift register unit circuits of claim 8, N being an integer greater than or equal to 3, wherein a first transfer terminal of an (m)th shift register unit circuit of the N shift register unit circuits is connected to a first input terminal of an (m+1)th shift register unit circuit, a second transfer terminal of the (m)th shift register unit circuit is connected to a second input terminal of the (m+1)th shift register unit circuit, wherein m is an integer and $1 \leq m < N$, and wherein a first output terminal or a first transfer terminal of a (n)th shift register unit circuit of the N shift register unit circuits is connected to a reset terminal of a (n−2)th shift register unit circuit, n being an integer and $2 < n \leq N$.

18. An OLED display device comprising a gate driver, wherein:

the gate driver comprises N cascaded shift register unit circuits of claim 14, N being an integer greater than or equal to 3, wherein a first transfer terminal of an (m)th shift register unit circuit of the N shift register unit circuits is connected to a first input terminal of an (m+1)th shift register unit circuit, and a second transfer terminal of the (m)th shift register unit circuit is connected to a second input terminal of the (m+1)th shift register unit circuit, m being an integer and $1 \leq m < N$, and wherein a first output terminal or a first transfer terminal of a (n)th shift register unit circuit of the N shift register unit circuits is connected to a reset terminal of a (n−2)th shift register unit circuit, n being an integer and $2 < n \leq N$.

19. A gate driver comprising N cascaded shift register unit circuits of claim 1, N being an integer greater than or equal to 3, wherein a first output terminal of an (m)th shift register unit circuit of the N shift register unit circuits is connected to a first input terminal of an (m+1)th shift register unit circuit, a third output terminal of the (m)th shift register unit circuit is connected to a second input terminal of the (m+1)th shift register unit circuit, m being an integer and $1 \leq m < N$, and wherein a first output terminal of a (n)th shift register unit circuit of the N shift register unit circuits is connected to a reset terminal of a (n−2)th shift register unit circuit, n being an integer and $2 < n \leq N$.

20. A method of driving a shift register unit circuit of claim 1, comprising:

supplying the first clock signal to the first clock terminal, supplying the second clock signal to the second clock terminal, supplying the third clock signal to the third clock terminal, and supplying the fourth clock signal to the fourth clock terminal, wherein the first clock signal, the second clock signal, the third clock signal, and the fourth clock signal have an identical duty cycle, and wherein the duty cycle is less than or equal to 4:9;

supplying the first input pulse to the first input terminal, and supplying the second input pulse to the second input terminal;

supplying the reset pulse to the reset terminal; and bringing the fifth node into conduction with the second node at least while the reset pulse is active.

* * * * *